US007205097B2

(12) United States Patent
Fukunaga et al.

(10) Patent No.: US 7,205,097 B2
(45) Date of Patent: Apr. 17, 2007

(54) LIQUID EJECTION HEAD AND METHOD OF PRODUCING THE SAME

(75) Inventors: Toshiaki Fukunaga, Kanagawa (JP); Isao Tsuruma, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 196 days.

(21) Appl. No.: 10/841,978

(22) Filed: May 10, 2004

(65) Prior Publication Data

US 2005/0024439 A1 Feb. 3, 2005

(30) Foreign Application Priority Data

May 9, 2003 (JP) ..... 2003-131061
Sep. 26, 2003 (JP) ..... 2003-334954
Sep. 30, 2003 (JP) ..... 2003-341696

(51) Int. Cl.
*B41J 2/06* (2006.01)

(52) U.S. Cl. ..... 430/320; 216/27

(58) Field of Classification Search ..... None
See application file for complete search history.

(56) References Cited

U.S. PATENT DOCUMENTS 6,158,844 A 12/2000 Murakami et al.
2004/0212661 A1* 10/2004 Tsuruma ..... 347/62

FOREIGN PATENT DOCUMENTS

JP 10-76664 A 3/1998
JP 10-138493 A 5/1998

* cited by examiner

*Primary Examiner*—John A. McPherson
(74) *Attorney, Agent, or Firm*—Sughrue Mion, PLLC

(57) ABSTRACT

The liquid ejection head ejects a solution, in which charged particles are dispersed, toward a counter electrode. The head has a head substrate, a solution guide member formed on a surface of the head substrate so as to protrude and include a sharp-pointed portion having a sharply pointed tip end, with the sharp-pointed portion being which is formed by inclined surfaces and having a cross section that is reduced as a distance to the tip end is decreased, and a solution supply path having a solution outflow opening through which the solution flows out to the neighborhood of the sharp-pointed portion so as to form a solution flow around the inclined surfaces. The solution flow is formed around the tip end of the sharp-pointed portion in a direction going across the inclined surface and a part of the solution flow is guided to the tip end and is ejected as a droplet by means of an electrostatic force.

5 Claims, 23 Drawing Sheets

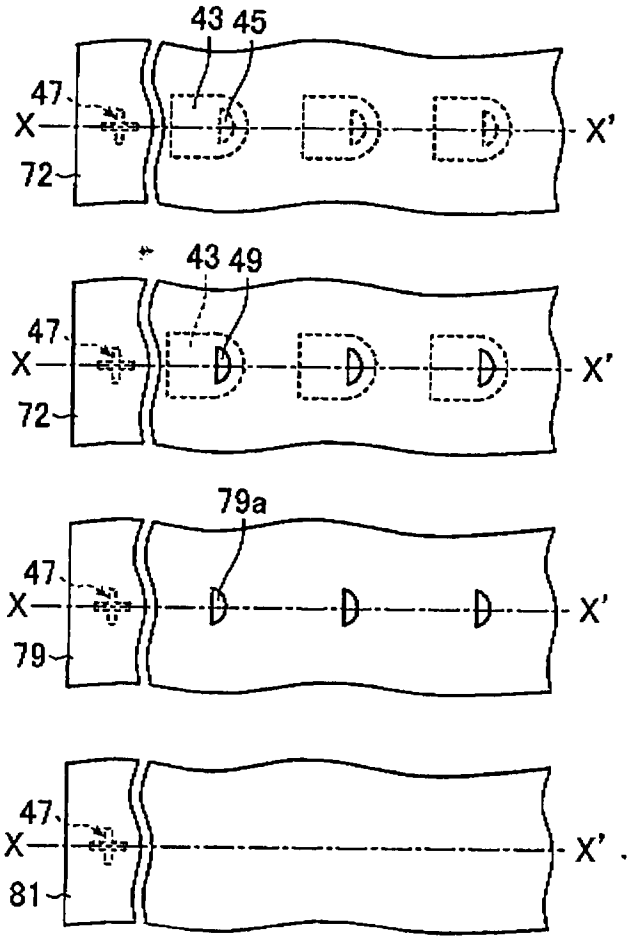
FIG. 4A
FIG. 4B
FIG. 4C
FIG. 4D
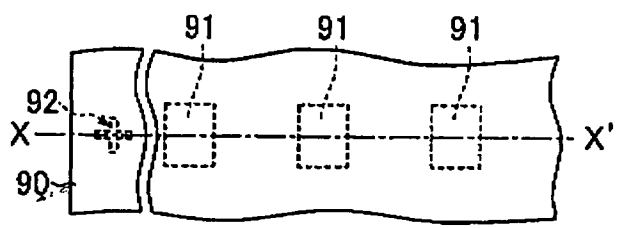
FIG. 4E
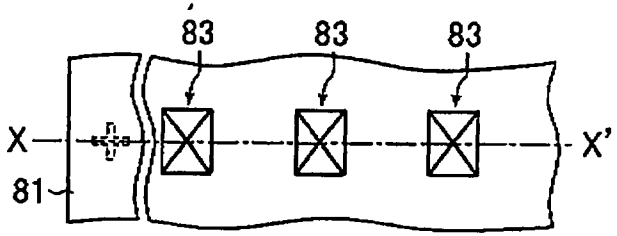
FIG. 4F
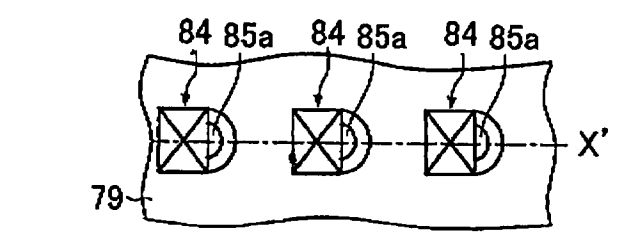
FIG. 4G
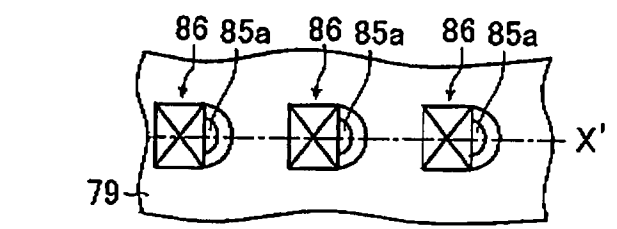
FIG. 4H

LIQUID EJECTION HEAD AND METHOD OF PRODUCING THE SAME

BACKGROUND OF THE INVENTION

1. Field of the Invention

The present invention relates to a liquid ejection head that ejects a solution, in which charged particles are dispersed in a solvent, by means of an electrostatic force and a method of producing the same.

2. Description of the Related Art

Nowadays, a thermal-type ink jet head that ejects an ink droplet by means of an expansive force of an air bubble generated in ink under heating and a piezoelectric type ink jet head that ejects an ink droplet by giving a pressure to ink using a piezoelectric element have been proposed. In the case of the thermal-type ink jet head, the ink is partially heated to 300° C. or higher, so that a problem arises in that a material for the ink is limited. Also, when using the piezoelectric type ink jet head, a problem occurs in that its construction is complicated and an increase in cost is inevitable. As an ink jet head that solves those problems, a liquid ejection head is proposed which ejects a solution, in which charged particles are dispersed, by means of an electrostatic force (see JP 10-76664 A, JP 10-138493 A, JP 11-105293 A, JP 10-230608 A, or JP 9-309208 A for instance).

FIGS. 23A and 23B are each a schematic structural diagram showing an example of a recording head of an image forming apparatus disclosed in JP 10-76664 A, with FIG. 23A being a schematic cross-sectional view of the recording head and FIG. 23B being a diagram where a protrusion plate 420 is viewed from the right side in FIG. 23A. In a recording head 400, one pair of support members 401 and 402 made of an insulative material and having an approximately rectangular plate shape are arranged so as to oppose each other. A gap between these support members 401 and 402 is set as a recording liquid supply path (ink supply path) 404 and a recording liquid outflow opening (ink outflow opening) 404*a* is obtained in end portions of the support members 401 and 402 on the upper side in this drawing, In the recording liquid supply path 404, a recording liquid 406 is allowed to flow in the upward direction in the drawing at a predetermined pressure and this liquid 406 flows out from the recording liquid outflow opening 404*a*. The recording liquid 406 is ink in which positively charged colorant particles 405 are dispersed. First electrodes 411 are formed on the inner surface of the recording liquid supply path 404 (one of both surfaces of each support member 401/402) so as to reach the recording liquid outflow opening 404*a*. A protrusion plate 420 that is an ink guide member having a protrusion 422 at its tip end is arranged in the recording liquid supply path 404 so that the protrusion 422 protrudes from the recording liquid outflow opening 404*a*. Also, second electrodes 412 are formed on the surfaces of the protrusion plate 420 in regions opposing the support members 401 and 402. Further, a counter electrode 430 is arranged on the upper side in the drawing, with this counter electrode 430 being grounded. Still further, a recording medium 408 is arranged on a surface of the counter electrode 430 opposing the protrusion 422.

In the recording head 400 having this construction, a part of the recording liquid 406 overflown through the recording liquid outflow opening 404*a* moves upwardly along the protrusion plate 420 in proximity to the recording liquid outflow opening 404*a* and a meniscus 440 is formed on a surface of the protrusion 422 by means of the supply pressure, surface tension, and the like of the recording liquid 406. On the other hand, the great majority of the recording liquid 406 overflown through the recording liquid outflow opening 404*a* flows along the support members 401 and 402 and returns to a recording liquid tank (not shown).

When a positive bias voltage is applied to the first electrode 411 and the second electrode 412 under a state where the meniscus 440 of the recording liquid is formed on the surface of the protrusion 422 in this manner, an electric field is formed between the first and second electrodes 411 and 412 and the counter electrode 430. The colorant particles 405 in the recording liquid 406 move upwardly in the recording liquid supply path 404 toward the tip end of the protrusion 422 by means of this electric field and gather in proximity to the tip end of the protrusion 422. When a voltage having a predetermined pulse width is superimposed on the bias voltage and is applied to the first electrode 411 and the second electrode 412 under this state, the electric field formed between the first and second electrodes 411 and 412 and the counter electrode 430 is strengthened and the colorant particles 405 in the meniscus 440 are pulled toward a counter electrode 430 side. In this manner, the recording liquid 406 containing the colorant particles 405 is ejected toward the counter electrode 430 as a droplet. In JP 10-76664 A, a droplet of the recording liquid 406 is ejected in this manner and the colorant particles 405 are caused to adhere onto the recording medium 408.

FIG. 24 is a conceptual diagram schematically showing an example of an outlined construction of an ink jet head of an ink jet recording apparatus disclosed in JP 10-138493 A. An ink jet head 500 shown in this drawing includes a head substrate 502, an ink guide 504, an insulative substrate 506, an ejection electrode 508, a counter electrode 510 supporting a recording medium P, a bias voltage supply 512, and a signal voltage supply 514. Note that in this drawing, only one individual electrode serving as an ejection means constituting the ink jet head disclosed in JP 10-138493 A is conceptually illustrated.

Here, the ink guide 504 is made of a resin flat plate having a predetermined thickness and including a convex tip end portion 504*a*, and is arranged on the head substrate 502. Also, in the insulative substrate 506, a through-hole 516 is established at a position corresponding to arrangement of the ink guide 504. The ink guide 504 passes through the through-hole 516 established in the insulative substrate 506 and its tip end portion 504*a* protrudes upwardly from the upper surface of the insulative substrate 506 in the drawing, that is, from a surface thereof on a recording medium P side. Also, the head substrate 502 and the insulative substrate 506 are arranged so as to be spaced apart from each other by a predetermined distance, and a flow path 518 of ink Q is formed between these substrates 502 and 506.

Further, the ejection electrode 508 is provided in a ring manner for each individual electrode on the upper surface of the insulative substrate 506 in the drawing to surround the periphery of the through-hole 516 established in the insulative substrate 506. The ejection electrode 508 is connected to the signal voltage supply 514 that generates a pulse signal corresponding to ejection data (ejection signal) such as image data or print data, and the signal voltage supply 514 is grounded through the bias voltage supply 512. Also, the counter electrode 510 is arranged at a position opposing the tip end portion 504*a* of the ink guide 504 and is grounded. Further, the recording medium P is arranged on the lower surface of the counter electrode 510 in the drawing, that is, on a surface thereof on an ink guide 504 side, and the counter electrode 510 functions as a platen of the recording medium P.

In the ink jet head 500 constructed in this manner, at the time of recording, ink containing a fine particle component charged to the same polarity as a voltage applied to the ejection electrode 508 is circulated by an ink circulation mechanism (not shown) in a predetermined direction (from the right to the left in the illustrated example) in the ink flow path 518, and a part of the ink Q in the ink flow path 518 is supplied to the tip end portion 504*a* of the ink guide 504 through the through-hole 516 in the insulative substrate 506 by a capillary phenomenon or the like.

Here, a predetermined high voltage (DC voltage of 1.5 kV, for instance) is constantly applied to the ejection electrode 508 by the bias voltage supply 512. Under this state, the strength of an electric field in proximity to the tip end portion 504*a* of the ink guide 504 is low and the ink Q supplied to the tip end portion 504*a* will not fly out from the tip end portion 504*a* of the ink guide 504. Under this state, however, a part of the ink Q in the ink flow path 518, in particular, the charged fine particle component further moves upwardly so as to exceed the upper surface of the insulative substrate 506 in the drawing by passing through the through-hole 516 in the insulative substrate 506 and gathers around the tip end portion 504*a* of the ink guide 504.

When a pulse voltage of DC 500 V or the like (ON-time; 0 V:OFF-time) is applied by the signal voltage supply 514 to the ejection electrode 508 biased to the high voltage (DC 1.5 kV) by the bias voltage supply 512, both of these high voltages are superimposed on each other and a voltage (2 kV, for instance) is applied to the ejection electrode 508. As a result, the ink Q, in particular, the charged fine particle component in the ink Q further moves upwardly along the ink guide 504 and gathers in the tip end portion 504*a*. Then, the ink Q gathered in the tip end portion 504*a* of the ink guide 504 in this manner and containing the charged fine particle component flies out from the tip end portion 504*a* by means of an electrostatic force, is attracted by the grounded counter electrode 510, and adheres onto the recording medium P. In this manner, a dot is formed by the charged fine particle component.

By forming dots of the charged fine particle component in this manner while relatively moving the ink jet head 500 and the recording medium P supported on the counter electrode 510, an image corresponding to image data is recorded on the recording medium P.

Also, JP 11-105293 A discloses an ink jet head where ink is caused to flow along a protrusion plate that is an ink guide member and a meniscus is formed at a protrusion of the protrusion plate. This protrusion plate is produced by molding an electrode base made of alumina and sharpening a tip end thereof through grinding.

Further, JP 10-230608 A discloses an ink jet head where an ink guide member having a sharp-pointed portion is set so as to protrude from a surface of an ink layer flowing in a direction approximately perpendicular to an ink droplet ejection direction, a guide groove for guiding the ink from the ink layer to a tip end of the sharp-pointed portion is formed in the ink guide member, and an ink droplet is ejected from the tip end of the ink guide member by utilizing an electrostatic force. This ink guide member is formed through molding of a plastic resin.

Also, JP 09-309208 A discloses an ink jet head where no ink guide member is provided and a meniscus having an approximately hemispherical shape is formed at an ink outflow opening by means of the pressure of ink flowing out from an ink supply path and the surface tension of the ink and an ink droplet is ejected by utilizing an electrostatic force.

In the case of such an ink jet head that ejects ink that is a recording liquid by means of an electrostatic force, in order to eject a small ink droplet, it is required to form a meniscus at a tip end of an ink guide member serving as an ink droplet ejection position as finely as possible. Also, in order to eject a droplet having a stabilized size and shape, it is required to maintain the shape of a meniscus as constant as possible. Further, in order to eject ink droplets having a stabilized shape and size at a high ejection frequency, it is required to speedily supply ink to an ink ejection position by an amount decreased by ink droplet ejection and to restore the shape of a meniscus to a pre-ink-ejection state immediately after the ink ejection. Also, in order to eject a liquid with high density and high definition uniformly, it is required to form a sharp-pointed portion at an end of an ink guide member serving as an ink droplet ejection position with high density and high definition.

However, in the case of the ink jet heads described in JP 10-7.6664 A and JP 11-105293 A where ink is caused to flow along a protrusion plate that is an ink guide member toward a sharp-pointed portion and a meniscus of the ink is formed at a tip end thereof, the meniscus greatly fluctuates due to fluctuations of an ink supply pressure. Therefore, there is a problem in that it is impossible to eject an ink droplet having a stabilized size with high position accuracy.

Also, for the method disclosed in JP 11-105293 A with which a protrusion plate that is an ink guide member is produced by sharpening a tip end of an alumina-made electrode base through grinding, there is a problem in that it is impossible to unlimitedly increase the accuracy of a sharp-pointed shape of the protrusion plate and the number of process steps is increased.

Further, in the ink jet head disclosed in JP 10-230608 A where a meniscus is formed at a tip end of a sharp-pointed portion serving as an ink droplet ejection position using ink that moves upwardly along an ink guide groove, the ink moves upwardly toward the sharp-pointed portion by utilizing a capillary phenomenon. Therefore, there is a problem in that a long time is taken by ink supply and it is impossible to successively eject ink droplets having a stabilized size and colorant component concentration at a high ejection frequency.

Also, with the conventional ink guide member production method based on molding of a plastic resin, there arises a problem in that at the time of pulling-out of a plastic resin from a mold, the plastic resin adheres to the mold and is broken, which makes it impossible to perform molding into a desired shape. Therefore, it is difficult to produce an ink guide member so as to be sharply pointed with high accuracy. Also, in this method, it is required to arrange multiple molded ink guide members on a substrate while increasing position accuracy. However, it is impossible to unlimitedly increase the arrangement/position accuracy of the ink guide members. Further, a large number of process steps are required for arrangement.

Also, in the ink jet head disclosed in JP 09-309208 A where an approximately hemispherical meniscus is formed at an ink outflow opening by means of the pressure of ink flowing out from the ink outflow opening and the surface tension of the ink without providing an ink guide member, it is required to reduce the size of the ink outflow opening in order to form a fine meniscus. However, it is impossible to reduce the size of the ink outflow opening from a certain size because it is required to prevent ink clogging. Also, the shape of the meniscus greatly fluctuates due to fluctuations of the pressure of the ink flowing out from the ink outflow opening. For these reasons, there is a problem in that it is impossible to eject a minute ink droplet with stability.

SUMMARY OF THE INVENTION

The present invention has been made in order to solve the problems described above and has an object to provide a liquid ejection head that is capable of ejecting, by means of an electrostatic force, a liquid as droplets having a minute diameter with high density and stability at a high ejection frequency as compared with a conventional liquid ejection head. Also, the present invention has another object to provide a liquid ejection head production method with which it is possible to produce the liquid ejection head with high accuracy while achieving high productivity.

In order to attain the above objects, according to a first aspect of the present invention, there is provided a liquid ejection head that ejects a solution, in which charged particles are dispersed, toward a counter electrode, comprising:

a head substrate;

a solution guide member formed on a surface of the head substrate so as to protrude and include a sharp-pointed portion having a sharply pointed tip end, with the sharp-pointed portion being formed by at least one of inclined surfaces and having a cross section that is reduced as a distance to the tip end is decreased; and a solution supply path having a solution outflow opening through which the solution flows out to the neighborhood of the sharp-pointed portion so as to form a solution flow around the inclined surfaces of the solution guide member, wherein the solution flow is formed around the tip end of the sharp-pointed portion in a direction going across the inclined surfaces and a part of the solution flow is guided to the tip end and is ejected as a droplet by means of an electrostatic force.

The solution supply path is preferably formed by a solution guide member through-hole formed in a direction from a base portion of the solution guide member to the sharp-pointed portion.

Preferably, the liquid ejection head further comprises a conductive film formed on a surface of the solution guide member in a region including at least the sharp-pointed portion.

Preferably, the liquid ejection head further comprises:

a plate-shaped insulative substrate provided so as to be spaced apart from the head substrate, with the insulative substrate having an insulative substrate through-hole at a predetermined position and the sharp-pointed portion of the solution guide member passing through and protruding from the insulative substrate through-hole;

a drive electrode provided on one of surfaces of the insulative substrate on a side, where the sharp-pointed portion protrudes, so as to surround the sharp-pointed portion; and a shield electrode that is grounded and provided on the other of the surfaces of the insulative substrate.

It is preferable that the solution guide member through-hole is connected with a head substrate through-hole formed in the head substrate on which the solution guide member is provided, and that the solution is supplied from a surface of the head substrate on a side opposite to the surface of the head substrate, on which the solution guide member is provided, and passes through the head substrate through-hole.

According to a second aspect of the present invention, there is also provided a method for producing a liquid ejection head that ejects a solution, in which charged particles are dispersed, toward a counter electrode, comprising:

a head substrate;

a solution guide member formed on a surface of the head substrate so as to protrude and include a sharp-pointed portion having a sharply pointed tip end, with the sharp-pointed portion being formed by at least one of inclined surfaces and having a cross section that is reduced as a distance to the tip end is decreased; and a solution supply path having a solution outflow opening through which the solution flows out to the neighborhood of the sharp-pointed portion so as to form a solution flow around the inclined surfaces of the solution guide member, wherein the solution flow is formed around the tip end of the sharp-pointed portion in a direction going across the inclined surfaces and a part of the solution flow is guided to the tip end and is ejected as a droplet by means of an electrostatic force, wherein the solution supply path is formed by a solution guide member through-hole formed in a direction from a base portion of the solution guide member to the sharp-pointed portion, and wherein the solution guide member through-hole is connected with a head substrate through-hole formed in the head substrate on which the solution guide member is provided, and the solution is supplied from a surface of the head substrate on a side opposite to the surface of the head substrate, on which the solution guide member is provided, and passes through the head substrate through-hole, the method comprising the steps of:

forming a photosensitive resin layer on the head substrate having the head substrate through-hole;

molding a convex portion forming the sharp-pointed portion on a surface of the photosensitive resin layer in proximity to the head substrate through-hole by pressing a mold substrate against the surface of the photosensitive resin layer;

exposing and photosensitizing the photosensitive resin layer in one of (i) a region corresponding to at least a part of the convex portion and a peripheral portion surrounding the head substrate through-hole of the head substrate and (ii) a region except for at least the corresponding region; and developing the photosensitized photosensitive resin layer to form the solution guide member on the head substrate and the solution guide member through-hole that is connected with the head substrate through-hole and forms the solution supply path.

According to a third aspect of the present invention, there is also provided a liquid ejection head that ejects a solution, in which charged particles are dispersed, toward a counter electrode, comprising:

a first substrate arranged so as to be spaced apart from the counter electrode by a predetermined distance;

a protrusion portion formed integrally with the first substrate and protruding from the first substrate toward the counter electrode;

a solution guide formed on an upper surface, which is a protrusion end, of the protrusion portion opposing the counter electrode so as to protrude from the upper surface toward the counter electrode and have a tip end portion that is sharply pointed, with the solution guide being formed by at least one of inclined surfaces so as to have a cross section that is reduced as a distance to the tip end portion is decreased, and the solution flowing around the inclined surfaces as a solution flow being guided to the tip end portion and being ejected as a droplet by means of an electrostatic force; and a second substrate provided with a control electrode for exerting the electrostatic force and having a through-hole for arrangement of the solution guide, wherein the second substrate is abutted against, bonded to, and supported by a part of the upper surface of the protrusion portion, at least the tip end portion of the solution guide passes through the through-hole and protrudes on a counter electrode side from a surface of the second substrate on a side opposing the counter electrode, at least the tip end portion of the solution guide is made of a single crystal material, and the tip end portion is sharply pointed by forming the inclined surfaces through anisotropic wet etching.

It is preferable that a plurality of through-holes are established in the second substrate, and that a plurality of solution guides are arranged so that tip end portions of the solution guides respectively pass through the through-holes and protrude on the counter electrode side.

It is preferable that the tip end portion of the solution guide has inclined surfaces formed by a high-order crystalline plane and is sharply pointed.

A tip end angle of the tip end portion of the solution guide is preferably set at 60° or less.

A radius of curvature of the tip end portion of the solution guide is preferably set at 4 μm or less.

Preferably, the liquid ejection head further comprises a solution supply path having a solution supply opening for supplying the solution to the neighborhood of the solution guide so that the solution flow is formed around the inclined surfaces of the solution guide, and the solution supply path is formed by a protrusion portion through-hole formed in a direction from a base portion of the protrusion portion to the upper surface.

It is preferable that the protrusion portion through-hole is connected to a first substrate through-hole formed in the first substrate provided with the protrusion portion, that a solution inflow opening is established in a surface of the first substrate on a side opposite to the surface on which the protrusion portion is provided, and that the solution is supplied from the solution inflow opening and passes through the first substrate through-hole.

Preferably, the liquid ejection head further comprises a solution recovery path having a solution recovery opening for recovering the solution forming the solution flow around the inclined surfaces of the solution guide from the neighborhood of the solution guide; the solution recovery opening is formed by a gap between an inner wall of the through-hole established in the second substrate and the upper surface of the protrusion portion; and the solution recovery path is formed by a gap between the first substrate and the second substrate.

According to a fourth aspect of the present invention, there is also provided a method for producing a liquid ejection head including a first substrate, a protrusion portion that protrudes from the first substrate and has a protrusion end forming an upper surface, a solution guide that is made of a single crystal material on the upper surface and ejects a solution guided to a sharply pointed tip end portion as a droplet by means of an electrostatic force, and a second substrate that has a through-hole, in which the solution guide is provided so as to protrude from a substrate surface, is joined to the upper surface, and is fixed to and supported by the protrusion portion, the method comprising the steps of:

producing a first head member through processing of an insulative substrate so that a convex portion forming the protrusion portion is formed on a plate-shaped substrate, with the convex portion having an upper surface at a protrusion end;

joining the upper surface of the convex portion to a single crystal substrate and integrating the first head member with the single crystal substrate;

producing a sharp-pointed portion forming the solution guide at a predetermined position on the upper surface of the convex portion by performing anisotropic wet etching of the single crystal substrate; and aligning a second head member forming the second substrate, which has a through-hole established at a predetermined position, with a predetermined position so that the sharp-pointed portion passes through the through-hole, and joining and fixing a surface of the second head member to the upper surface of the protrusion portion.

The sharp-pointed portion forming the solution guide is preferably produced at the predetermined position on the upper surface of the convex portion by forming projections and depressions in a surface of the single crystal substrate through anisotropic dry etching and then performing anisotropic wet etching of the projection of the single crystal substrate.

It is preferable that a plurality of sharp-pointed portions that each form the solution guide are produced through anisotropic wet etching of the single crystal substrate, that the second head member forming the second substrate and having a plurality of through-holes at predetermined positions is aligned with the predetermined position so that the sharp-pointed portions respectively pass through the through-holes, and that the surface of the second head member is joined and fixed to the upper surface of the protrusion portion.

According to a fifth aspect of the present invention, there is also provided a liquid ejection head that ejects a solution containing charged particles onto a recording medium by utilizing an electrostatic force, comprising:

a head substrate;

an insulative substrate positioned on the head substrate and having an ejection opening for ejecting the solution; and a solution guide member formed on the head substrate and including a tip end portion protruding through the ejection opening of the insulative substrate, wherein a control electrode, to which a voltage for controlling the ejection of the solution is to be applied, is formed in the tip end portion of the solution guide member, and a through-hole passing through the head substrate in a thickness direction and a recovery groove for recovering the solution from the ejection opening are formed in the head substrate, with the through-hole communicating with the ejection opening and a space defined by the recovery groove and the insulative substrate also communicating with the ejection opening.

The solution guide member has preferably a shape that is narrowed as a distance to a tip end thereof is decreased.

A tip end angle of the tip end portion of the solution guide is preferably set at 60° or less.

A radius of curvature of the tip end portion of the solution guide is preferably set at 4 μm or less.

The solution guide member is preferably made of Si.

A shield electrode is preferably formed on at least one of surfaces of the insulative substrate.

A plurality of ejection openings and a plurality of solution guide members, which respectively protrude through the ejection openings, are preferably formed and arranged in a two-dimensional array manner.

According to a sixth aspect of the present invention, there is also provided a method for producing a liquid ejection head that ejects a solution containing charged particles onto a recording medium by utilizing an electrostatic force, comprising:

a head substrate;

an insulative substrate positioned on the head substrate and having an ejection opening for ejecting the solution; and a solution guide member formed on the head substrate and including a tip end portion protruding through the ejection opening of the insulative substrate, wherein a control electrode, to which a voltage for controlling the ejection of the solution is to be applied, is formed in the tip end portion of the solution guide member, and a through-hole passing through the head substrate in a thickness direction and a recovery groove for recovering the solution from the ejection opening are formed in the head substrate, with the through-hole communicating with the ejection opening and a space defined by the recovery groove and the insulative substrate also communicating with the ejection opening, the method comprising the steps of:

forming the solution guide member through anisotropic etching; and forming an electrode in the tip end portion of the solution guide member.

In the liquid ejection head according to the first aspect of the present invention, the solution is caused to flow out from the immediate neighborhood of the sharp-pointed portion at the tip end of the solution guide member, so that it becomes possible to swiftly supply the solution containing the charged particles to the extreme top portion of the solution guide member that is a droplet ejection position. Also, the flowing Solution forms the solution flow going across a part of the inclined surface of the sharp-pointed portion and a part of the solution flow is guided to the extreme top portion of the solution guide member and forms a meniscus, so that it becomes possible to form the meniscus with stability without being influenced by fluctuations of the pressure of the flowing solution. As a result, it becomes possible to eject a minute droplet with stability at a high frequency from the extreme top portion of the solution guide member whose tip end has been sharply pointed.

Also, the solution guide member through-hole formed in the solution guide member in a height direction along a liquid ejection direction from the head substrate surface to the sharp-pointed portion is set as the solution supply path, so that it becomes possible to cause the solution to flow out from the immediate neighborhood of the extreme top portion that is a solution ejection position. As a result, it becomes possible to swiftly form Stabilized meniscus, which makes it possible to eject a minute droplet with stability at a high frequency from the extreme top portion of the solution guide member whose tip end has been sharply pointed. Also, the solution supply path is formed in the solution guide member, so that it becomes possible to reduce the cross section of the solution guide member and to arrange multiple solution guide members on the head substrate with high density. As a result, it becomes possible to eject minute droplets with high density.

Further, the conductive film is formed on a surface of the solution guide member in a region including at least the sharp-pointed portion, so that a strong electric field is generated at the extreme top portion, which makes it possible to eject the solution from the extreme top portion at a relatively low voltage.

Also, in the liquid ejection head according to the first aspect of the present invention, the plate-shaped insulative substrate is provided so as to be spaced apart from the head substrate and the sharp-pointed portion of the solution guide member protrudes through the insulative substrate through-hole established in the insulative substrate. In addition, the drive electrode for forming an electric field acting on the charged particles in the meniscus is provided on one of the surfaces of the insulative substrate on a side where the sharp-pointed portion protrudes, and the shield electrode is provided on the other of the surfaces of the insulative substrate so as to oppose the drive electrode. With this construction, it becomes possible to prevent a situation where an electric field generated in a direction opposite to an advancing direction of the solution is exerted on the charged particles in the solution supply path, which makes it possible to cause the solution containing a stabilized concentration of the charged particles to flow out from the solution outflow opening and to stabilize the concentration of the charged particles in the meniscus. As a result, it becomes possible to eject a droplet having a stabilized concentration and size from the extreme top portion.

Also, the solution guide member through-hole is connected with the head substrate through-hole formed in the head substrate and the solution is supplied from a surface of the head substrate on an side opposite to a surface thereof, on which the solution guide member is provided, and passes through the head substrate through-hole, so that it becomes possible to supply the solution containing a stabilized concentration of the charged particle to each solution guide member through-hole at a stabilized pressure. Therefore, the solution containing the stabilized concentration of the charged particles flows out from the solution outflow opening and the concentration of the charged particles in the meniscus is stabilized. As a result, it becomes possible to eject a droplet having a stabilized concentration and size from the extreme top portion.

With the liquid ejection head production method according to the second aspect of the present invention, the photosensitive resin layer is formed on the head substrate and the convex portion, whose extreme top portion has been sharply pointed, is formed on a surface of the photosensitive resin layer by pressing the separately produced mold substrate against the surface of the photosensitive resin layer and the solution guide member is formed by partially photosensitizing and developing the photosensitive resin layer so that a region including the convex portion is left as a part of the solution guide member. Therefore, it becomes possible to arrange and form solution guide members, whose tip ends have been molded as sharp-pointed portions using the mold substrate, with high density and high accuracy as compared with a conventional liquid ejection head production method. As a result, it becomes possible to produce a liquid ejection head that is capable of ejecting a solution as small droplets with high density and high accuracy as compared with a conventional case. Also, it becomes possible to simplify the process steps as compared with the conventional production method and to suppress the occurrence of defective shapes of the solution guide members. As a result, it becomes possible to produce the liquid ejection head with high productivity as compared with the conventional production method. Also, the solution guide member is formed using a photolithography method, so that it becomes possible to freely design the shape of the solution guide member and to produce solution guide members having various shapes. As a result, it becomes possible to produce a liquid ejection head including a solution guide member having a shape corresponding to the application purpose of the liquid ejection head and the characteristics of a solution to be ejected.

In the case of the liquid ejection head according to the third aspect of the present invention, it is possible to simultaneously produce, through anisotropic wet etching of a semiconductor microprocessing technique, multiple liquid ejection heads that each has the construction where the solution guide with the tip end portion having been sharply pointed to a high degree is provided on the upper surface of the protrusion portion protruding from the first substrate toward the counter electrode (on a surface of the protrusion portion opposing the counter electrode) with high position accuracy and high shape accuracy. Therefore, it becomes possible to produce, at low cost, a liquid ejection head that is capable of ejecting a droplet with stability at a low ejection voltage.

Also, in the liquid ejection head according to the third aspect of the present invention, the second substrate provided with the control electrode is abutted against and jointed to the upper surface of the protrusion portion. With this construction, position displacements between the solution guide and the control electrode due to warpage of the second substrate are prevented from occurring and variations of a droplet ejection voltage ascribable to the position displacements are also prevented from occurring. As a result, it becomes possible to eject the solution from respective stabilized surfaces of meniscuses formed at multiple solution guides with stability at a low ejection voltage.

In the liquid ejection head produced with the liquid ejection head production method according to the fourth aspect of the present invention, the solution is caused to flow out from the immediate neighborhood of the solution guide and therefore it is possible to swiftly supply the solution containing the charged particles to the tip end portion of the solution guide that is a droplet ejection position. Also, in this liquid ejection head, the flowing solution forms the solution flow going across a part of the inclined surface of the sharp-pointed portion and a part of the solution flow is guided to the extreme tip end portion of the solution guide member and forms a meniscus, so that it becomes possible to form the meniscus with stability while preventing the influences of fluctuations of the pressure of the flowing solution. Therefore, it becomes possible to eject a minute droplet with stability at a high ejection frequency from the sharply pointed tip end portion of the solution guide.

In the liquid ejection head according to the fifth aspect of the present invention, the control electrode for causing the liquid to fly is directly provided in the tip end portion of the solution guide member, so that it becomes possible to cause the solution to fly from the tip end portion of the solution guide member with reliability.

Also, in the liquid ejection head according to the fifth aspect of the present invention, the control electrode is directly provided in the tip end portion of the solution guide member, so that it becomes possible to generate an electric field so as to be concentrated around the tip end portion of the solution guide member, which suppresses a voltage required to eject the solution and also reduces a drive voltage of the liquid ejection head. As a result, in an ink jet recording apparatus provided with this liquid ejection head, it becomes possible to use an inexpensive IC having a low withstand voltage as compared with a conventional case, which makes it possible to realize size reduction and cost reduction of the ink jet recording apparatus.

Further, in a conventional liquid ejection head, a solution guide and an ejection electrode are respectively produced on and supported by different substrates, which leads to a danger that position displacements between the solution guide and the ejection electrode occur due to warpage of the substrates and the like and variations occur in solution ejection. In contrast to this, in the liquid ejection head according to the fifth aspect of the present invention, the control electrode is provided in the tip end portion of the solution guide member and is integrated therewith, so that it becomes possible to reduce the occurrence of variations in ejection phenomenon due to the position displacements between the solution guide and the ejection electrode.

Also, in the liquid ejection head according to the fifth aspect of the present invention, the solution guide member is formed between a through-hole, through which the solution flows into the ejection opening formed in the insulative substrate, and the recovery groove for recovering the solution flowing into the ejection opening. With this construction, after passing through the through-hole and flowing into the ejection opening while surrounding the side wall of the solution guide member protruding through the ejection opening, the solution flows into the recovery groove formed on a side opposite to the through-hole with respect to the solution guide member. That is, in the liquid ejection head according to the fifth aspect of the present invention, the solution flows into the ejection opening from the immediate neighborhood of the solution guide member, so that it becomes possible to swiftly supply the solution containing the charged particles to the extreme top portion of the solution guide member that is a droplet ejection position. Also, the flowing solution forms the solution flow going across a part of the inclined surface of the solution guide member and a part of the solution flow is guided to the extreme top portion of the solution guide member and forms a meniscus, so that it becomes possible to form the meniscus with stability without being influenced by fluctuations of the pressure of the flowing solution. As a result, it becomes possible to eject a minute droplet with stability at a high ejection frequency from the extreme top portion of the solution guide member whose tip end has been sharply pointed.

Also, in the liquid ejection head according to the fifth aspect of the present invention, the shield electrode is provided on at least one of surfaces of the insulative substrate arranged on the head substrate. At this time, the shield electrode is positioned between the control electrode, to which a voltage for ejecting the liquid is applied, and the through-hole formed in the head substrate for supplying the solution to the ejection opening of the insulative substrate. With this construction, an electric field generated from the control electrode and directed in a direction opposite to the advancing direction of the solution does not act on the charged particles in the through-hole and the solution containing a stabilized concentration of the charged particles flows out from the solution outflow opening, so that the concentration of the charged particles in the meniscus is stabilized. As a result, it becomes possible to eject a droplet having a stabilized concentration and size from the extreme top portion.

Also, when multiple ejection openings are established in the insulative substrate and multiple ink guide members are formed so as to respectively protrude from the ejection openings, the shield electrode is also capable of suppressing electrical interaction between control electrodes formed at the tip ends of those ink guide members. In addition, the shield electrode is further capable of shielding an electric field generated from wiring connected to the control electrode.

With the liquid ejection head production method according to the sixth aspect of the present invention, it is possible to produce a very sharply pointed solution guide member with ease through anisotropic wet etching and to simultaneously produce multiple liquid ejection heads where such a solution guide member is provided on a head substrate with high position accuracy and high shape accuracy using a semiconductor microprocessing technique. Therefore, it becomes possible to produce, at low cost, a liquid ejection head that is capable of ejecting a solution as a small droplet at a low ejection voltage with high density and stability. Also, it becomes possible to simplify process steps as compared with a conventional production method and to suppress the defective shape of the solution guide member. Therefore, it becomes possible to produce a liquid ejection head with high productivity as compared with the conventional production method.

Also, the solution guide member may be formed using a photolithography method, which makes it possible to freely design the shape of the solution guide member and to produce solution guide members having various shapes. As a result, it becomes possible to produce a liquid ejection head using a solution guide member having a shape corresponding to the application purpose of the liquid ejection head and the characteristics of a solution to be ejected.

BRIEF DESCRIPTION OF THE DRAWINGS

In the accompanying drawings:

FIGS. 4A to 4H are each an explanatory diagram of an ink guide member production method according to a first embodiment of the liquid ejection head production method of the present invention;

DETAILED DESCRIPTION OF THE PREFERRED EMBODIMENTS

A liquid ejection head and a production method thereof according to the present invention will now be described based on embodiments illustrated in the accompanying drawings.

<First Embodiment>

Figure 1:
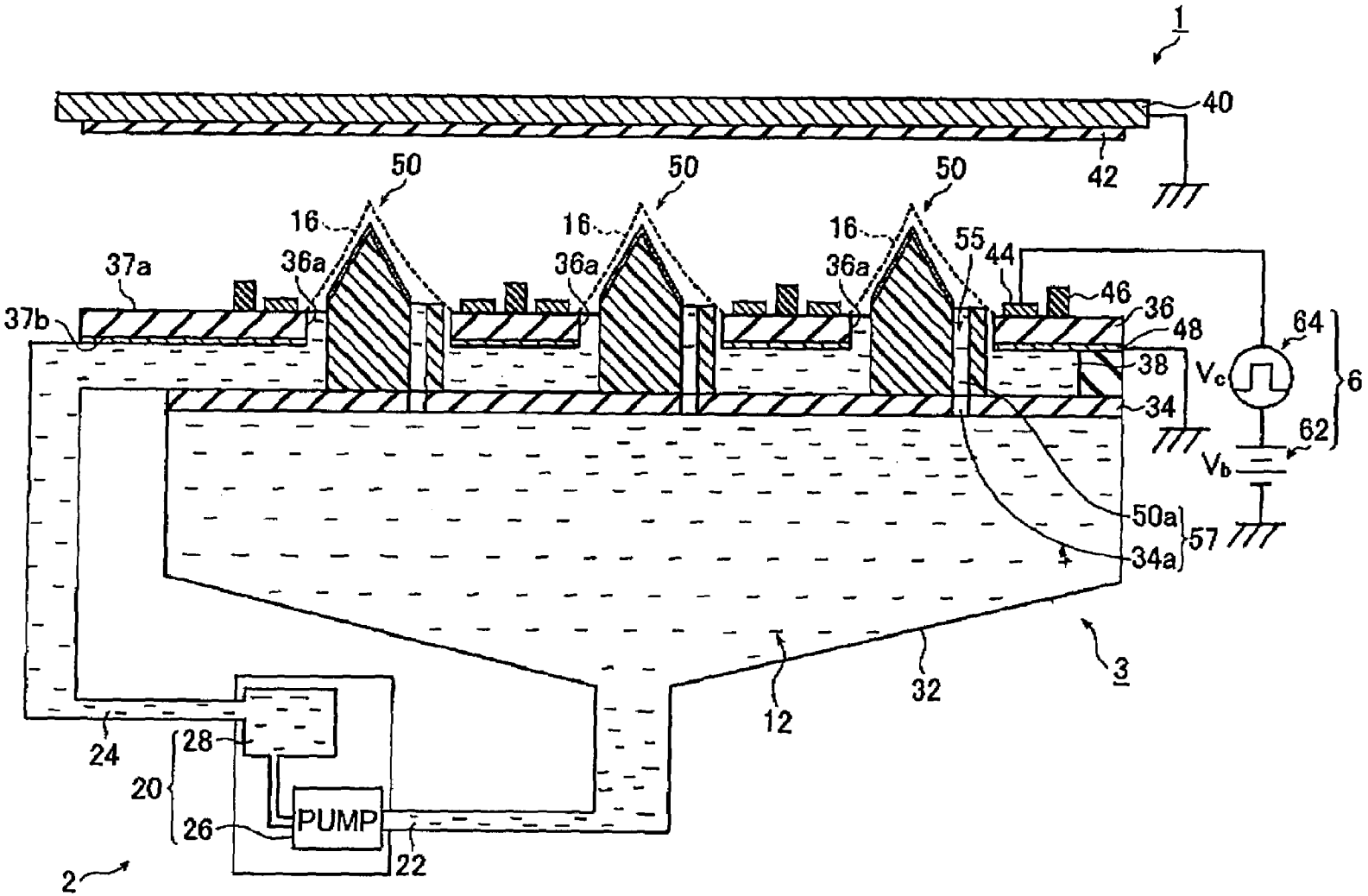
FIG. 1 is a schematic structural diagram of an ink ejection head according to a first embodiment of the liquid ejection head of the present invention.

FIG. 1 is a schematic structural diagram of an ink ejection apparatus 1 provided with an ink ejection head 3 that is a first embodiment of the liquid ejection head according to the present invention. As shown in FIG. 1, the ink ejection apparatus 1 includes an ink reflux unit 2, the ink ejection head 3, and a power supply unit 6.

The ink reflux unit 2 includes an ink circulation device 20, an ink supply pipe 22, and an ink recovery pipe 24, with the ink circulation device 20 including an ink pump 26 and an ink tank 28.

In the ink circulation device 20, the ink pump 26 and the ink tank 28 are connected to each other. Also, the ink pump 26 is connected to the ink ejection head 3 through the ink supply pipe 22. Further, the ink tank 28 is connected to the ink ejection head 3 through the ink recovery pipe 24.

The ink ejection head 3 includes an ink accommodation chamber 32, a head substrate 34, an insulative substrate 36, an ink recovery path 38, a counter electrode 40, drive electrodes 44, separation barriers 46, a shield electrode 48, and ink guide members 50. Also, a recording medium 42, on which a predetermined image or the like is to be recorded by an ejected liquid, is placed on the counter electrode 40.

The ink accommodation chamber 32 is an approximately rectangular-shaped space for containing ink and is connected to the ink supply pipe 22, with a wall surface of the ink accommodation chamber 32 on the upper side in FIG. 1 being formed by a substrate surface of the head substrate 34. The head substrate 34 is an insulative substrate, such as a glass substrate, and head substrate through-holes 34*a* are established in the head substrate 34 at predetermined positions so as to pass through the head substrate 34 in the vertical direction in FIG. 1. Above the head substrate 34 in FIG. 1, the insulative substrate 36 is arranged parallel to the head substrate 34 with a predetermined distance in-between. Also, above the insulative substrate 36 in FIG. 1, the grounded counter electrode 40 is arranged so as to oppose the insulative substrate 36 with a predetermined instance in-between, with the recording medium 42, such as recording paper, being placed on a surface of the counter electrode 40 opposing the insulative substrate 36. A gap between the insulative substrate 36 and the head substrate 34 forms the ink recovery path 38 and this ink recovery path 38 is connected to the ink recovery pipe 24 as shown in FIG. 1. Circular insulative substrate through-holes 36*a* passing through the insulative substrate 36 in the vertical direction in FIG. 1 are established in the insulative substrate 36. On a surface 37*a* (first surface) of the insulative substrate 36 opposing the counter electrode 40, the ring-shaped drive electrodes 44 made of a metal are provided so as to surround the peripheries of the insulative substrate through-holes 36*a* and the separation barriers 46, whose surfaces have ink repellency, are provided so as to surround the drive electrodes 44. Also, on a surface 37*b* (second surface) of the insulative substrate 36 opposing the head substrate 34, the grounded shield electrode 48 is arranged. At positions corresponding to the head substrate through-holes 34*a* on a surface of the head substrate 34 on a side opposing the insulative substrate 36, the ink guide members 50 are provided so as to partially protrude from the insulative substrate through-holes 36*a*.

Figure 2A:
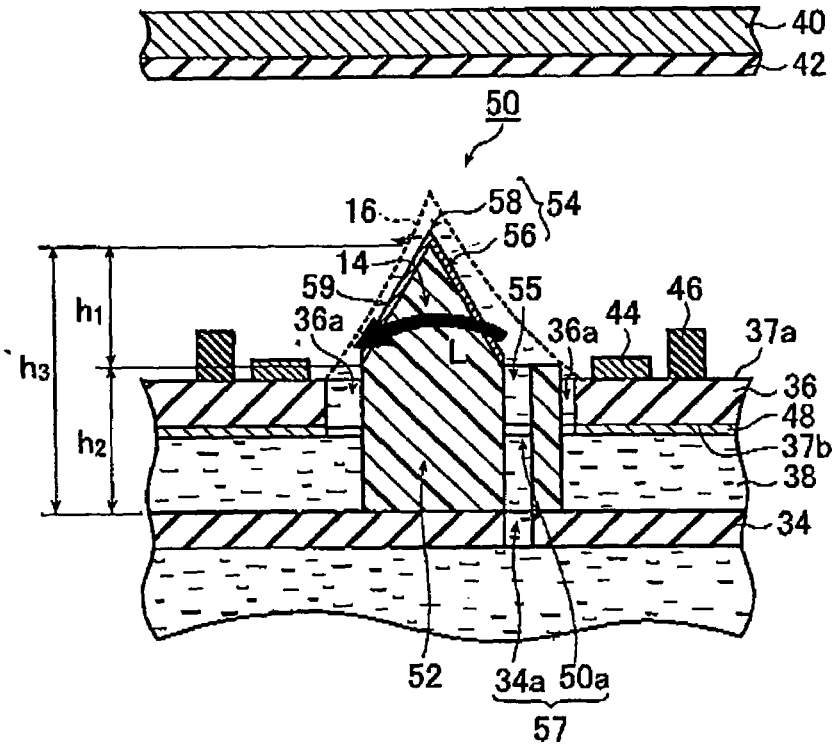
FIGS. 2A and 2B are each an explanatory diagram of one of multiple ink guide members of the ink ejection head shown in FIG. 1.
Figure 2B:
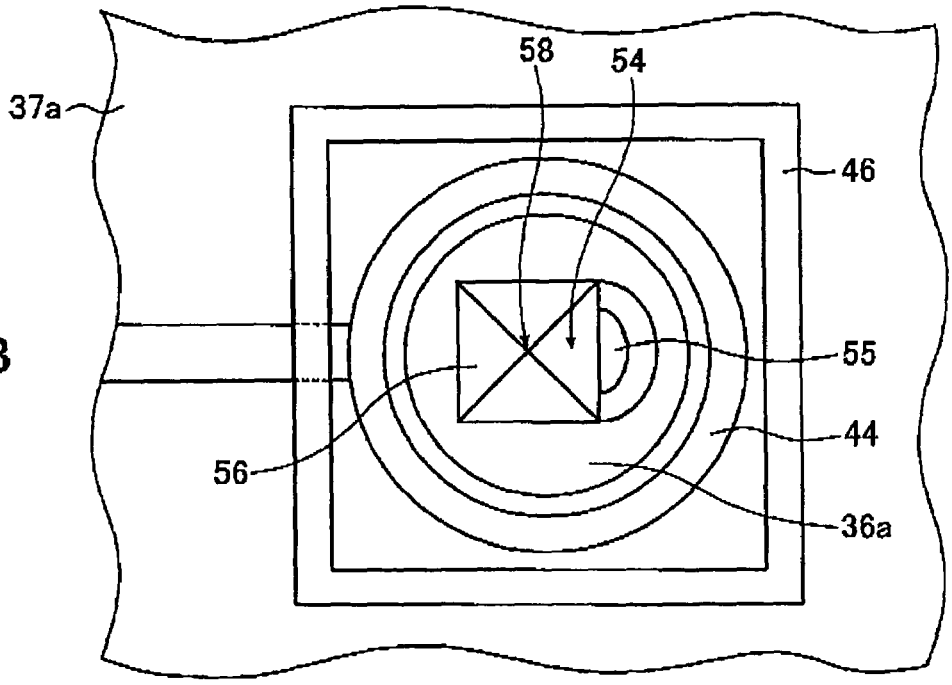

FIGS. 2A and 2B are each an explanatory diagram of one of the multiple ink guide members 50 shown in FIG. 1. In more detail, FIG. 2A is a schematic cross-sectional view where the ink guide member 50 and the periphery of this ink guide member 50 are enlarged and illustrated, while FIG. 2B is a schematic plan view where the ink guide member 50 and the periphery of this ink guide member 50 are enlarged and illustrated.

As shown in FIGS. 2A and 2E, the ink guide member 50 includes an ink guide member trough hole 50*a*, a base portion 52, a sharp-pointed portion 54, and a conductive film 59.

In FIG. 2A, the ink guide member 50 is provided on a surface of the head substrate 34 opposing the insulative substrate 36 so as to protrude upwardly. Also, the based portion 52 has a height of $h_2$ and its side surfaces are formed approximately perpendicular to the head substrate 34. In the base portion 52, the ink guide member through-hole 50*a* is formed in a protruding direction of the ink guide member 50 (vertical direction in FIG. 2A). At one end of this ink guide member through-hole 50*a*, an ink outflow opening 55 is formed in a portion of the base portion 52 having a height $h_2$ from the head substrate 34. Also, the other end of the ink guide member through-hole 50*a* is connected to the head substrate through-hole 34*a* and forms an ink supply path 57.

The sharp-pointed portion 54 is provided on the upper surface of the base portion 52 in FIG. 2A in proximity to the ink outflow opening 55 and includes inclined surfaces 56 and an extreme top portion 58. The sharp-pointed portion 54 has an approximately pyramid shape with a height of $h_1$ and its side surfaces are formed by the triangular inclined surfaces 56. Also, the extreme top portion 58 that is a tip end is sharply pointed. Further, the conductive film 59 made of a metallic layer is formed on the surface of the sharp-pointed portion 54. Above the head substrate 34 in FIG. 2A, the insulative substrate 36 is arranged parallel to the head substrate 34 with a predetermined distance in-between. The circular insulative substrate through-hole 36*a* passing through the insulative substrate 36 in the vertical direction in FIG. 1 is established in the insulative substrate 36 and a portion of the ink guide member 50 including at least the sharp-pointed portion 54 protrudes from this insulative substrate through-hole 36*a*. As shown in FIG. 2B, the insulative substrate 36 is adjusted in position and is arranged so that the center of the insulative substrate through-hole 36*a* approximately coincides with the extreme top portion 58 of the ink guide member 50 when viewed from the upper side in FIG. 2A.

The power supply unit 6 includes a bias power supply 62 and a drive power supply 64, with the drive power supply 64 being connected to a signal output means (not shown). The bias power supply 62 and the drive power supply 64 are connected to each drive electrode 44 of the ink ejection head 3 provided on the surface 37*a* of the insulative substrate 36 through wiring (not shown) made of a metal. With this construction, the bias power supply 62 constantly applies a bias voltage Vb to every drive electrode 44 constituting the ink ejection head 3. On the other hand, the drive power supply 64 superimposes a drive voltage Vc that is a pulse voltage on the bias voltage Vb and applies a resultant voltage to a desired drive electrode 44 in accordance with a signal inputted from the signal output means (not shown).

In the ink reflux unit 2, a predetermined amount of ink 12 is reserved in the ink tank 28. This ink 12 is a solution where positively charged particles are dispersed in a colloid manner in an insulative solvent having a resistivity of $10^8$ Ωcm or more together with a charge control agent, a binder, and the like and are floated in the solvent. In the ink tank 28, the concentrations of the charged particles, the charge control agent, the binder, and the like in the insulative solvent of the ink 12 are constantly adjusted so as to fall within predetermined concentration ranges by a concentration adjustment mechanism (not shown). The ink 12 adjusted in concentration by the concentration adjustment mechanism (not shown) in the ink tank 28 is supplied from the ink pump 26 to the ink accommodation chamber 32 of the ink ejection head 3 through the ink supply pipe 22 at a predetermined pressure. The ink 12 in the ink accommodation chamber 32 passes through the respective head substrate through-holes 34*a* and ink guide member through-holes 50*a* and is supplied to the respective ink guide members 50.

The ink 12 supplied from the ink accommodation chamber 32 to the ink guide members 50 by the action of the ink pump 26 flows through the ink supply paths 57 formed by the head substrate through-holes 34*a* and the ink guide member through-holes 50*a* in the upward direction in FIG. 2A and flows out from the ink outflow opening 55. At this time, the supply pressure of the ink 12 by the ink pump 26 is adjusted so that an ink flow 14 is formed with which the ink 12 flown out from the ink outflow opening 55 goes across the inclined surfaces 56 around the extreme top portion 58 (flow in the direction of arrow L in FIG. 2A), passes through the insulative substrate through-hole 36*a*, and flows into the ink recovery path 38.

A part of the ink 12 is guided to the extreme top portion 58 of the ink guide member 50 by means of the surface tension of the ink 12 when going across the inclined surfaces 56. The ink 12 guided to the extreme top portion 58 forms a meniscus 16 covering at least the extreme top portion 58 of the sharp-pointed portion 54 as indicated by the dotted line in FIG. 2A. At this time, the meniscus 16 is mainly formed by the surface tension of the ink 12 and is formed in a stabilized shape that is hardly influenced by minute fluctuations of the supply pressure of the ink 12 ascribable to the pulsatory motions of the ink pump 26 or the like. Also, the meniscuses 16 formed on the surfaces of adjacent ink guide members 50 are prevented from being connected with each other and are separated from each other by the separation barriers 46 provided on the insulative substrate 36. In the ink ejection apparatus 1, the ink 12 containing a constant concentration of the charged particles is constantly supplied to the extreme top portions 58 of the respective ink guide members 50 and the meniscuses 16 are formed in the manner described above.

On the other hand, the great majority of the ink 12 supplied to the respective ink guide members 50 does not form the meniscuses 16. Such a portion of the ink not forming the meniscuses passes through the insulative substrate through-holes 36*a*, flows into the ink recovery path 38, and returns to the ink tank 28. The ink 12 returned to the ink tank 28 is adjusted in concentration again in this tank 28 and is sent again from the ink pump 26 into the ink accommodation chamber 32 through the ink supply pipe 22 at a predetermined pressure. That is, the ink ejection head 3 according to the present invention is constructed so as to be constantly supplied with the ink 12 containing a constant concentration of the charged particles by the ink reflux unit 2.

Figure 3:
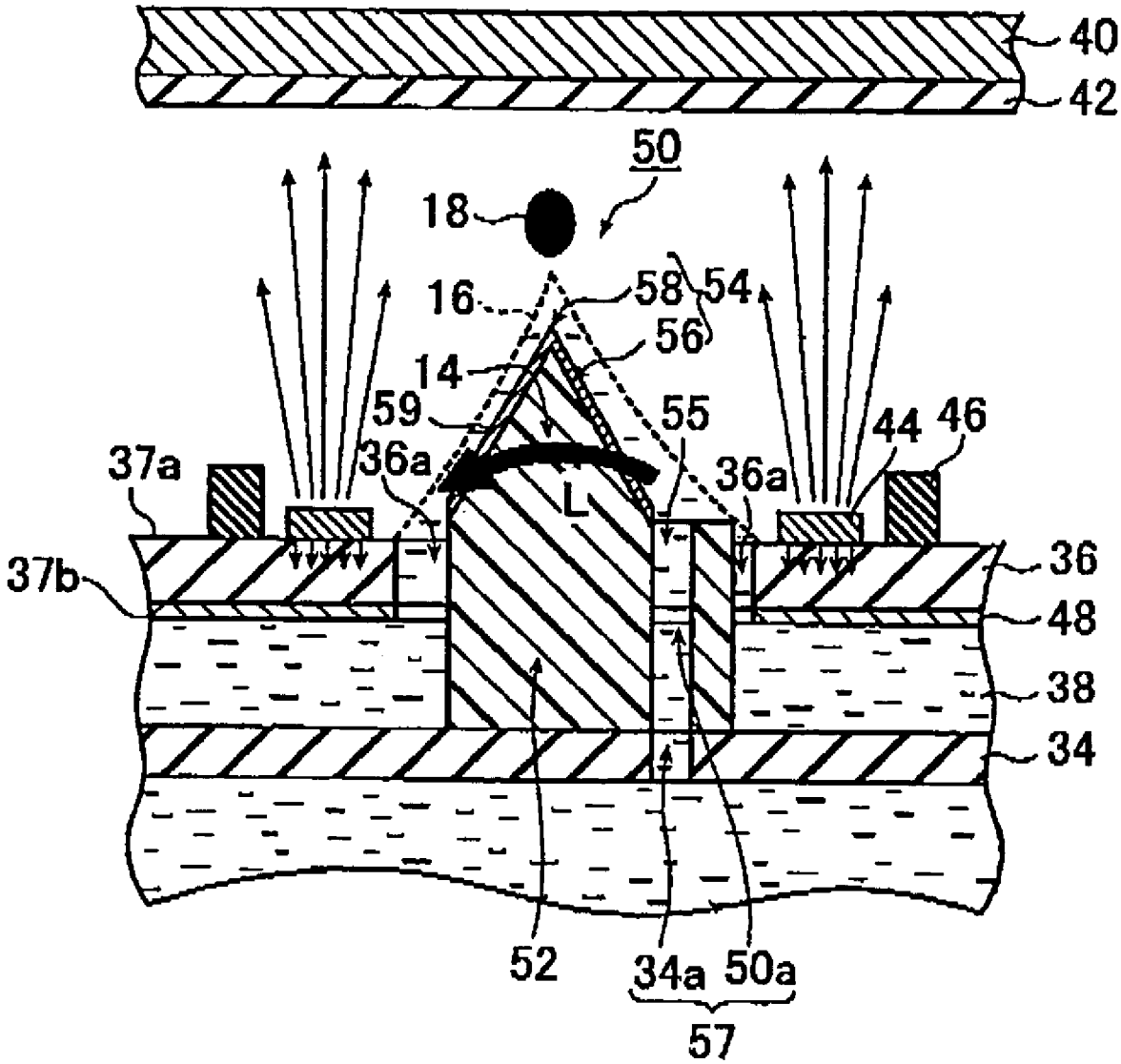
FIG. 3 is an explanatory diagram of a liquid ejection operation of the ink ejection head shown in FIG. 1.

Next, a liquid ejection operation in the ink ejection apparatus 1 will be described. FIG. 3 is an explanatory diagram of the liquid ejection operation of the ink ejection head 3 of this embodiment and is a schematic cross-sectional view where one of the multiple ink guide members 50 shown in FIG. 1 is enlarged and illustrated. As described above, in the ink ejection head 3, the ink 12 containing a constant concentration of the charged particles is circulated and the meniscus 16 covering at least the extreme top portion 58 is formed at the sharp-pointed portion 54 of the ink guide member 50. When a bias voltage Vb (1.5 kV, for instance) is applied from the bias power supply 62 of the power supply unit 6 under this state, an electric field is formed between the drive electrode 44 and the counter electrode 40 by this bias voltage Vb. Then, the drive power supply 64 of the power supply unit 6 superimposes a drive voltage Vc that is a pulse voltage (500 V, for instance) on the bias voltage Vb and applies a resultant voltage (2 kV in total, for instance) to the drive electrode 44 formed around a desired ink guide member 50 in accordance with a signal inputted from the signal output means (not shown). As a result, the electric field formed between the drive electrode 44 and the counter electrode 40 is strengthened and an ink droplet 18 is ejected from the meniscus 16 toward the counter electrode 40 by means of an electrostatic force generated by the strengthened electric field and is caused to adhere to the recording medium 42.

At this time, an electric field exerted from the drive electrode 44 in the downward direction in FIG. 3 is also formed. However, the grounded shield electrode 48 is provided on the lower side of the drive electrode 44 in FIG. 3 so as to oppose the drive electrode 44 and this electric field directed in the downward direction in FIG. 3 is concentrated toward the shield electrode 48 and is shielded. As a result, widening in the horizontal direction in FIG. 3 of the electric field exerted from the drive electrode 44 in the downward direction in FIG. 3 is suppressed. As a result, no electric field directed in the downward direction in FIG. 3 is formed in the ink supply path 57 and no electrostatic force is exerted on the ink 12 moving in the ink supply path 57 in the upward direction in FIG. 3. Therefore, the ink 12 in the ink supply path 57 is not influenced by the electric field formed by the voltage application to the drive electrode 44 and flows in the ink supply path 57 in the upward direction in FIG. 3 while maintaining a constant concentration of the charged particles.

Immediately after the drive voltage Vc is applied and the ink droplet 18 is ejected, the voltage of the drive electrode 44 returns to a bias state. Further, immediately after the ejection, ink supply from the ink flow 14 going across the inclined surfaces 56 in proximity to the extreme top portion 58 is performed by an amount consumed by the ejection and the shape of the meniscus 16 is restored swiftly.

In this embodiment, the conductive film 59 is formed on the surface of the sharp-pointed portion 54 of the ink guide member 50 of the ink ejection head 3. With this conductive film 59, the extreme top portion 58 of the ink guide member 50 is given conductivity and it becomes possible to strengthen the electric field around the extreme top portion 58. In the present invention, however, it is not necessarily required to form the conductive film 59 so long as a predetermined electric field strength is obtained.

Also, in this embodiment, the separation barriers 46 are provided around the drive electrodes 44 of the ink ejection head 3, although it is not necessarily required to provide these separation barriers 46 in the present invention. However, it is preferable that the separation barriers 46 are provided because it becomes possible to separate the meniscuses 16 formed at the adjacent ink guide members 50 and to maintain the respective meniscuses 16 formed at the respective ink guide members 50 with stability without being influenced by fluctuations of the meniscuses 16 at the time of ejection of the ink droplets 18 from the adjacent ink guide members 50.

Further, it is preferable that at least the surfaces of the separation barriers 46 have ink repellency because it becomes possible to separate the meniscuses 16 formed at the adjacent ink guide members 50 with more reliability by preventing a situation where the ink climbs the wall surfaces of the separation barriers 46. Here, the ink repellency means a water-repellent property in the case of water-based ink and means an oil repellent property in the case of oil-based ink.

Also, in this embodiment, the shield electrode 48 is provided on the surface 37*b* of the insulative substrate 36 so as to oppose the drive electrode 44, although it is not necessarily required to provide this shield electrode 48. However, when the electric field exerted from the drive electrode 44 in the downward direction in FIG. 3 is shielded using the shield electrode 48, widening in the horizontal direction in FIG. 3 of the electric field directed in the downward direction in FIG. 3 is suppressed. As a result, it becomes possible to prevent a situation where an electric field directed in a direction opposite to the moving direction of the ink 12 in the ink supply path 57 is formed in the ink supply path 57, which makes it possible to cause the ink 12 containing a stabilized concentration of the charged particles to flow out from the ink outflow opening 53. For this reason, it is preferable that the shield electrode 48 is provided, thereby making it possible to maintain a certain concentration of the charged particles in the meniscus 16 and to stabilize the size and shape of the ejected ink droplet 18.

Also, in this embodiment, a construction is adopted in which the drive electrode 44 and the wiring (not shown) are provided on the surface 37*a* of the insulative substrate 36 and contact the ink 12 and the atmosphere.

However, the ink ejection head according to the present invention is not limited to this and a construction may be used in which the drive electrode 44 and the wiring provided on the surface 37*a* are covered with an insulative film and are prevented from contacting the ink 12 and the atmosphere. With this construction, it becomes possible to prevent short circuits between the respective drive electrodes 44 and the wiring, current leakage from the respective drive electrodes 44 and the wiring, abnormal discharging, and the like. As a result, it becomes possible to prevent malfunctions and an increase in ejection voltage at the time of an ink ejection operation and to eject an ink droplet 18 having a stabilized size and shape at a low ejection voltage with stability. Therefore, in order to eject the ink droplet 18 with stability, it is preferable that the drive electrode 44 and the wiring are covered with an insulative film.

As described above, with the ink ejection apparatus 1 constructed using the ink ejection head 3 of this embodiment, it becomes possible to form the meniscus 16 covering the extreme top portion 58 of the ink guide member 50 in a stabilized shape without being influenced by fluctuations of the supply pressure of the ink 12 ascribable to the pulsatory motions of the ink pump 26 and the like. Also, ink supply to the meniscus 16 is performed from the ink flow 14 flowing in proximity to the extreme top portion 58 in which the meniscus 16 is formed, so that it also becomes possible to swiftly restore the meniscus 16 after the ejection of the ink droplet 18. As a result of these effects, it becomes possible to eject the ink droplet 18 having a stabilized size and shape at a high frequency.

The liquid ejection head produced according to the present invention is not limited to a head involving the ejection of ink containing colorant particles and may be a head that ejects any other kind of solution so long as the solution contains charged particles dispersed in a solvent.

The ink ejection head 3, in which the multiple ink guide members 50 including the sharp-pointed portions 54 and internally having the ink guide member through-holes 50*a* serving as the ink supply paths 57 are formed with high definition and are arranged with high accuracy and high density, is produced in a manner described below.

FIGS. 4A to 4H and FIGS. 5A to 5H are each an explanatory diagram of an ink guide member production method that is a first embodiment of the ink ejection head production method for the present invention. FIGS. 4A to 4H are each a plan view taken from above a substrate surface of the insulative substrate on which the ink guide members are to be produced. Also, FIGS. 5A to 5H are each a cross-sectional view taken along the line X–X' in FIGS. 4A to 4H, containing the insulative substrate during production, and corresponding to one of FIGS. 4A to 4H.

Figure 5F:
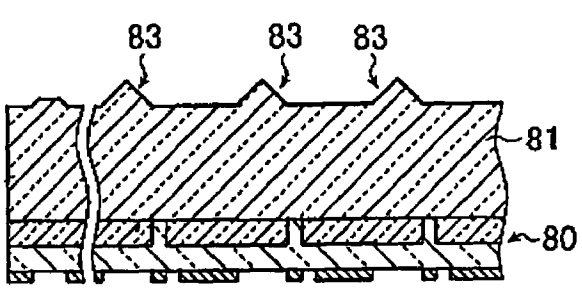
FIGS. 5A to 5H are each a diagram illustrating the ink guide member production method shown in FIGS. 4A to 4H from a direction that is different from that in FIGS. 4A to 4H.
Figure 5G:
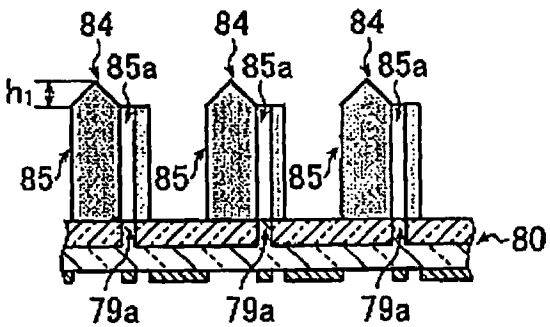
Figure 5H:
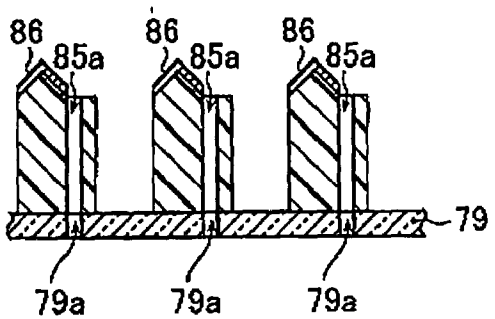
Figure 5A:
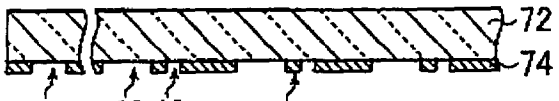

First, as shown in FIG. 5A, a mask substrate 72 (such as a glass substrate) made of an insulative material with transparency is prepared. Then, a lightproof layer 74 made of Cr or the like is formed on the lower surface of this mask substrate 72 in FIG. 5A. Following this, predetermined opening patterns 43 are formed in the lightproof layer 74 by photolithography and lift-off. As shown in FIG. 4A, each opening pattern 43 has a shape where this pattern 43 surrounds the peripheral of a lightproof region 45 having an approximately hemispherical shape. Also, an alignment key mark 47 is formed in the lightproof layer 74 using photolithography and lift-off at at least one position outside an ink ejection head production range. Here, the transparency means a property with which light irradiated to expose a photosensitive resin layer 81 to be described later (see FIG. 5D) formed on a surface of an insulative substrate 79 (see FIG. 5D) passes through the mask substrate 72 and the insulative substrate 79 with a light intensity with which it is possible to entirely photosensitive the photosensitive resin layer 81 in the traveling direction of the light.

Figure 5B:
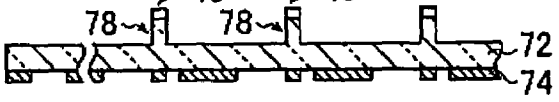
Figure 5C:
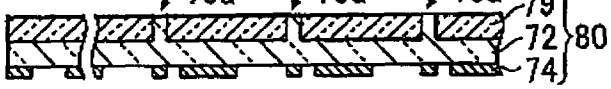

Next, as shown in FIG. 5B, resist patterns 49 are formed on a surface of the mask substrate 72 on a side opposite to the surface thereof, on which the lightproof layer 74 has been formed, using photolithography so as to coincide with the lightproof regions 45. Then, the mask substrate 72 is dry-etched using these resist patterns 49 as masks and protrusion portions 78 of the mask substrate 72 are obtained as shown in FIGS. 4B and 5B.

Next, a transparent insulative substrate 79 made of glass or the like is prepared so as to have the same height as the protrusion portions 78. Following this, insulative substrate through-holes 79*a*, which have cross-sectional shapes that are the same as those of the protrusion portions 78 and sectional areas that are somewhat larger than those of the protrusion portions 78, are established in the insulative substrate 79 at positions corresponding to the protrusion portions 78 through photolithography and dry etching. Then, the resist on the mask substrate 72 is removed and the insulative substrate 79 is arranged on the mask substrate 72 so that the protrusion portions 78 of the mask substrate 72 are fitted into the insulative substrate through-holes 79*a*. In this manner, the mask substrate 72, on whose surface the lightproof layer 74 has been formed, is integrated with the insulative substrate 79 and a base substrate 80 is obtained. Here, like in the above description, the transparency means a property with which light irradiated to expose the photosensitive resin layer 81 to be described later (see FIG. 5D) formed on the surface of the insulative substrate 79 passes through the mask substrate 72 and the insulative substrate 79 with a light intensity with which it is possible to entirely photosensitize the photosensitive resin layer 81 in the traveling direction of the light.

Figure 5D:
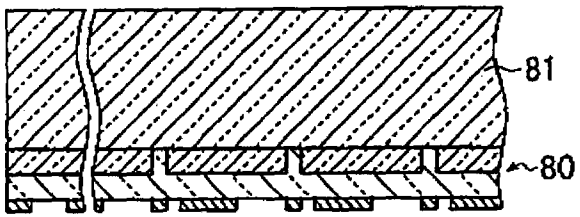

Next, as shown in FIGS. 4D and 5D, a photosensitive resin material, such as NANO SU-8 manufactured by MicroChem Corp., is applied to a surface of the base substrate 80 with a spin coat method so as to form a film having a thickness of $h_3$ or more. Following this, heating to a temperature (50° C. to 90° C. or higher, for instance) is performed using a hot plate or a clean oven and a solvent is removed, thereby forming the photosensitive resin layer 81 that is a thick film. The following description will be made by assuming that the photosensitive resin material used in this embodiment is a negative-type resist where each photosensitized portion is bridged.

Figure 5E:
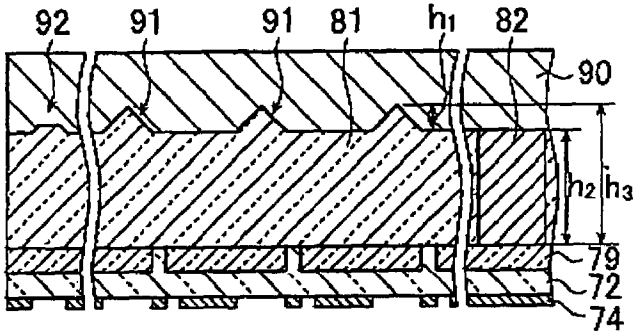

Next, as shown in FIGS. 4E and 5E, a spacer 82 having a height of $h_2$ is arranged in a peripheral portion of the insulative substrate 79. Then, a mold substrate 90 (see FIG. 6), on whose surface concave portions 91 having an approximately pyramid shape with a height of $h_1$ has been formed, is arranged on the photosensitive resin layer 81 so that these concave portions 91 oppose the upper surface of the photosensitive resin layer 81. Note that in addition to the approximately pyramid-shaped concave portions 91, a desired alignment target formation mark 92 is formed at at least one position of the mold substrate 90. When the mold substrate 90 is arranged on the photosensitive resin layer 81, the key mark 47 formed in the lightproof layer 74 is aligned with the target formation mark 92. As a result of this alignment, as shown in FIG. 4E, when viewed from above the substrate surface of the insulative substrate 79, the positions of the approximately pyramid-shaped concave portions 91 are set in proximity to the positions of the lightproof regions 45 of the mask substrate 72. Following this, the whole of the base substrate 80 where the mold substrate 90 has been arranged on the photosensitive resin layer 81 is set in a hot-press machine and is heated to a temperature, such as 50° C. to 60° C. or higher, that is the transition point of the SU-8 glass, and the mold substrate 90 is pressed toward the base substrate 80 at a pressure, such as 0.1 MPa or higher, while deaerating a gap between the mold substrate 90 and the photosensitive resin layer 81 using a vacuum pump. At this time, a distance between the mold substrate 90 and the base substrate 80 is regulated by the spacer 82 having the height of $h_2$ and a distance from the base substrate 80 to the deepest portion of the pyramid-shaped concave portions 91 of the mold substrate 90 becomes $h_3$. Next, as shown in FIGS. 4F and 5F, the whole of the product is cooled to room temperature and the mold substrate 90 is detached from the photosensitive resin layer 81. In this manner, convex portions 83 having a triangular cross-sectional shape with a height of $h_1$ are molded and formed on the surface of the photosensitive resin layer 81 through the pressing of the mold substrate 90 described above.

Next, ultraviolet rays having a wavelength of 350 to 400 nm are irradiated from the lower surface of the base substrate 80 in FIG. 5F perpendicular to the base substrate 80 and the photosensitive resin layer 81 is exposed in portions corresponding to the opening patterns 43. At this time, portions corresponding to the lightproof regions 45 are not exposed and are left as not-photosensitized portions. Following this, heating to a temperature (50° C. to 90° C. or higher, for instance) is performed using a hot plate or a clean oven and then the base substrate 80 is cut into a predetermined size of the liquid ejection head through dicing or the like together with the photosensitive resin layer 81. Following this, the base substrate 80 is immersed in a developing liquid together with the photosensitive resin layer 81 and each unexposed portion of the photosensitive resin layer 81 is dissolved. Further, the whole of the product is cleaned through pure water rinsing and the developing liquid is removed. Then, the exposed portions are subjected to hardening processing at a temperature (100° C. to 200° C., for instance). In this manner, structural members 85 shown in FIGS. 4G and 5G are obtained where sharp-pointed portions 84 with a height of $h_1$ have been formed at the tip ends of the members 85 with high definition and structural member through-holes 85*a* connected with the insulative substrate through-holes 79*a* have been internally formed.

Following this, a metallic material is selectively vapor-deposited using a mask on the surfaces of the sharp-pointed portions 84 of the structural members 85 subjected to the hardening processing, thereby forming metallic layers 86. Following this, the mask substrate 72 is detached from the insulative substrate 79 and the ink guide members 50 that are protrusion members formed on the insulative substrate 79 are obtained as shown in FIGS. 4H and 5H.

As a result of the process steps described above, a construction member is obtained where the multiple ink guide members 50, which internally have the ink guide member through-holes 50*a* (structural member through-holes 85*a*) connected with the head substrate through-holes 34*a* (insulative substrate through-holes 79*a*), whose overall heights are $h_3$, and whose tip ends are the sharp-pointed portions 84 (sharp-pointed portions 54) covered with the conductive films 59 (metallic films 86) and having a height of $h_1$, are arranged on the head substrate 34 (insulative substrate 79).

Following this, as shown in FIG. 1, the ink accommodation chamber 32, the insulative substrate 36, and the counter electrode 40, on which the recording medium 42 has been arranged, are placed with respect to the head substrate 34 for which the ink guide members 50 have been formed. In this manner, the ink ejection head 3 is produced.

In this embodiment, a negative-type resist is used as the photosensitive resin material, although the photosensitive resin material may be a positive-type resist. In this case, unlike in the above description, the ink guide members are formed at desired positions and in a desired shape by lightproofing regions that will finally become the ink guide members and exposing other portions at the time of exposure of the photosensitive resin layer 81.

Figure 6:
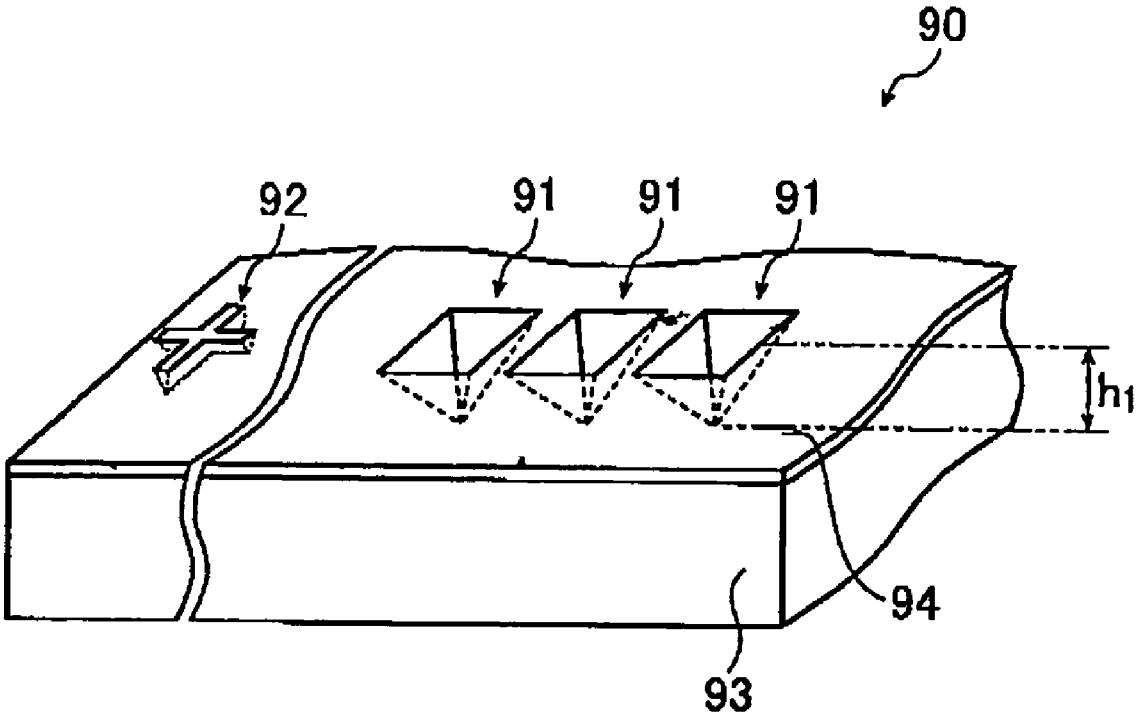
FIG. 6 is a schematic structural diagram showing an example of a mold substrate used with the ink ejection head production method shown in FIGS. 4A to 4G.

Next, the mold substrate 90 used in this embodiment of the present invention will be described in detail. FIG. 6 is a schematic structural diagram showing an example of the mold substrate used with the ink ejection head production method of this embodiment. The mold substrate 90 has a construction where a release layer 94 made of a fluoride resin or the like is formed on a surface of an Si single crystal substrate 93 on whose surface the approximately pyramid-shaped concave portions 91 have been formed. The Si single crystal substrate 93 is a p-type Si single crystal substrate whose surface is a (100) crystalline plane. Also, the multiple approximately pyramid-shaped concave portions 91, whose deepest portions have a depth of $h_1$ from the substrate surface and whose inclined surfaces are each formed by a (111) crystalline plane, are formed on the substrate surface with high accuracy. Further, the alignment target formation mark 92 is formed on the substrate surface at at least one predetermined position.

Hereinafter, a production method for the mold substrate 90 will be described in detail.

FIGS. 7A to 7F and FIGS. 8A to 8F are each an explanatory diagram of the mold substrate production method according to the present invention. In more detail, FIGS. 7A to 7F are each a plan view taken from above the substrate surface of the mold substrate, while FIGS. 8A to 8F are each a cross-sectional view of the mold substrate during production taken along the line Y–Y' in FIGS. 7A to 7F and corresponding to FIGS. 7A to 7F.

Figure 7E:
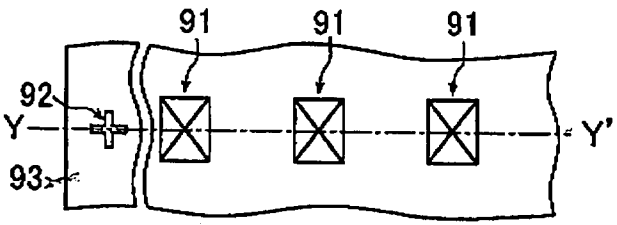
FIGS. 7A to 7F are each an explanatory diagram of a production method for the mold substrate according to the present invention.
Figure 7F:
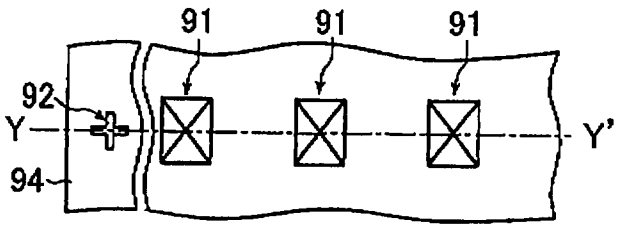
Figure 7A:
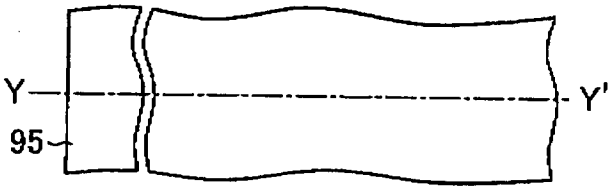
Figure 7B:
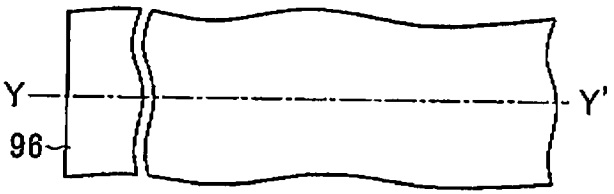
Figure 8E:
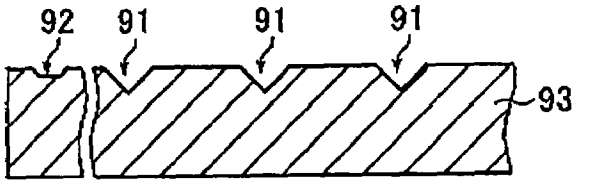
FIGS. 8A to 8F are each a diagram illustrating the mold substrate production method shown in FIGS. 7A to 7F from a direction that is different from that in FIGS. 7A to 7F.
Figure 8F:
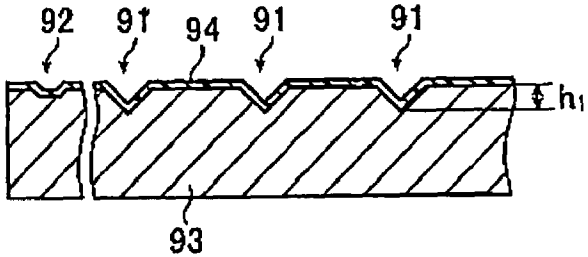
Figure 8A:
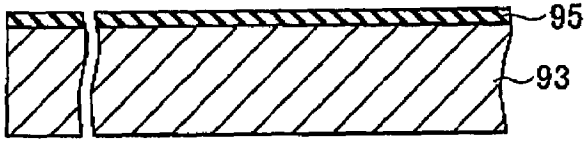
Figure 8B:
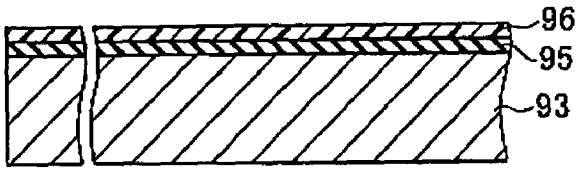

First, as shown in FIG. 8A, a thermal oxidation layer 95 is formed through dry oxidation or the like on a surface of the Si single crystal substrate 93 that is a p-type (100) crystalline plane. Following this, as shown in FIGS. 7B and 8B, a resist layer 96 is applied onto the thermal oxidation layer 95 with a spin coat method.

Figure 7C:
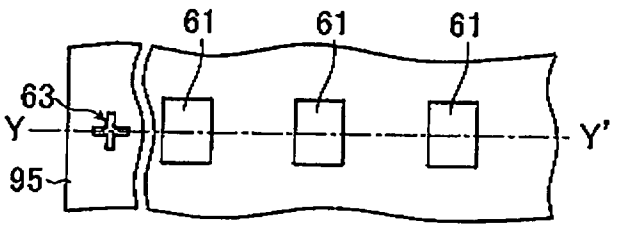
Figure 8C:
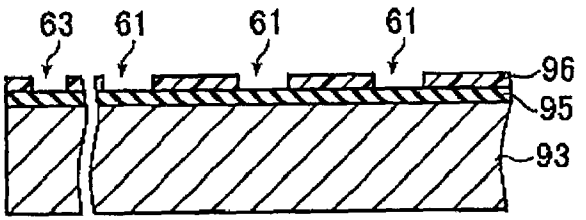

Next, as shown in FIGS. 7C and 8C, after the resist layer 96 is formed using the spin coat method or the like, exposure and development are performed, thereby forming square resist opening patterns 61 and a cross-shaped resist opening pattern 63.

Figure 7D:
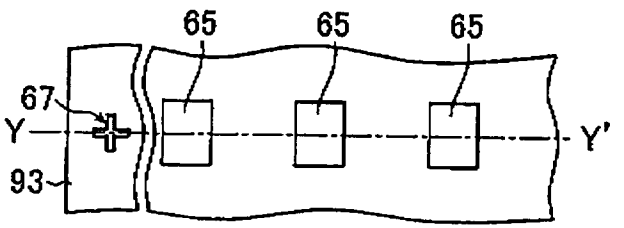
Figure 8D:
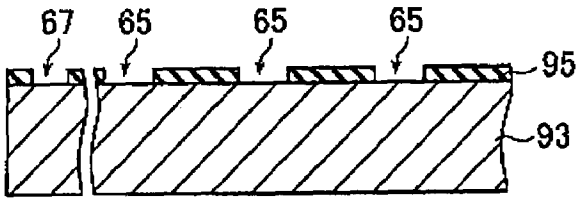

Then, as shown in FIGS. 7D and 8D, square oxidation film opening patterns 65 and a cross-shaped oxidation film opening pattern 67 are formed by dry-etching the thermal oxidation layer 95 using a reactive ion etching apparatus (RIE apparatus) or the like and the resist layer 96 is removed.

Next, as shown in FIGS. 7E and 8E, anisotropic etching is performed using a 30 wt % solution of KOH in water or the like by setting the thermal oxidation layer 95 having the oxidation film opening patterns 65 and the cross-shaped oxidation film opening pattern 67 as an etching mask. Following this, the thermal oxidation layer 95 is removed. As a result, the approximately pyramid-shaped concave portions 91, whose inclined surfaces are each formed by a (111) crystalline plane, and the target formation mark 92 are obtained.

Next, as shown in FIGS. 7F and 8F, the release layer 94 is formed by spraying a fluororesin coating material or the like onto a surface of the Si single crystal substrate 93. With the method described above, the mold substrate 90 having the release layer 94 on its surface and provided with the V-groove-shaped concave portions 91 having a depth of $h_1$ is produced.

With the production method for the mold substrate 90 described above, the V-groove-shaped concave portions 91 having a highly accurate shape and arrangement are formed through anisotropic etching using the resist opening patterns 61 formed with high shape accuracy and high arrangement accuracy through photolithography. By pressing this mold substrate 90 against the photosensitive resin layer 81 in the manner described above, it becomes possible to form the convex portions 83 arranged and shaped with high accuracy and having a triangular cross-sectional shape with a height of $h_1$ on the surface of the photosensitive resin layer 81 with high density and high accuracy.

It should be noted here that in this embodiment described above, the release layer 94 is formed on the surface of the mold substrate 90, although the mold substrate 90 may be pressed against the photosensitive resin layer 81 without forming the release layer 94 on its Si semiconductor single crystalline plane. In this case, however, at the time of releasing of the mold substrate 90 from the photosensitive resin layer 81 after the pressing, a situation may occur where it is impossible to perform the releasing because the photosensitive resin material adheres to the Si single crystalline plane or a defective shape is produced because the releasing is performed under a state where the photosensitive resin partially adheres to the mold substrate. Therefore, it is preferable that the release layer 94 is formed on the surface to thereby make it possible to perform the releasing with ease and to suppress the production of the defective shape due to a release failure with more reliability.

The ink ejection head and the ink ejection head production method according to this embodiment of the present invention are fundamentally constructed in the manner described above. Up to this point, the ink ejection head and the ink ejection head production method of this embodiment have been described in detail, although the present invention is not limited to this embodiment and it is of course possible to make various modifications and changes without departing from the gist of the present invention.

<Second Embodiment>

Next, a second embodiment of the liquid ejection head and the liquid ejection head production method of the present invention will be described. Note that in this embodiment, each construction element that is the same as that of the liquid ejection head 1 of the first embodiment shown in FIG. 1 is given the same reference numeral and the detailed description thereof will be omitted.

Figure 9:
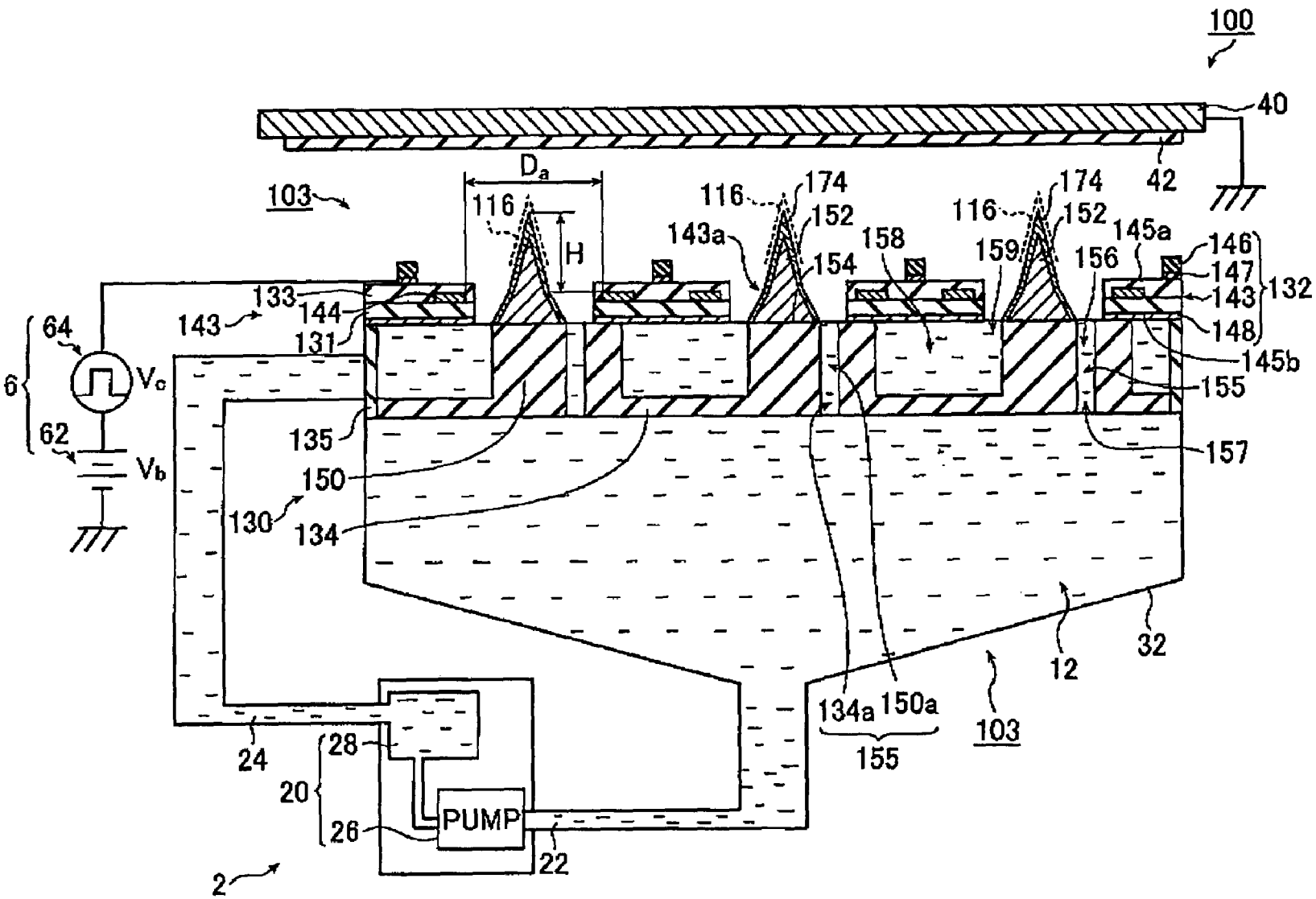
FIG. 9 is a schematic structural diagram of an ink ejection apparatus provided with an ink ejection head according to a second embodiment of the liquid ejection head of the present invention.

FIG. 9 is a schematic structural diagram of an ink ejection apparatus 100 provided with an ink ejection head 103 that is the second embodiment of the liquid ejection head of the present invention.

Figure 10A:
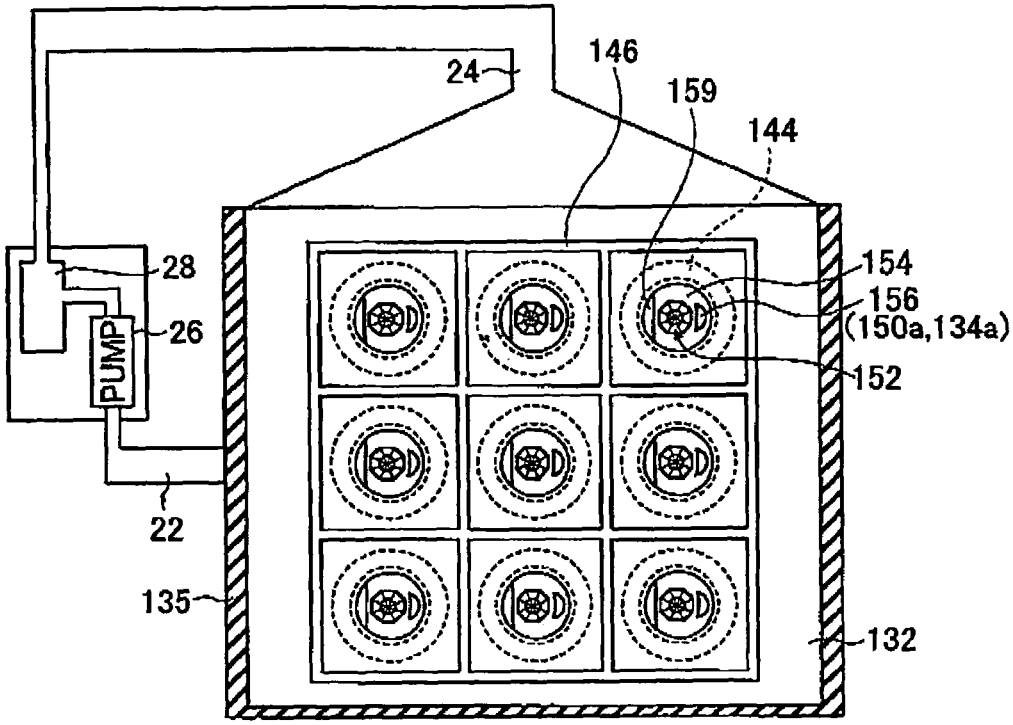
FIGS. 10A and 10B are each a schematic structural diagram illustrating the ink ejection head of the second embodiment from a direction that is different from that in FIG. 9.
Figure 10B:
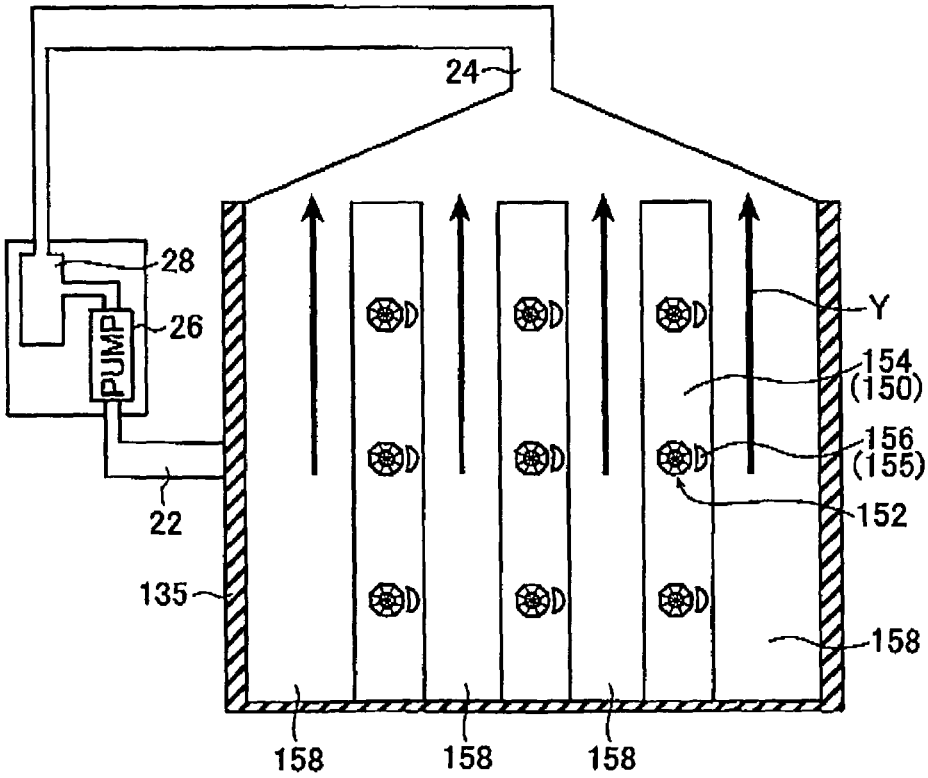

As shown in FIG. 9, the ink ejection apparatus 100 includes an ink reflux unit 2, the ink ejection head 103, and a power supply unit 6. Also, FIGS. 10A and 10B are each a schematic structural diagram of the ink ejection head 103 taken from the upper side in FIG. 9. In more detail, FIG. 10A is a schematic structural diagram of the ink ejection head 103 taken from the upper side in FIG. 9 where the illustration of a counter electrode 40 (see FIG. 9) is omitted. On the other hand, FIG. 10B is a schematic structural diagram of the ink ejection head 103 taken from the upper side in FIG. 9 where the illustration of the counter electrode 40 and a second head member 132 (see FIG. 9) are omitted.

The ink reflux unit 2 is the same as that shown in FIG. 1, so that the detailed description thereof will be omitted. In this embodiment, an ink accommodation chamber 32 is an approximately rectangular-shaped space for accommodating ink and a wall surface of the ink accommodation chamber 32 on the upper side in FIG. 9 is formed by a substrate surface of a head substrate 134 of the ink ejection head 103.

Also, an ink tank 28 is connected to the ink ejection head 103 through an ink recovery pipe 24.

The ink ejection head 103 includes a first head member 130 (hereinafter referred to as the "head member 130"), an upper cover 132 that is a second head member, a counter electrode 40, and ink guides 152. Also, a recording medium 42, on which a predetermined image or the like is to be recorded by an ejected liquid, is placed on the counter electrode 40.

The head member 130 is formed so that protrusion portions 150 protrude from the plate-shaped head substrate 134 that is the first substrate toward the counter electrode. The head substrate 134 is an insulative substrate, such as a glass substrate, and the protrusion portions 150 formed integrally with the head substrate 134 in an approximately rectangular parallelopiped shape protruding toward the counter electrode 40 are provided at predetermined positions on a surface of the head substrate 134 on a side opposing the counter electrode 40. As shown in FIG. 10B, the protrusion portions 150 are formed so as to have an approximately rectangular parallelopiped shape extending from an end portion of the head substrate 134 on the upper side in FIG. 10B to an end portion thereof on the lower side in FIG. 10B and to protrude from the substrate surface of the head substrate 134 with a uniform height.

Upper surfaces 154 of the protrusion portions 150 that are surfaces on a counter electrode 40 side are set approximately parallel to the surface of the head substrate 134 on a side opposing the counter electrode 40. Also, the upper surfaces 154 of the multiple protrusion portions 150 provided on the head substrate 134 are each formed within approximately the same plane.

Protrusion portion through-holes 150*a* passing through the protrusion portions in the protruding direction of the protrusion portions 150 (vertical direction in FIG. 9) are established in the protrusion portions 150. These protrusion portion through-holes 150*a* are respectively connected with head substrate through-holes 134*a* passing through the plate-shaped head substrate 134, thereby forming ink supply paths 155 that are each a liquid supply path. At one end of the ink supply paths 155, ink outflow openings 156 are formed in the upper surface 154. Also, at the other end of the ink supply paths 155, ink inflow openings 157 are formed in a wall surface of the ink accommodation chamber 32 on the upper side in FIG. 9. Further, ink guides 152 formed through anisotropic etching of an Si single crystal substrate or the like, protruding from the upper surfaces 154 toward the counter electrode 40, and having tip ends sharply pointed to a high degree are provided in predetermined areas of the upper surfaces 154 of the protrusion portions 150. The ink guides 152 will be described later.

The upper cover 132 that is the second head member is arranged on the head member 130 (first head member 130) and is jointed with the head member 130.

The upper cover 132 is arranged so as to be abutted against the upper surfaces 154 of the protrusion portions 150 protruding from the head substrate 134 and is fixed approximately parallel to the head substrate 134. As a result, the substrate surface of the head substrate 134 and the upper cover 132 are spaced apart from each other by a certain distance. Then, spaces surrounded by the substrate surface of the head substrate 134, the substrate surface of the upper cover 132, and wall surfaces of the protrusion portions 150 adjacent to each other form ink recovery paths 158.

As shown in FIGS. 10A and 10B, a gap between the head substrate 134 and the upper cover 132 is closed by a side wall 135 on three sides that are the left side, the lower side, and the right side in FIGS. 10A and 10B and is connected to the solution recovery pipe 24 on the upper side in FIGS. 10A and 10B.

The upper cover 132 includes a control substrate 143 that is a second substrate, a separation barrier 146, a guard electrode 147, and a shield electrode 148.

The control substrate 143 is produced by applying an $SiO_2$ insulative film 133 or the like on the entire surface of an insulative substrate 131 made of glass or the like and provided with control electrodes 144 and wiring to be described later so that these control electrodes 144 and wiring are also coated with the insulative film 133. Also, control substrate through-holes 143*a* having a circular cross section and passing through the control substrate 143 in the vertical direction in FIG. 9 are established in the control substrate 143 at predetermined positions corresponding to the protrusion portions 150. Further, the guard electrode 147 is provided on a surface 145*a* (first surface) of the control substrate 143 on a side opposing the counter electrode 40 so as to surround the peripheries of the control electrodes 144 when viewed from the upper side in FIG. 9 and the separation barrier 146 made of an insulative material, whose surface has ink repellency, is provided on a surface of the guard electrode 147 on the upper side in FIG. 9. The shield electrode 148 is grounded and is provided on the whole of a surface 145*b* (second surface) of the control substrate 143 on a side opposing the head substrate 134.

Figure 11A:
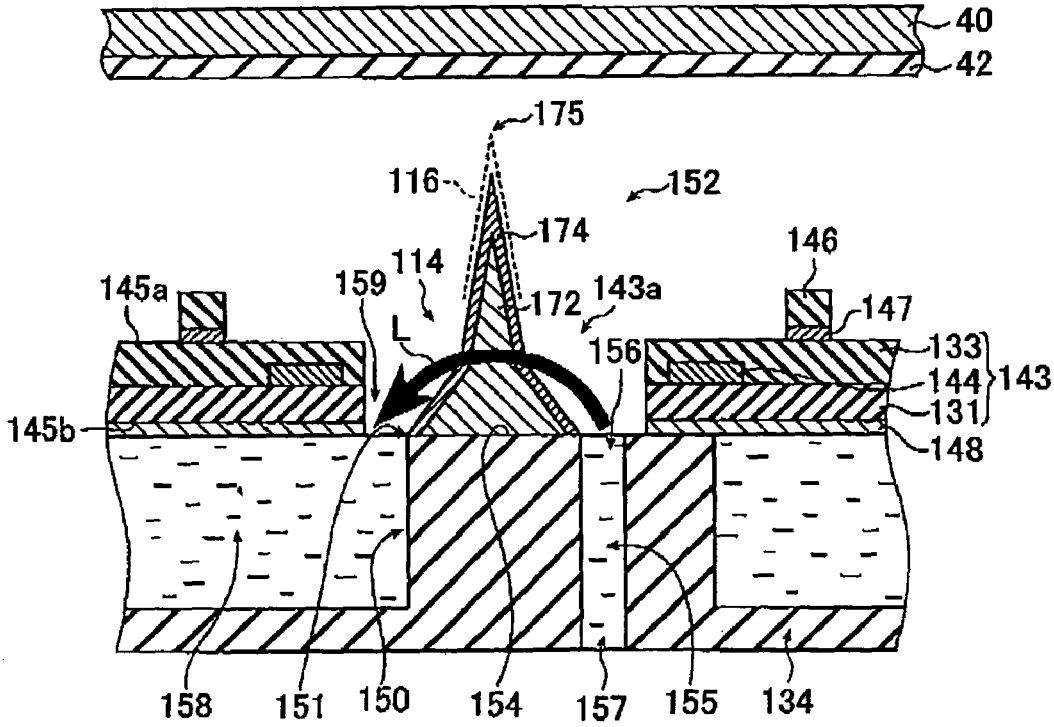
FIGS. 11A and 11B are each an explanatory diagram of one of multiple ink guides shown in FIGS. 9, 10A, and 10B and the periphery of the ink guide.
Figure 11B:
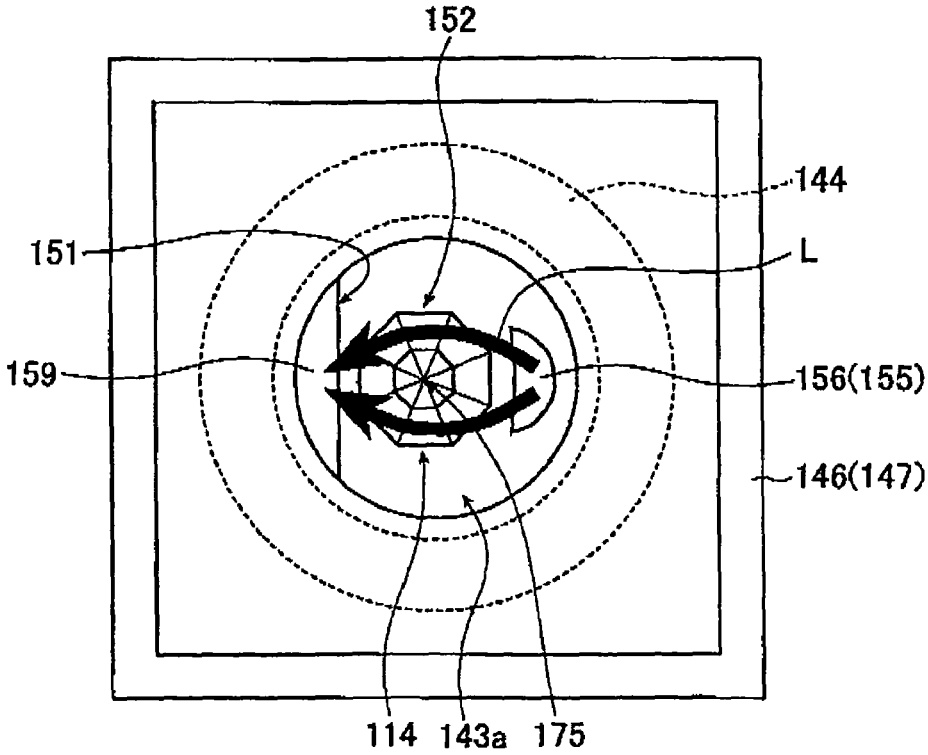

FIGS. 11A and 11B are each an explanatory diagram of one of the multiple ink guides 152 shown in FIGS. 9, 10A, and 10B and the periphery of the ink guide 152. FIG. 11A is a schematic cross-sectional view where the ink guide 152 and the periphery of the ink guide 152 are enlarged and illustrated, while FIG. 11B is a schematic plan view where the ink guide 152 and the periphery of the ink guide 152 are enlarged and illustrated.

As shown in FIGS. 11A and 11B, the ink guide 152 is provided on the upper surface 154 of the protrusion portion 150 having an approximately rectangular parallelopiped shape (surface thereof opposing the counter electrode 40) so as to protrude from the upper surface 154 toward the counter electrode 40, with its tip end being sharply pointed.

In FIG. 11A, the protrusion portion 150 is provided on the surface of the head substrate 134 on a counter electrode 40 side so as to protrude toward the counter electrode 40. Also, the protrusion portion through-hole 150*a* that is a through-hole passing through the protrusion portion 150 in a protruding direction of the protrusion portion 150 (vertical direction in FIG. 11A) and the head substrate through-hole 134*a* passing through the head substrate in the protruding direction are connected to each other, thereby forming the ink supply path 155. Further, at one end of the ink supply path 155, an ink outflow opening 156 is obtained in the upper surface 154 that is a surface of the protrusion portion 150 on the counter electrode 40 side. On the other hand, at the other end of the path 155, an ink inflow opening 157 is obtained in the substrate surface of the head substrate 134 constituting the wall surface of the ink accommodation chamber 32. Still further, the ink guide 152 is provided in proximity to the ink outflow opening 156 on the upper surface 154 of the protrusion portion 150.

The ink guide 152 is formed by coating the entire surface of a pyramid structural member 172, which has been produced by performing anisotropic wet etching of an Si single crystal material or the like so as to obtain a sharp-pointed tip end portion 175 having a tip end angle of 60° or less and a radius of curvature of 4 μm or less, with a conductive film 174 made of a metal or the like so that the tip end portion 175 is also coated with the conductive film 174. A method of forming this ink guide 152 will be described in detail later.

In FIGS. 11A and 11B, the ink guide 152 has a structure where the surface of the pyramid structural member 172 is formed by inclined surfaces, each of which forms two different angles with the upper surface 154, and is coated with the conductive film 174. FIGS. 11A and 11B each schematically show the outside shape of the ink guide 152 and the shape of the ink guide 152 is not faithfully illustrated in these drawings. Various shapes of the ink guide 152 can be obtained by changing conditions concerning the anisotropic wet etching described above. In the present invention, it is sufficient that the ink guide 152 is formed through anisotropic wet etching of a single crystal material so that its tip end is sharply pointed with high accuracy and therefore the ink guide 152 is not specifically limited. However, it is preferable that the ink guide 152 in this embodiment has a tip end whose tip end angle is 60° or less and radius of curvature is 4 μm or less as described above.

In FIGS. 11A and 11B, the upper cover 132 is abutted against the upper surface 154 of the protrusion portion 150 of the head substrate 134 and is jointed-thereto, and a gap between the head substrate 134 and the upper cover 132 is set as the ink recovery path 158. The circular control substrate through-hole 143*a* passing through the control substrate 143 in the vertical direction in FIG. 9 is established in the control substrate 143 of the upper cover 132 and a part of the ink guide 152 including at least the tip end portion 175 protrudes from the control substrate through-hole 143*a*.

As shown in FIG. 11B, the upper cover 132 is adjusted in position and arranged so that the center of the control substrate through-hole 143*a* approximately coincides with the tip end portion of the ink guide 152 and the solution outflow opening 156 and a part of an edge 151 of the protrusion portion 150 (end portion of the upper surface 154 on the left side in FIG. 11B) are positioned inside the control substrate through-hole 143*a* when viewed from the upper side in FIG. 11A. The ink recovery path 158 is spatially connected to the ink outflow opening 156 and the ink supply path 155 through an ink recovery opening 159 (see FIGS. 11A and 11B) that is an opening formed by an end portion of the inner wall of the control substrate through-hole 143*a* on a control substrate 143 side and the edge 151 of the protrusion portion 150.

In the control substrate 143, the control electrodes 144 is provided on a surface of an insulative substrate 131, which is made of ceramics (such as $Al_2O_3$ or $ZrO_2$) or a resin (such as polyimide) and constitutes the control substrate 143, in the shape of a ring whose center coincides with the tip end portion 175 of the ink guide 152 while surrounding the periphery of the control substrate through-hole 143*a* when viewed from the upper side in FIG. 9. The ratio (Da:H) between the internal diameter Da of the control electrodes 144 and a distance from the control electrodes 144 to the extreme tip end portion of the ink guide 152 protruding toward the recording medium 142 side, that is, a distance H from the upper surface of the control electrodes 144 to the extreme tip end portion of the ink guide 152 is preferably set in a range of 1:0.5 to 1:2, more preferably in a range of 1:0.7 to 1:1.7 (see FIG. 9). Note that the internal diameter Da of the control electrodes 144 and the distance H from the control electrodes 144 to the extreme tip end portion of the ink guide 152 protruding toward the recording medium 142 side is described in detail in commonly assigned Japanese Patent Application No. 2003-20585.

Each control electrode 144 is connected to an electrode pad (not shown) through wiring formed on the surface of the insulative substrate 131. The electrode pad (not shown) is connected to an ejection bias voltage supply 62 and an ejection signal voltage supply 64 of the voltage supply unit 6.

The ejection bias voltage supply 62 of the voltage supply unit 6 constantly applies a bias voltage $V_b$ to the control electrodes 144 of the control substrate 143. Also, the ejection signal voltage supply 64 superimposes an ejection voltage $V_c$ that is a pulse voltage on the bias voltage $V_b$ and applies a resultant voltage to the control electrodes 144 in accordance with a signal inputted from a signal output means (not shown).

In the ink ejection apparatus 100 having such a structure, the following flow of the ink is formed.

In the ink reflux unit 2, a predetermined amount of ink 12 is reserved in the ink tank 28. This ink 12 is a solution where positively charged particles are dispersed in an insulative solvent having a resistivity of $10^8$ Ωcm or more together with a charge control agent, a binder, and the like. In the ink tank 28, the concentrations of the charged particles, the charge control agent, the binder, and the like in the insulative solvent of the ink 12 are constantly adjusted so as to fall within predetermined concentration ranges by a concentration adjustment mechanism (not shown). The ink 12 adjusted in concentration by the concentration adjustment mechanism (not shown) in the ink tank 28 is supplied from the ink pump 26 to the ink accommodation chamber 32 of the ink ejection head 103 through the ink supply pipe 22 at a predetermined pressure. The ink 12 in the ink accommodation chamber 32 passes through the ink inflow opening 157 and is supplied from the ink supply path 155 to the respective protrusion portion 150.

In the vicinity of the protrusion portion 150, the ink 12 supplied to the ink accommodation chamber 32 by the action of the ink pump 26 flows through the ink supply path 155 in the upward direction in FIG. 11A and flows out from the ink outflow opening 156. At this time, the supply pressure of the ink 12 by the ink pump 26 is adjusted so that an ink flow 114 is formed with which the ink 12 flown out from the ink outflow opening 156 goes across the surfaces of the ink guide 152 provided on the upper surface 154 of the protrusion portion 150 (flow in the direction of arrow L in FIGS. 11A and 11B), goes through the ink recovery opening 159, and flows into the ink recovery path 158.

A part of the ink 12 is guided to the tip end portion 175 of the ink guide 152 by means of the surface tension of the ink 12 when going across the surface of the ink guide 152. The ink 12 guided to the tip end portion 175 forms a meniscus 116 covering at least the tip end portion 175 of the ink guide 172 as indicated by the dotted line in FIG. 11A. At this time, the meniscus 116 is mainly formed by the surface tension of the ink 12 and is formed in a stabilized shape that is hardly influenced by minute fluctuations of the supply pressure of the ink 12 ascribable to the pulsatory motions of the ink pump 26 or the like. Also, the meniscuses 116 formed on the surfaces of adjacent ink guides 152 are prevented from being connected with each other and are separated from each other by the separation barriers 146 provided on the upper cover 132. In the ink ejection apparatus 100, the ink 12 containing a constant concentration of the charged particles is constantly supplied to the tip end portions 175 of the respective ink guides 152 and the meniscuses 116 are formed in the manner described above.

In this way, a part of the ink 12 supplied to the respective ink guides 152 forms the meniscuses 116. On the other hand, the remaining great majority of the ink 12 passes through the ink recovery opening 159, flows into the ink recovery path 158, flows inside the ink recovery path 158 in the direction (direction indicated by an arrow Y of FIG. 10B) parallel to the head substrate 134 and the control substrate 143, passes through the ink recovery pipe 24, and returns to the ink tank 28. The ink 12 returned to the ink tank 28 is adjusted in concentration again in this tank 28 and is sent again from the ink pump 26 into the ink accommodation chamber 32 through the ink supply pipe 22 at a predetermined pressure. That is, in the ink ejection apparatus 100 according to the present invention, the ink ejection head 103 is constantly supplied with the ink 12 containing a constant concentration of the charged particles by the ink reflux unit 2.

Figure 12:
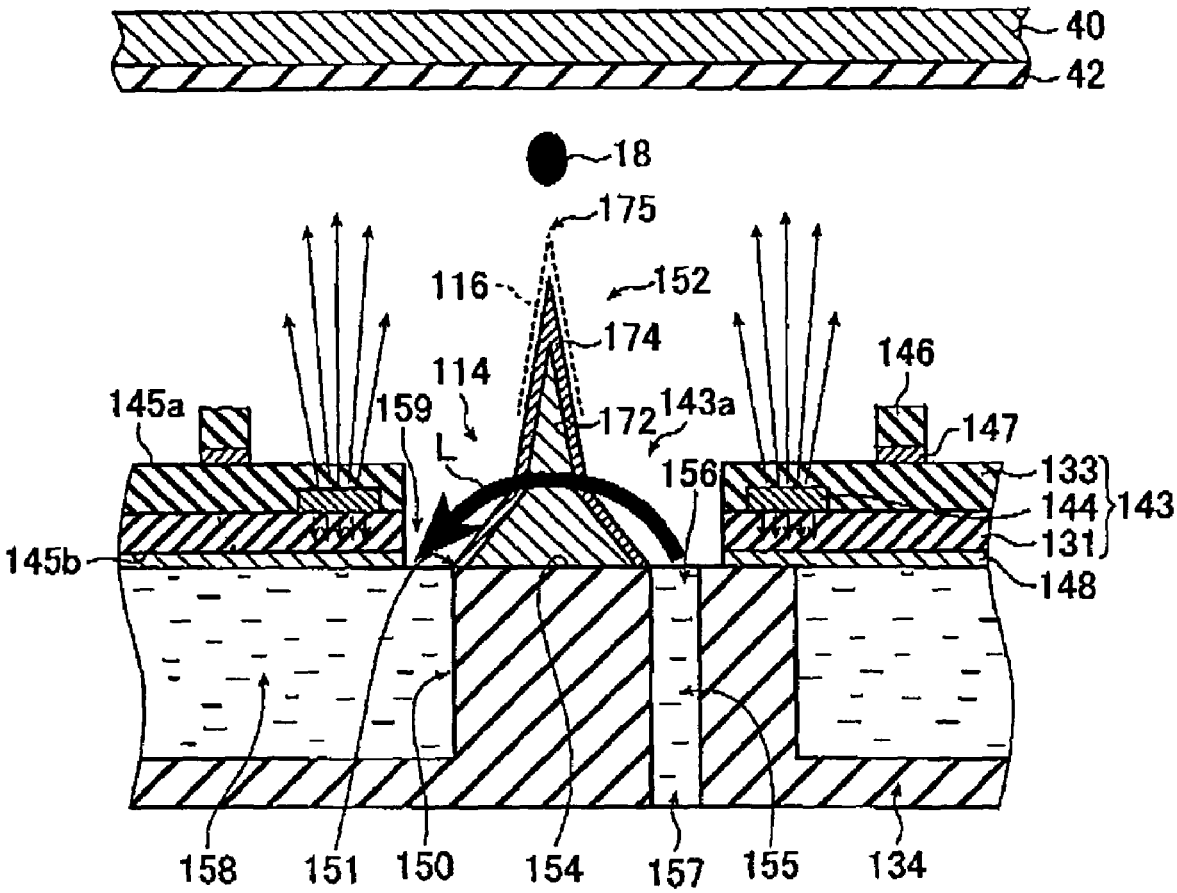
FIG. 12 is an explanatory diagram of a liquid ejection operation of the ink ejection head according to the second embodiment.

Next, a liquid ejection operation in the ink ejection apparatus 100 will be described. FIG. 12 is an explanatory diagram of the liquid ejection operation of the ink ejection head 103 of this embodiment and is a schematic cross-sectional view where one of the multiple ink guides 152 shown in FIG. 9 is enlarged and illustrated. As described above, in the ink ejection head 103, the ink 12 containing a constant concentration of the charged particles is circulated and the meniscus 116 covering at least the tip end portion 175 is formed on the surface of the ink guide 152. When a bias voltage Vb (900 V, for instance) is applied from the bias power supply 62 of the power supply unit 6 under this state, an electric field is formed between the control electrodes 144 and the counter electrode 40 by this bias voltage Vb. Then, the drive power supply 64 of the power supply unit 6 superimposes a drive voltage Vc that is a pulse voltage (250 V, for instance) on the control electrodes 144 formed around a desired ink guide 152 in accordance with a signal inputted from the signal output means (not shown) and applies a resultant voltage of 1150 V. As a result, the electric field formed between the control electrodes 144 and the counter electrode 40 is strengthened and an ink droplet 18 is ejected from the meniscus 116 toward the counter electrode 40 by means of an electrostatic force generated by the strengthened electric field and is caused to adhere to the recording medium 42.

At this time, an electric field exerted from the control electrodes 144 in the downward direction in FIG. 11A is also formed. However, the grounded shield electrode 148 is provided on the lower side of the control electrodes 144 in FIG. 12 so as to oppose the control electrodes 144 and this electric field directed in the downward direction in FIG. 12 is concentrated toward this shield electrode 148 and is shielded. The shielding suppresses widening in the horizontal direction in FIG. 12 of the electric field exerted from the control electrodes 144 in the downward direction in FIG. 12. As a result, no electric field directed in the downward direction in FIG. 12 is formed in the ink supply path 155 and no electrostatic force is exerted on the ink 12 moving in the ink supply path 155 in the upward direction in FIG. 12. Therefore, the ink 12 in the ink supply path 155 is not influenced by the electric field formed by the voltage application to the control electrodes 144 and flows in the ink supply path 155 in the upward direction in FIG. 12 while maintaining a constant concentration of the charged particles.

Immediately after the control voltage Vc is applied and the ink droplet 18 is ejected, the voltage of the control electrodes 144 returns to a bias state. Further, immediately after the ejection, ink supply from the ink flow 114 flowing in proximity to the tip end portion 175 is performed on the meniscus 116 by an amount consumed by the ejection and the shape of the meniscus 116 is restored swiftly.

In this embodiment, the conductive film 174 is formed on the ink guide 152 of the ink ejection head 103. With this conductive film 174, the tip end portion 175 of the ink guide 152 is given conductivity and it becomes possible to strengthen the electric field around the tip end portion 175. In the present invention, however, it is not necessary to form the conductive film 174 so long as it is possible to obtain a predetermined electric field strength.

Also, in this embodiment, the separation barriers 140 are provided around the control electrodes 144 of the ink ejection head 103, although it is not necessary to provide these separation barriers 140 in the present invention. However, it is preferable that the separation barriers 146 are provided because it becomes possible to separate the meniscuses 116 formed at the adjacent ink guides 152 and to maintain the respective meniscuses 116 formed at the respective ink guides 152 with stability without being influenced by fluctuations of the meniscuses 116 at the time of ejection of the ink droplets 18 from the adjacent ink guides 152.

Further, it is preferable that at least the surfaces of the separation barriers 146 have ink repellency because it becomes possible to separate the meniscuses 116 formed at the adjacent ink guides 152 with more reliability by preventing a situation where the ink climbs the wall surfaces of the separation barriers 146. Here, the ink repellency means a water-repellent property in the case of water-based ink and means an oil repellent property in the case of oil-based ink.

Also, in this embodiment, the shield electrode 148 is provided on the opposite surface of the control substrate 143 of the present invention to the side opposing the counter electrode 40, so as to oppose the control electrodes 144, although it is not necessary to provide this shield electrode 148. However, when the electric field exerted from the control electrodes 144 directed in the downward direction in FIG. 11A is shielded using the shield electrode 148, widening in the horizontal direction in FIG. 11A of the electric field directed in the downward direction in FIG. 11A is suppressed. As a result, it becomes possible to prevent a situation where an electric field directed in a direction opposite to the moving direction of the ink 12 in the ink supply path 155 is formed in the ink supply path 155, which makes it possible to cause the ink 12 containing a stabilized concentration of the charged particles to flow out from the ink outflow opening 156. For this reason, it is preferable that the shield electrode 148 is provided, thereby making it possible to maintain a certain concentration of the charged particles in the meniscus 116 and to stabilize the size and shape of the ejected ink droplet 18.

As described above, with the ink ejection apparatus 100 constructed using the ink ejection head 103 of this embodiment, it becomes possible to form the meniscus 116 covering the tip end portion 175 of the ink guide 152 prepared by anisotropic wet etching of a single crystal substrate and sharpened with high accuracy in a stabilized shape without being influenced by fluctuations of the supply pressure of the ink 12 ascribable to the pulsatory motions of the ink pump 26 and the like. Also, ink supply to the meniscus 116 is performed from the ink flow 114 flowing in proximity to the tip end portion 175 in which the meniscus 116 is formed, so that it also becomes possible to swiftly restore the meniscus 116 after the ejection of the ink droplet 18. As a result of those effects, it becomes possible to eject the minute ink droplet 18 having a stabilized size and shape at a high ejection frequency.

The liquid ejection head produced according to the present invention is not limited to a head involving the ejection of ink containing colorant particles and may be a head that ejects any other kind of solution so long as the solution contains charged particles dispersed in a solvent.

The ink ejection head 103 described above may be produced in a manner described below.

FIGS. 13A to 13E and FIGS. 14A to 14E are each a schematic cross-sectional view illustrating a production method for the ink ejection head of this embodiment.

First, a glass substrate 167 made of quartz glass is prepared as an insulative substrate and its both surfaces are ground. Then, metallic patterns 168 having a predetermined shape are formed using photolithography on one of the surfaces (surface on the upper side in FIG. 13A) of the glass substrate 167. When viewed from the upper side in FIG. 13A, these metallic patterns 168 have a shape that is the same as the shape of the upper surfaces 154 of the protrusion portions 150 shown in FIG. 10B taken from the upper side in FIG. 9. That is, openings 171 corresponding to the solution supply openings 156 are formed at predetermined positions in the patterns 168 having an approximately rectangular shape corresponding to the upper surface 154. In this embodiment, a quartz glass substrate is used as the insulative substrate, although it is possible to use a glass substrate made of borosilicate glass or the like as the insulative substrate.

Figure 13A:
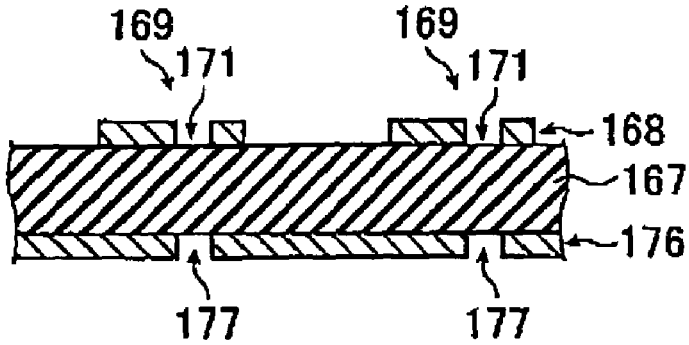
FIGS. 13A to 13E are each an explanatory diagram of a production method for the ink ejection head according to the second embodiment.

Next, as shown in FIG. 13A, a metallic pattern 176 having a predetermined shape is formed using Cr, Ni, or the like on a surface of the glass substrate 167 on a side opposite to the metallic pattern 168 (surface thereof on the lower side in FIG. 13A) using photolithography. This metallic pattern 176 has a shape where a metallic layer is provided on the whole of the surface of the glass substrate 167 on the side opposite to the metallic pattern 168 and openings 177 corresponding to the solution inflow openings 157 are established in this metallic layer so as to approximately coincide with the openings 171 of the metallic patterns 168 when viewed from the lower side in FIG. 13A.

The material of this metallic pattern is not limited to Cr or Ni and the metallic pattern need only be made of a material resistant to dry etching using $CF_4$ gas.

Figure 13B:
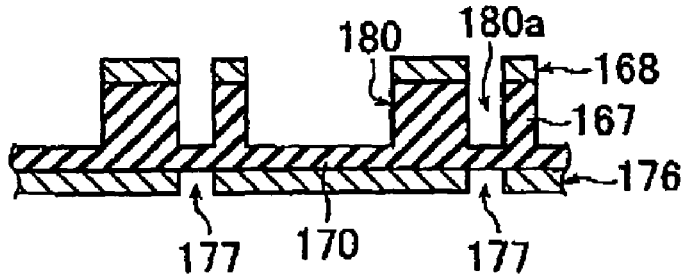

Next, as shown in FIG. 13B, the glass substrate 167 is dry-etched by a predetermined depth from its surface on the upper side in FIG. 13A using the metallic patterns 168 as etching masks, thereby forming projections and depressions on the surface of the glass substrate 167. In this manner, the glass substrate 167 is processed into a shape where convex portions 180 having a cross-sectional shape corresponding to the metallic patterns 168 protrude from a surface of a plate-shaped base portion 170. Also, as a result of the dry etching, convex portion through-holes 180*a* having a cross-sectional shape corresponding to the opening portions 171 are established in the convex portions 180.

Figure 13C:
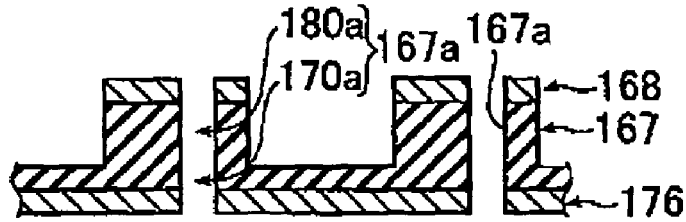

Next, as shown in FIG. 13C, the glass substrate 167 is dry-etched from it surface on the lower side in FIG. 13C using the metallic pattern 176 as an etching mask. As a result, substrate portion through-holes 170*a* having a cross-sectional shape corresponding to the openings 177 are established. Here, the substrate portion through-holes 170*a* and the convex portion through-holes 180*a* are connected with each other, thereby forming glass substrate through-holes 167*a* passing through the glass substrate 167 in the vertical direction. Next, the metallic patterns 168 and 176 are removed through etching (see FIG. 13D). In this manner, the first head member 130 is obtained where the convex portions 180 having an approximately rectangular parallelopiped shape and corresponding to the protrusion portions 150 are formed at predetermined positions so as to protrude from the substrate portion 170 corresponding to the head substrate 134 and the glass substrate through-holes 167*a* corresponding to the ink supply paths 155 are established so as to pass through the substrate portion 170 and the convex portions 180 in the vertical direction in FIG. 13D.

Figure 13D:
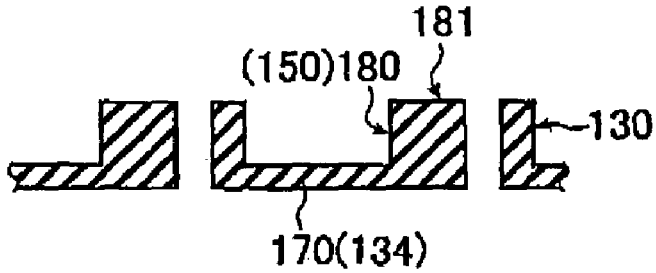
Figure 13E:
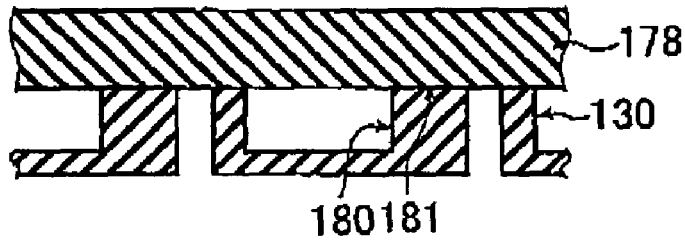

Next, as shown in FIG. 13E, a single crystal Si substrate 178, whose both surfaces that are each a (100) crystalline plane have been ground, is joined to the upper surface 181 of the convex portions 180 on the upper side in FIG. 13D with a surface activation joining method. The method of joining these substrates is not limited to the surface activation joining method and the joining may be performed using a solder or a bonding agent that is resistant to KOH etchant. Also, when the glass substrate 167 is not a quartz glass substrate but is a glass substrate made of borosilicate glass or the like and containing an alkaline ion, it is possible to achieve the joining of these substrates using an anode joining method.

Figure 14A:
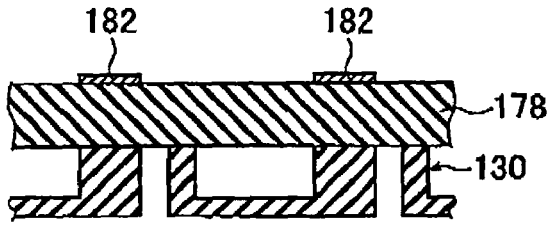
FIGS. 14A to 14E are also each an explanatory diagram of the production method for the ink ejection head according to the second embodiment, in which process steps following the process step shown in FIG. 13E are illustrated.

Next, as shown in FIG. 14A, an $SiO_2$ film is formed on a surface of the single crystal Si substrate 178 with a thermal oxidation method, a CVD method, or the like and is processed into square $SiO_2$ patterns 182 having a predetermined size whose sides coincide with the <110> and <1–10> crystal orientations of the single crystal Si substrate 178, at positions corresponding to the convex portions 180 of the first head member 130 through photolithography and etching.

Figure 14B:
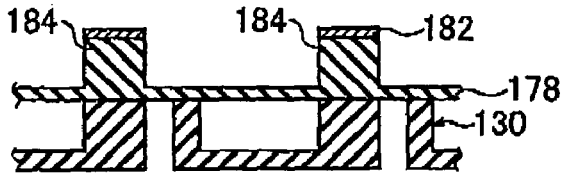

Next, $SF_6$ dry etching of the single crystal Si substrate 178 is performed using the $SiO_2$ patterns 182 as etching masks by a predetermined amount, thereby forming multiple square-pole structural members 184 made of Si as shown in FIG. 14B. Thus, projections corresponding to the multiple square-pole structural members 184 made of Si and the depressions corresponding to the surfaces of the other portions of the single crystal Si substrate 178 are formed in the single crystal Si substrate 178.

Figure 14C:
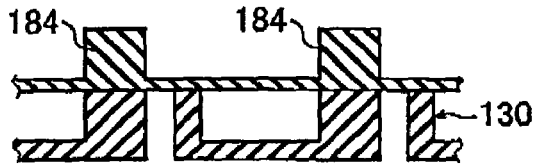
Figure 14D:
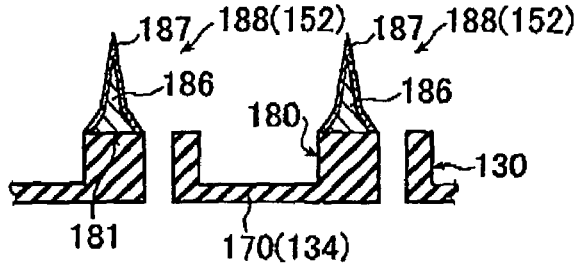

Next, the $SiO_2$ patterns 182 are removed by performing $CF_4$ dry etching (see FIG. 14C). Following this, the whole of the product is immersed in a 34 wt % solution of KOH in water heated to around 70° C. and anisotropic wet etching of Si is performed. During this anisotropic wet etching, etching speeds from each edge and each vertex portion of the square-pole structural members 184 are in particular high and the etching is processed while setting high-order crystalline planes as etching surfaces. As a result of this etching, Si pyramidal structural members 186 formed by inclined surfaces that are each a high-order crystalline plane and having a sharpened tip end with a tip end angle of around 60° or less and a radius of curvature of 4 μm or less are formed on the substrate upper surfaces 181 of the convex portions 180. Then, as shown in FIG. 14D, conductive films 187 are formed on the surfaces of the pyramidal structural members 186 using a sputtering method or the like and sharp-pointed members 188 corresponding to the ink guides 152 are obtained on the upper surfaces 154 (substrate upper surfaces 181) of the protrusion portions 150 (convex portions 180) that protrude from the surface of the head substrate 134 (substrate portion 170) of the head member 130.

Figure 14E:
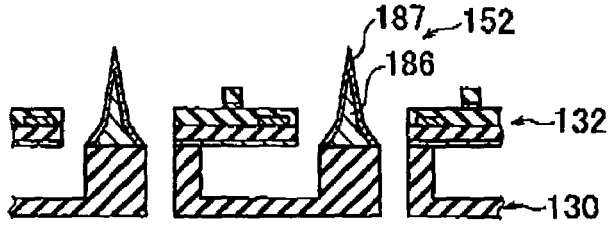

Next, as shown in FIG. 14E, a separately produced second head member 132, in which through-holes have been established at predetermined positions and which has metallic patterns that are control electrodes formed so as to surround the through-holes, is abutted against the upper surfaces 154 of the convex portions 180 and is bonded to these surfaces 154 using a bonding agent or the like, thereby joining the first head member 130 and the second head member 132 to each other. Following this, the side walls 135 described above are arranged and joined to the first head member 130 and the second head member 132, thereby obtaining the ink ejection head 103 (see FIGS. 9, 10A, and 10B).

Figure 15:
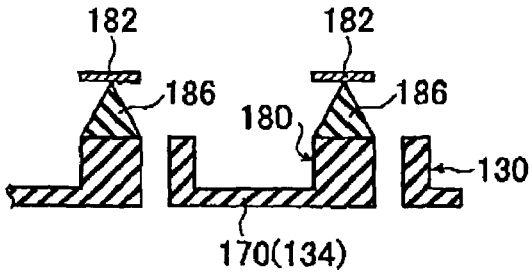
FIG. 15 is a schematic cross-sectional view illustrating an etching process of a single crystal Si substrate of the production method for the ink ejection head according to the second embodiment.

It is also possible to produce the ink ejection head 103 according to this embodiment by changing the etching process of the single crystal Si substrate 178 (steps shown in FIGS. 14B to 14D) in a manner described below. FIG. 15 is a schematic cross-sectional view illustrating another etching process of the single crystal Si substrate 178 of the production method for the ink ejection head 103 of this embodiment.

First, after the square $SiO_2$ patterns 182 shown in FIG. 14A, whose sides coincide with the <110> and <1–10> crystal orientations of the single crystal Si substrate 178, are formed in a predetermined size, the substrate is immersed in a 34 wt % solution of KOH in water heated to 70° C. and anisotropic etching of Si is performed using the $SiO_2$ patterns 182 as etching masks. In this etching process, the single crystal Si substrate 178 is etched using the square $SiO_2$ patterns 182 as etching masks and undercut progresses from corner portions of the square shape of the $SiO_2$ patterns 182 and the etching is continued until the $SiO_2$ patterns 182 are separated from the surface of the single crystal Si substrate 178. In this manner, Si pyramidal structural members 186 formed by inclined surfaces that are each a high-order crystalline plane and having a sharpened tip end with a tip end angle of around 60° or less and a radius of curvature of 4 μm or less are produced on the substrate upper surfaces 181 of the convex portions 180 as shown in FIG. 15.

Following this, the step shown in FIG. 14E is performed like in the above description and the ink ejection head 103 is obtained.

In this embodiment, $SiO_2$ is used to form the etching mask for forming the Si square-pole structure using the $SF_6$ reaction gas, although a metal, such as Cr or Al, that is resistant to a fluorine-based gas may be used to form the mask.

Also, in this embodiment, the Si square-pole structure is formed through dry etching using the $SF_6$ reaction gas, although the same pole-shaped structure may be produced by directly processing the Si substrate using a microprocessing method such as sand blasting or ultrasonic processing.

In each embodiment described above, the sharp-pointed ink guides are produced through the anisotropic etching of an Si single crystal substrate. In the present invention, however, the material of the single crystal substrate is not limited to Si so long as it is possible to produce the sharp-pointed ink guides by performing the anisotropic etching. For instance, so long as such sharp-pointed ink guides can be produced through the anisotropic etching, it is possible to produce the ink guides using a compound semiconductor single crystal substrate or the like with the ink ejection head production method of the present invention.

Also, in each embodiment described above, ink guides, whose inclined surfaces are each a high-order crystalline plane and tip end has been sharply pointed, are produced through anisotropic etching. In the present invention, however, it is not necessarily required to set the inclined surfaces of the ink guides as such high-order crystalline planes and the inclined surfaces may be formed with (111) planes, for instance. Note that the high-order crystalline planes in the present invention refer to crystalline planes expressed by the Miller indices and are, for instance, (211) or (311) crystalline planes having great values of the Miller indices.

Also, in each embodiment described above, the tip ends of the ink guides are each set so that its tip end angle is at 60° or less and its radius of curvature is at 4 μm or less. In the present invention, however, there occurs no problem even if the tip end of each ink guide is not sharply pointed to this degree so long as a droplet is ejected with stability from the ink guide tip end at a desired ejection voltage. However, in order to eject the ink with more stability while reducing the ejection voltage, it is preferable that each ink guide is produced so that its tip end has a tip end angle of 60° or less and a radius of curvature of 4 μm or less.

<Third Embodiment>

Next, a third embodiment of the present invention will be described. Note that in this embodiment, each construction element that is the same as that of the liquid ejection head 1 of the first embodiment shown in FIG. 1 is given the same reference numeral and the detailed description thereof will be omitted.

Figure 16:
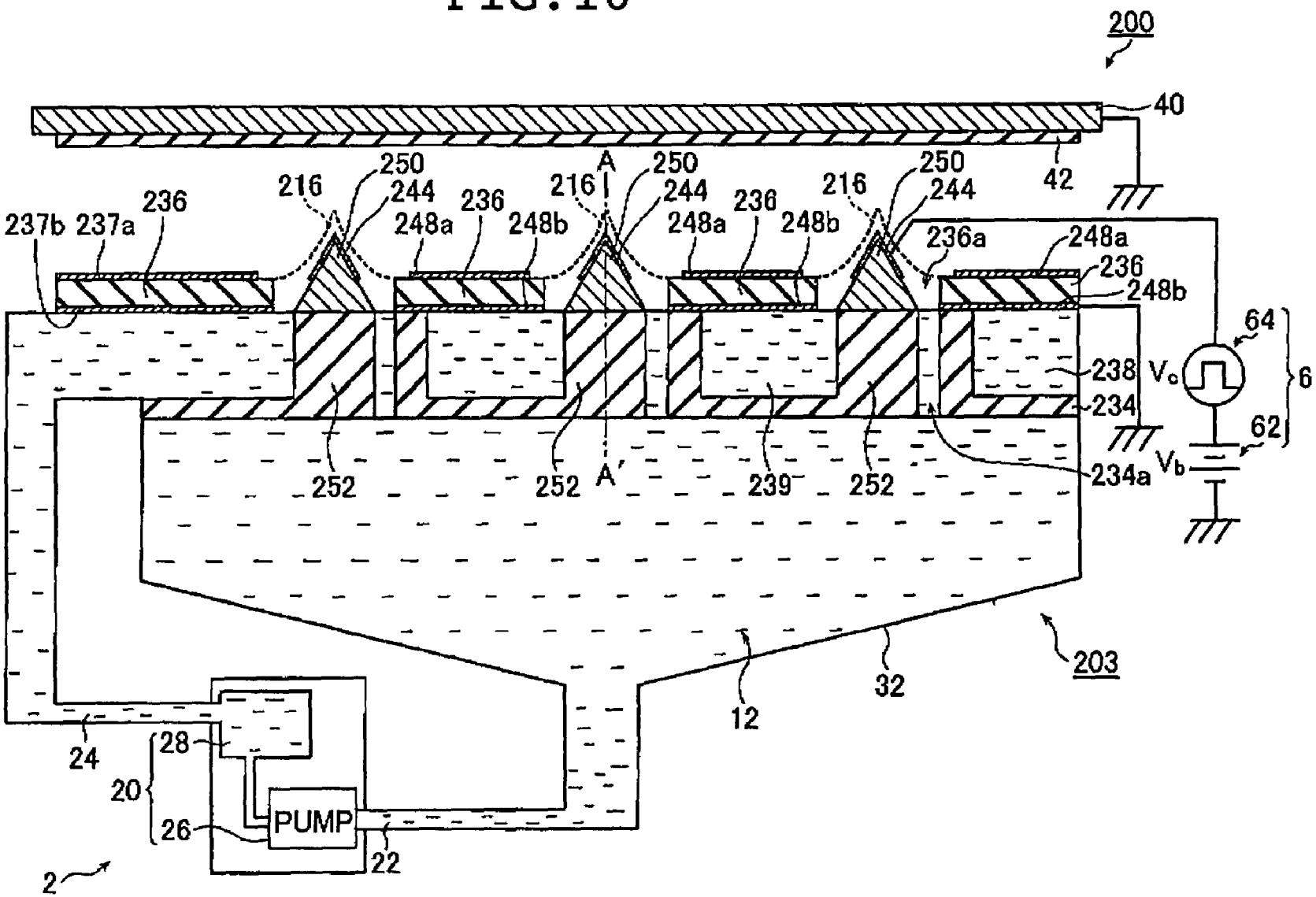
FIG. 16 is a schematic structural diagram of an ink ejection apparatus provided with an ink ejection head according to a third embodiment of the present invention.

FIG. 16 is a schematic structural diagram of an ink ejection apparatus 200 provided with an ink ejection head 203 that is the third embodiment of the liquid ejection head of the present invention. As shown in FIG. 16, the ink ejection apparatus 200 mainly includes an ink reflux unit 2, the ink ejection head 203, and a power supply unit 6. Hereinafter, the ink reflux unit 2, the ink ejection head 203, and the power supply unit 6 will be described in order.

First, the ink reflux unit 2 will be described. The ink reflux unit 2 is the same as that shown in FIG. 1, so that the detailed description thereof will be omitted. In this embodiment, an ink pump 26 is connected to the ink ejection head 203 through an ink supply pipe 22 and an ink tank 28 is connected to the ink ejection head 203 through an ink recovery pipe 24 like in the above embodiments.

Also, ink 12 adjusted in concentration by a concentration adjustment mechanism (not shown) in the ink tank 28 is supplied from the ink pump 26 to an ink accommodation chamber 32 of the ink ejection head 203 through the ink supply pipe 22 at a predetermined pressure, The ink accommodation chamber 32 is filled with the ink 12 and the ink 12 is supplied to ink ejection openings 236*a* by passing through respective head substrate through-holes 234*a*.

Next, the ink ejection head 203 will be described with reference to FIG. 16. The ink ejection head 203 includes the ink accommodation chamber 32, a head substrate 234, an insulative substrate 236, ink recovery paths 238, a counter electrode 40, control electrodes 244, shield electrodes 248*a* and 248*b*, and ink guide members 250. Also, a recording medium 42, on which a predetermined image or the like is to be recorded by an ejected liquid, is placed on the counter electrode 40.

The ink accommodation chamber 32 is a space for accommodating the ink 12 and is defined by a vessel whose upper portion is opened in an approximately rectangular shape, and the lower surface of the head substrate 234 placed so as to cover the upper portion of the vessel. An opening portion is formed in the bottom surface of the vessel constituting the ink accommodation chamber 32 and is connected to the ink supply pipe 22.

The head substrate 234 is produced using an insulative substrate, such as a glass substrate, and head substrate through-holes 234*a* passing through the head substrate 234 in the vertical direction (thickness direction of the substrate) are established in the head substrate 234 at predetermined positions as ink supply paths for supplying the ink to the ink guide members 250. Above the head substrate 234, the insulative substrate 236 is arranged parallel to the head substrate 234 and is bonded to the head substrate 234. Also, the grounded shield electrodes 248*a* and 248*b* are respectively formed on the upper surface 237*a* and the lower surface 237*b* of the insulative substrate 236. Above the insulative substrate 236, the grounded counter electrode 40 is arranged so as to oppose the insulative substrate 236 with a predetermined distance in-between. The recording medium 42 (recording paper, for instance) is placed on a surface of the counter electrode 40 on a side opposing the insulative substrate 236.

In the head substrate 234, ink recovery grooves 239 are formed so as to extend in a direction perpendicular to the paper plane of FIG. 16 and the ink recovery paths 238 are defined by the inner walls of the ink recovery grooves 239 and the lower surface 237*b* of the insulative substrate 236. The ink recovery paths 238 are connected to the ink recovery pipe 24 as shown in FIG. 16. The circular ink ejection openings 236*a* passing through the insulative substrate 236 in the vertical direction in FIG. 16 (thickness direction of the insulative substrate) are established in the insulative substrate 236. Also, the head substrate 234 is provided with the ink guide members 250 at positions corresponding to the ink ejection openings 236*a* of the insulative substrate 236 so that the extreme top portions 258 of the ink guide members 250 are positioned higher than the upper surface 237*a* of the insulative substrate 236 and the tip end portions of the ink guide members 250 protrude from the ink ejection openings 236*a*. That is, the ink supply paths 234*a* communicate with the ink ejection openings 236*a* and the ink ejection openings 236*a* communicate with the ink recovery paths 238.

Figure 17A:
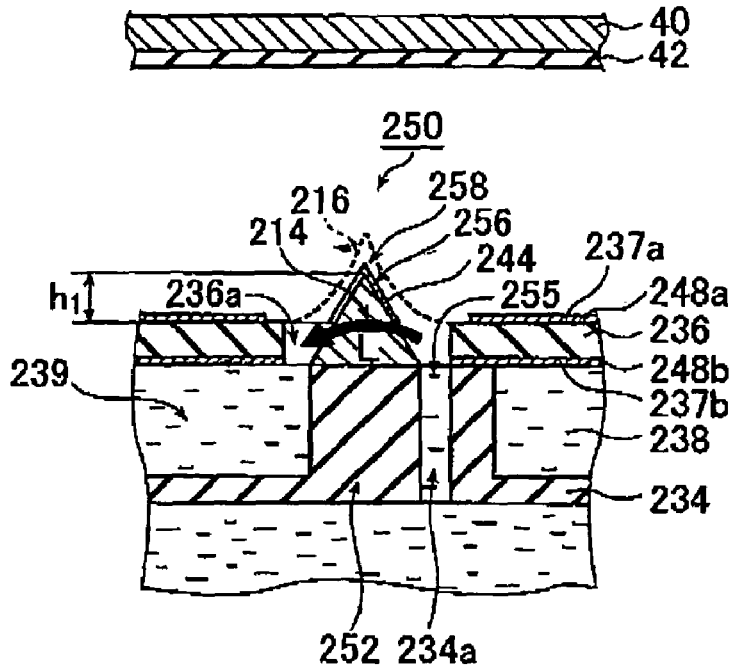
FIG. 17A is a partial enlarged cross-sectional view of one of multiple ink guide members of the ink ejection head shown in FIG. 16.
Figure 17B:
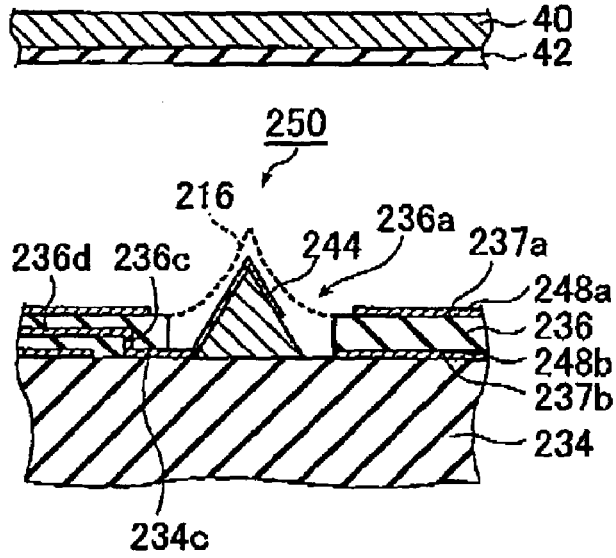
FIG. 17B is a schematic cross-sectional view taken perpendicularly to a paper plane of FIG. 16 along a plane containing the line A–A' in FIG. 16.
Figure 17C:
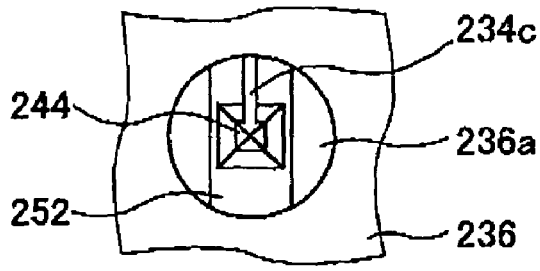
FIG. 17C is a schematic plan view showing one of the multiple ink guide members in FIG. 16 viewed from the upper side in FIG. 16.

Here, the ink guide members 250 will be described in detail with reference to FIGS. 17A to 17C. FIGS. 17A to 17C each show one of the multiple ink guide members 250 shown in FIG. 16. In more detail, FIG. 17A is a schematic cross-sectional view where the peripheral portion of the ink guide member 250 is enlarged and illustrated, FIG. 17B is a schematic cross-sectional view taken perpendicular to the paper plane of FIG. 16 along a plane containing the line A–A' in FIG. 16, and FIG. 17C is a schematic plan view where the peripheral portion of the ink guide member 250 is viewed from the upper side in FIG. 16.

As shown in FIG. 17A, the ink guide member 250 is provided on the upper surface of a side wall 252 forming the ink recovery groove 239 of the head substrate 234 so as to protrude toward the counter electrode 40. Also, as shown in FIG. 17C, the ink guide member 250 is positioned so that its extreme top portion 258 approximately coincides with the center axis of the ink ejection opening 236*a* of the insulative substrate 236. Further, the ink guide member 250 is a pyramid-shaped structural member having a tapered shape that becomes narrower as a distance to its tip end is decreased. Still further, the extreme top portion 258 that is the tip end is sharply pointed. The ink guide member 250 is formed using single crystal Si, for instance. From the viewpoint of reduction in drive voltage, it is desirable that the tip end portion of the ink guide member 250 has a tip end angle of 60° or less and a radius of curvature of 4 μm or less.

Figure 18A:
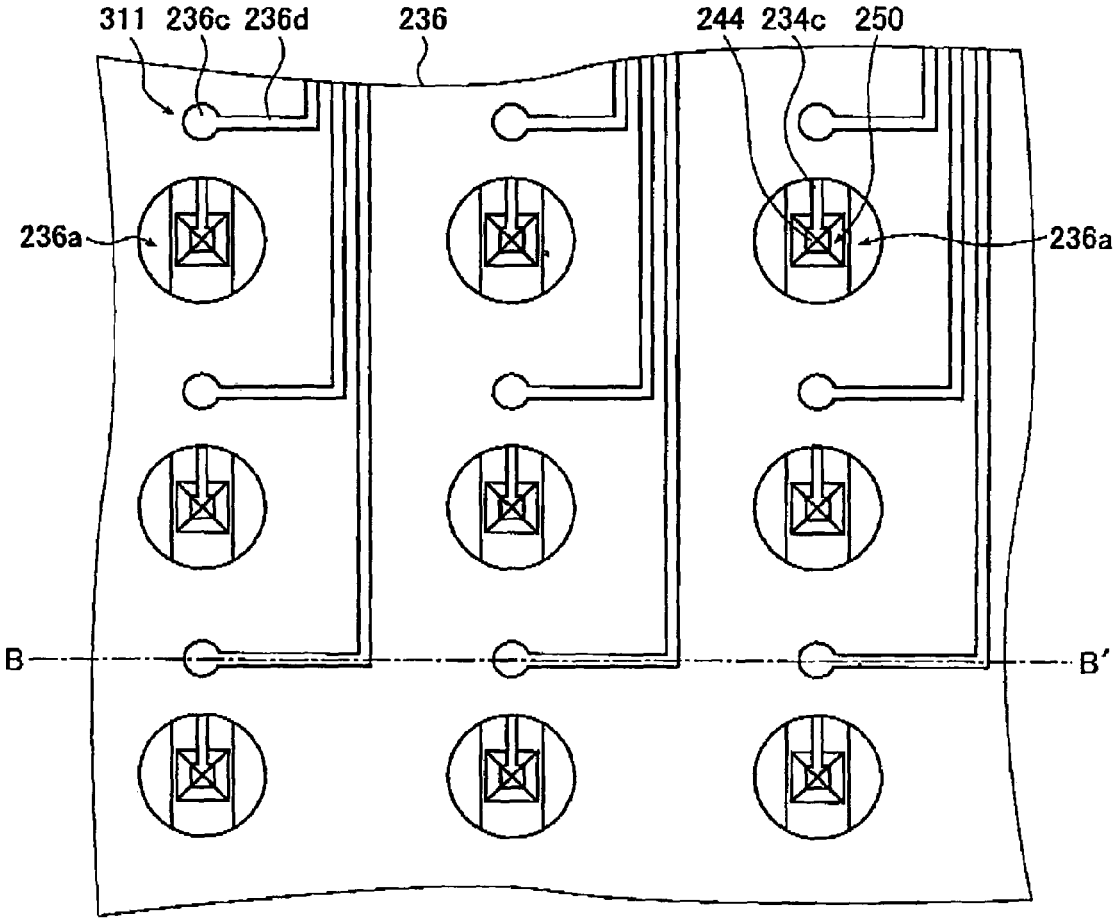
FIG. 18A is a schematic plan view showing a schematic construction and arrangement of metallic wiring connected to control electrodes of the ink ejection head shown in FIG. 16.
Figure 18B:
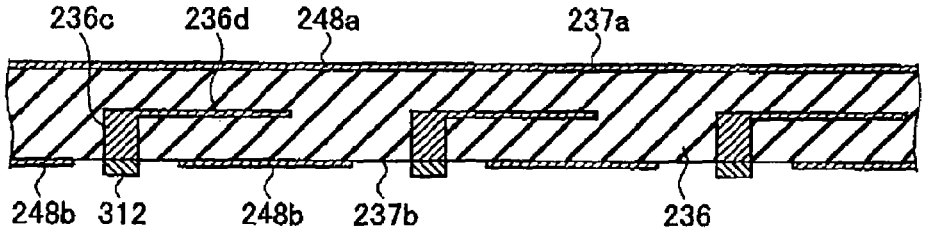
FIG. 18B is a schematic cross-sectional view taken along the line B–B' in FIG. 18A.

The control electrode 244 that is a two-layered film composed of a Cr film and an Au film is formed at the tip end of the ink guide member 250 so as to partially cover the surface of the tip end. In this embodiment, the thickness of the Cr film is set at 30 nm and the thickness of the Au film is set at 100 nm, although these thicknesses of the Cr film and the Au film are merely examples and the present invention is not limited to these thicknesses. As shown in FIG. 17B, metallic lines 236*c* and 236*d* for accomplishing electrical joining with the control electrode 244 are formed on the insulative substrate 236 so as to be connected with each other. Also, a metallic line 234*c* connected with the control electrode 244 is formed so as to extend from the outer peripheral side of the ink guide member 250 on the upper surface of the side wall 252 forming the ink recovery groove 239 of the head substrate 234. Here, FIGS. 18A and 18B each show a schematic construction and arrangement of metallic wiring connected with the control electrode 244. FIG. 18A is a schematic plan view showing the schematic construction and arrangement of the metallic wiring connected with the control electrode of the ink ejection head shown in FIG. 16 and FIG. 18B is a schematic cross-sectional view taken along the line B–B' in FIG. 18A. An opening 311 passing through the insulative substrate 236 in its thickness direction is formed in the insulative substrate 236 and a metal or the like is filled in this opening 311, thereby forming the metallic line 236*c* extending in the thickness direction of the insulative substrate 236. On a lower surface 237*b* of the insulative substrate 236 shown in FIG. 17B, the metallic line 236*c* is bonded to and connected with the metallic line 234*c* formed on the upper surface of the head substrate 234 by applying a solder 312 to an exposed portion of the metallic line 236*c* on the lower surface 237*b* of the insulative substrate 236 in a manner shown in FIG. 18B. Through these wiring, the control electrode 244 is electrically connected to the power supply unit 6 shown in FIG. 16.

As shown in FIG. 17A, in a region of the head substrate 234 on an outer peripheral side of the ink guide member 250, a through-hole 234*a* passing through the head substrate 234 in the thickness direction is formed. An opening portion at the upper end of this through-hole 234*a* functions as an ink outflow opening 255 through which the ink flows out to a space defined by the inner wall of the ink ejection opening 236*a* of the insulative substrate 236, and an opening portion at the lower end of the through-hole 234*a* functions as an ink supply port 257 connected with the ink accommodation chamber 232. With this construction, communication between the head substrate through-hole 234*a* and the ink ejection opening 236*a* is established and the head substrate through-hole 234*a* functions as an ink supply path that supplies the ink to the ink ejection opening 236*a*.

In FIG. 17A, the ink 12 supplied to the ink accommodation chamber 32 by the ink pump 26 flows through the head substrate through-hole 234*a* functioning as an ink supply path in the upward direction and flows out from the ink outflow opening 255. At this time, the supply pressure of the ink 12 is adjusted by the ink pump 26 so that the ink 12 flown out from the ink outflow hole 255 goes across the inclined surfaces 256 around the extreme top portion 258 (in the direction of arrow L in FIG. 17A), advances to a region of the ink ejection opening 236*a* on an ink recovery path side, and flows into the ink recovery path 238.

When going across the inclined surfaces 256, a part of the ink 12 is guided to the extreme top portion 258 of the ink guide member 250 by means of the surface tension of the ink 12. The ink 12 guided to the extreme top portion 258 forms a meniscus 216 covering the extreme top portion 258 as indicated by the dotted line in FIG. 17A. Here, the meniscus 216 is mainly formed by the surface tension of the ink 12, so that this meniscus 216 is formed in a stabilized shape that is hardly influenced by minute fluctuations of the supply pressure of the ink 12 ascribable to the pulsatory motions of the ink pump 26 or the like. In this manner, in the ink ejection apparatus 200, the ink 12 containing a constant concentration of charged particles is constantly supplied to the extreme top portions 258 of the respective ink guide members 250 and the meniscuses 216 are formed.

A part of the ink 12 supplied to each ink guide member 250 forms the meniscus 216 in the manner described above. On the other hand, the remaining great majority of the ink 12 flows into the ink recovery path 238 communicating with the ink ejection opening 236*a* and returns to the ink tank 28. The ink 12 returned to the ink tank 28 is adjusted in concentration again in this tank 28 and is sent from the ink pump 26 into the ink accommodation chamber 32 through the ink supply pipe 22 again at a predetermined pressure. With this construction, in the ink ejection head 203 according to this embodiment, the ink 12 containing a constant concentration of charge particles is constantly supplied to the ink guide members 250 by the ink reflux unit 2.

Next, the power supply unit 6 will be described with reference to FIG. 16. The power supply unit 6 includes a bias power supply 62 and a drive power supply 64, with the drive power supply 64 being connected with a signal output means (not shown). The bias power supply 62 and the drive power supply 64 are connected to the control electrodes 244 of the ink ejection head 203 through the metal-made wiring of the insulative substrate 236. With this construction, the bias power supply 62 constantly applies a bias voltage Vb to each control electrode 244 constituting the ink ejection head 203 and the drive power supply 64 superimposes a drive voltage Vc that is a pulse voltage on the bias voltage Vb and applies a resultant voltage to a desired control electrode 244 in accordance with a signal inputted from the signal output means (not shown).

Figure 19:
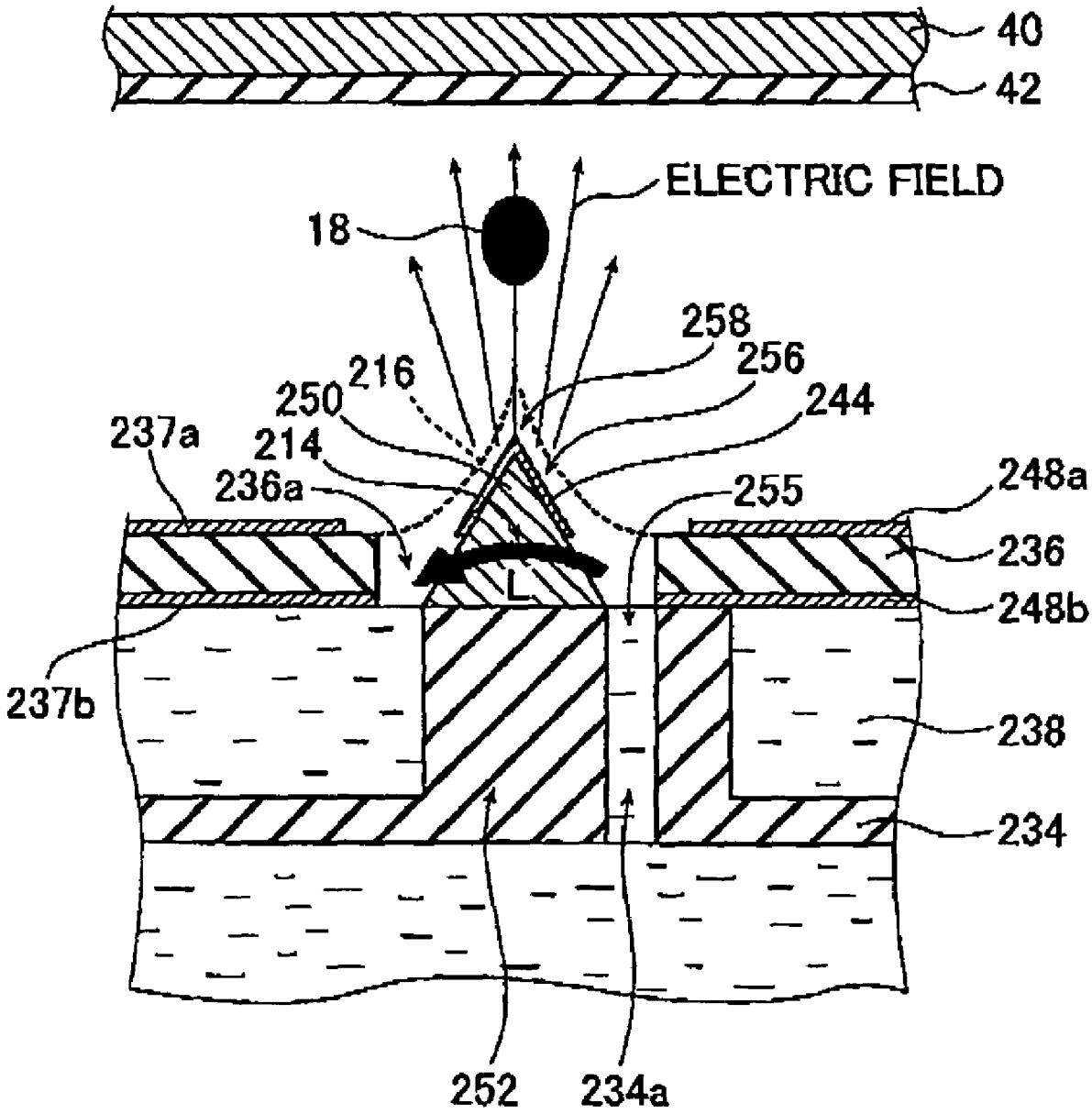
FIG. 19 is an explanatory diagram illustrating a liquid ejection operation of the ink ejection head shown in FIG. 16.

Next, an ink ejection operation in the ink ejection apparatus 1 will be described with reference to FIGS. 16 and 19. FIG. 19 is a schematic cross-sectional view where one of the multiple ink guide members 250 shown in FIG. 16 is enlarged and illustrated. In the ink ejection head 203, the ink 12 containing a constant concentration of the charged particles is circulated as described above, and the meniscus 216 covering the extreme top portion 258 in a film manner is formed at the tip end portion of the ink guide member 250. A voltage (900 V, for instance) is constantly applied to the control electrode 244 provided for the tip end portion of the ink guide member 250 from the bias power supply 62 shown in FIG. 16 as a bias and a pulse voltage (about 200 V, for instance) is superimposed on the bias voltage and is applied to the control electrode 244 as a signal voltage in accordance with an image signal inputted from the signal output means (not shown). The set voltage of the counter electrode 40 provided on the back of the recording medium 42 is set at 0 V. When a bias voltage Vb is applied from the bias power supply 62 of the power supply unit 6, an electric field is formed by this bias voltage Vb between the control electrode 244 and the counter electrode 40. Following this, when a drive voltage Vc that is a pulse voltage (250 V, for instance) is applied from the drive power supply 64 as a signal voltage corresponding to the image signal, this drive voltage Vc is superimposed on the bias voltage Vb (900 V, for instance) from the bias power supply 62 and a result voltage (1,150 V, for instance) is applied as a control voltage to the control electrode 244 formed at the tip end of the ink guide member 250 shown in FIG. 19. When the control voltage is applied to the control electrode 244 in this manner, the electric field formed between the control electrode 244 and the counter electrode 40 is strengthened and an ink droplet 18 is ejected from the meniscus 216 toward the counter electrode 40 by an electrostatic force generated by this strengthened electrode field and is caused to adhere onto the recording medium 42. At this time, the control electrode 244 is directly provided at the tip end of the ink guide member 250, so that the electric field gathers around the tip end portion of the ink guide member 250. As a result, it becomes possible to reduce a voltage required to cause the ink to fly, that is, a pulse voltage required to cause ink ejection as compared with a conventional case.

By the way, at the time of driving, when such a voltage is applied to the control electrode 244, an electric field exerted from the control electrode 244 in the downward direction in FIG. 19 is also formed. However, the shield electrode 248*b* is provided on the lower surface 237*b* of the insulative substrate 236 and the electric field directed downwardly in FIG. 19 is concentrated toward the shield electrode 248*b* and is shielded by this electrode 248*b*. As a result, widening in the horizontal direction in FIG. 19 of the electric field exerted from the control electrode 244 downwardly in FIG. 19 is suppressed. As a result, the downward electric field from the control electrode 244 does not reach the inside of the head substrate through-hole 234*a* functioning as the ink supply path and no electrostatic force is exerted on the ink 12 moving in the upward direction in FIG. 18 in the head substrate through-hole 234*a*. As described above, the ink 12 in the head substrate through-hole 234*a* is not influenced by the electric field generated by the voltage application to the control electrode 244 and flows in the ink supply path 257 in the upward direction in FIG. 18 while maintaining a constant concentration of the charged particles. As described above, the shield electrode 248*b* formed on the lower surface 237*b* of the insulative substrate 236 effectively prevents a situation where the electric field generated from the control electrode 244 reaches the head substrate through-hole 234*a* and the charged particle concentration of the ink passing through the head substrate through-hole 234*a* becomes uneven as a result of the voltage application at the time of driving.

Also, the shield electrode 248*a* is provided on the upper surface 237*a* of the insulative substrate 236. This shield electrode 248*a* suppresses widening in the horizontal direction in FIG. 19 of the electric field exerted from the control electrode 244 in the downward direction in the drawing like the shield electrode 248*b* described above. As a result, it becomes possible to prevent the unevenness of the charged particle concentration of the ink in the head substrate through-hole 234*a* resulting from the voltage application at the time of driving. In addition, the shield electrode 248*a* on the upper surface 237*a* of the insulative substrate 236 also suppresses interferences by electric fields generated from adjacent control electrodes 244.

Immediately after the drive voltage Vc is applied and the ink droplet 18 is ejected, the voltage of the control electrode 44 returns to a bias state. Further, immediately after the ejection, ink supply from the ink flow 214 going across the inclined surfaces 256 in proximity to the extreme top portion 258 is performed on the meniscus 216 by an amount consumed by the ejection and the shape of the meniscus 216 is restored swiftly.

Next, a production method for the ink ejection head 203 described above will be described with reference to the accompanying drawings. FIGS. 20A to 20J are each a schematic diagram showing a production process of the ink ejection head according to the present invention.

Figure 20A:
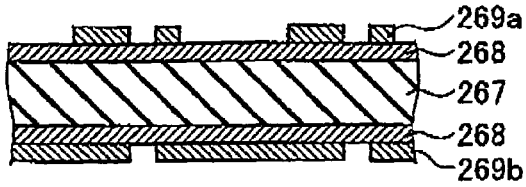
FIGS. 20A to 20J are each an explanatory diagram illustrating a production method for the ink ejection head according to the third embodiment of the present invention.

First, an $SiO_2$ substrate 267, whose both surfaces have been ground, is prepared and metallic layers 268 are formed on the upper surface and the lower surface of the $SiO_2$ substrate 267. As the material of the metallic layers 268, it is possible to use a metal, such as Cr or Ni, that is resistant to fluorine-based dry etching. Next, as shown in FIG. 20A, on a surface of the metallic layer 268 formed on the upper surface of the $SiO_2$ substrate 267, a resist pattern 269*a* having a shape corresponding to the ink recovery paths 238 and the head substrate through-holes 234*a* shown in FIG. 16 is formed through photolithography. At this time, an alignment mark (not shown) having a predetermined shape is formed in the metallic layer 268 at a predetermined position outside an ink ejection head production range. Then, alignment is performed with reference to this alignment mark and, as shown in FIG. 20A, a resist pattern 269*b* having a shape corresponding to the head substrate through-holes 234*a* is formed on a surface of the metallic layer 268 formed on the lower surface, of the $SiO_2$ substrate 267 through photolithography.

Figure 20B:
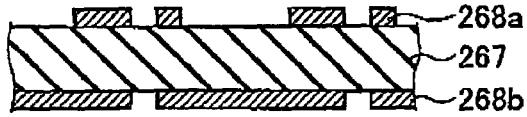

The metallic layers 268 formed on the upper surface and the lower surface of the $SiO_2$ substrate 267 are respectively etched using the resist patterns 269*a* and 269*b* formed in the manner described above as etching masks and then these resist patterns are removed. As a result, as shown in FIG. 20B, a metallic layer pattern 268*a* having a shape corresponding to the resist pattern 269*a* is formed on the upper surface of the $SiO_2$ substrate 267 and a metallic layer pattern 268*b* having a shape corresponding to the resist pattern 269*b* is formed on the lower surface of the $SiO_2$ substrate 267. Portions of the upper surface of the $SiO_2$ substrate 267, in which the metallic layer pattern 268*a* is not formed, correspond to the groove portions of the ink recovery paths 238 and the head substrate through-holes 234*a* of the liquid ejection head 203 shown in FIG. 16. Also, portions of the lower surface of the $SiO_2$ substrate 267, in which the metallic layer 268*b* is not formed, correspond to the head substrate through-holes 234*a* of the liquid ejection head 203 shown in FIG. 16. In this embodiment, the metallic layer patterns 268*a* and 268*b* are formed so that the opening portions of the head substrate through-holes 234*a* assume a rectangular shape.

Figure 20C:
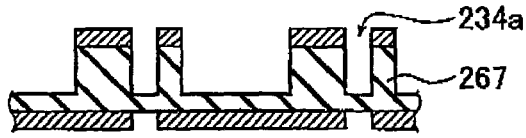
Figure 20D:
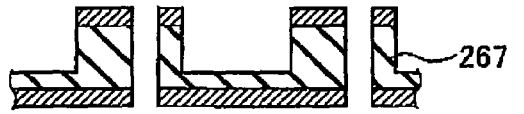

Next, as shown in FIG. 20C, $CF_4$ dry etching is performed for a predetermined period of time from the upper-surface side of the $SiO_2$ substrate 267 using the metallic layer 268*a* as an etching mask. As a result, the groove portions of the ink recovery paths 238 are formed and the head substrate through-holes 234*a* are partially formed. It is possible to adjust the groove portions of the ink recovery paths 238 so as to have a desired depth by controlling the etching time. Next, as shown in FIG. 20D, $CF_4$ dry etching is performed for a predetermined period of time from the lower-surface side of the $SiO_2$ substrate 267 using the metallic layer 268*b* as an etching mask. As a result, the $SiO_2$ substrate 267 is etched only in portions corresponding to the head substrate through-holes 234*a* and the head substrate through-holes 234*a* are established in the $SiO_2$ substrate 267 at predetermined positions, as shown in FIG. 20D.

Figure 20E:
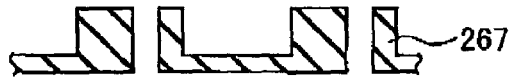
Figure 20F:
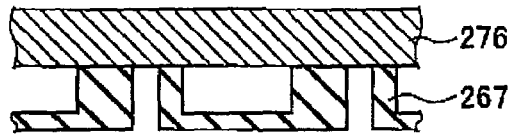

Next, as shown in FIG. 20E, the metallic layers 268*a* and 268*b* formed on both surfaces of the $SiO_2$ substrate 267 are removed through etching. Then, as shown in FIG. 20F, a single crystal Si substrate 276, whose both surfaces are formed by (100) crystalline planes and have been ground, is joined to the upper surface of the $SiO_2$ substrate 267 using a surface activation joining method.

Figure 20G:
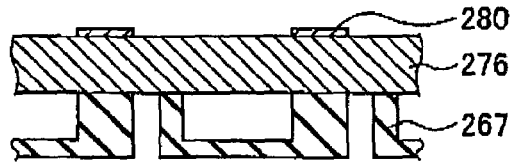

Next, an $SiO_2$ film 280 is formed on a surface of the single crystal Si substrate 276 through thermal oxidation or with a chemical vapor deposition (CVD) method so as to have a predetermined thickness. Then, as shown in FIG. 20G, a square pattern of the $SiO_2$ film 280, whose sides coincide with the <110> and <1–10> crystal orientations of the single crystal Si substrate 276, is formed by a usual photolithographic technique at predetermined positions where the ink guide members 250 of the liquid ejection head shown in FIG. 16 are to be formed. It is possible to form the $SiO_2$ film 280 by performing alignment with a predetermined position with reference to the aforementioned alignment mark using a both-side aligner apparatus or the like.

Figure 20H:
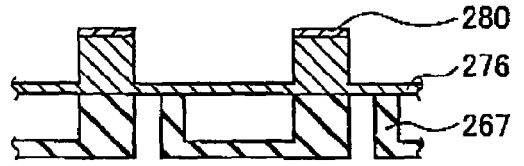
Figure 20I:
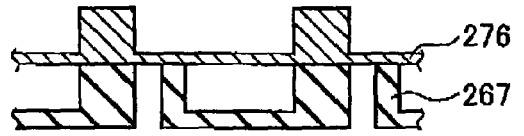

Then, dry etching of the Si substrate 276 using an $SF_6$-based gas is performed using the square pattern of the $SiO_2$ film 280 as an etching mask (see FIG. 20H).

As shown in FIG. 20H, etching of the Si substrate 276 is performed so that each region of the Si substrate, in which the $SiO_2$ film 280 is not formed, is left by a predetermined thickness. As a result, as shown in FIG. 20H, the Si substrate 276 is patterned into a shape corresponding to the square pattern mask of the $SiO_2$ film 280, that is, a square shape whose sides coincide with the <110> and <1–10> crystal orientations of the single crystal Si substrate 276.

Next, as shown in FIG. 201, dry etching is performed using a $CF_4$-based gas to remove the square pattern mask of the $SiO_2$ film 280.

Figure 20J:
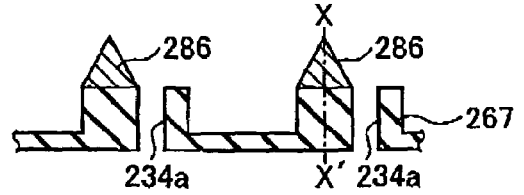

Following this, the single crystal Si substrate 276 (see FIG. 20I) is immersed in a 34 wt % solution of KOH in water heated to 70° C. and anisotropic etching of the single crystal Si substrate 276 is performed. By this etching process, pyramid structural members 286 having a tip end sharpened so as to have a tip end angle of around 60° or less and a radius of curvature of 4 μm or less are formed on the surface of the $SiO_2$ substrate 267, which is as shown in FIG. 20J. The pyramid structural members 286 correspond to the ink guide members 250 of the liquid ejection head shown in FIG. 16 and the inclined surfaces of the pyramid structural members 286 are each formed by a high-order crystalline plane.

Anisotropic etching of the single crystal Si substrate 276 may be performed using the KOH aqueous solution in the state shown in FIG. 20G or FIG. 20H. In this case, the single crystal Si substrate 276 is etched using the square $SiO_2$ film 280 as an etching mask. During this anisotropic etching, undercut progresses from the corner portions of the square shape of the $SiO_2$ film 280 and the etching is continued until the $SiO_2$ film 280 is separated from the surface of the single crystal Si substrate 276. As a result, the pyramid structural members 286 shown in FIG. 20J are formed.

Figure 21A:
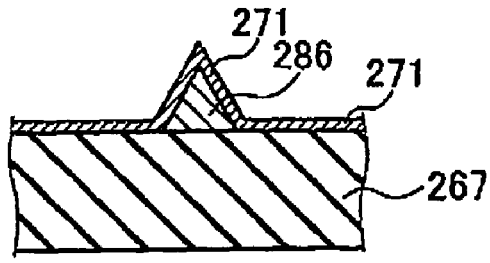
FIGS. 21A to 21E are each an explanatory diagram illustrating a process for forming an electrode on an ink guide member of the ink ejection head according to the third embodiment of the present invention.
Figure 21B:
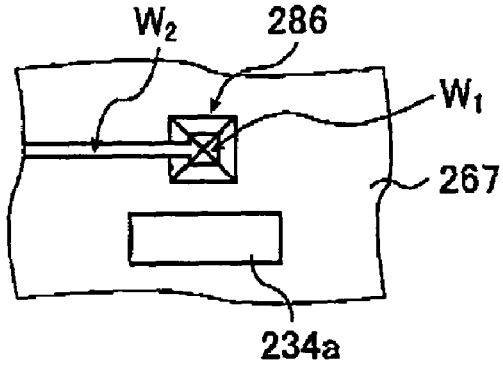
Figure 21C:
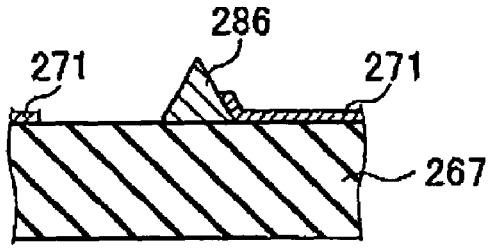
Figure 21D:
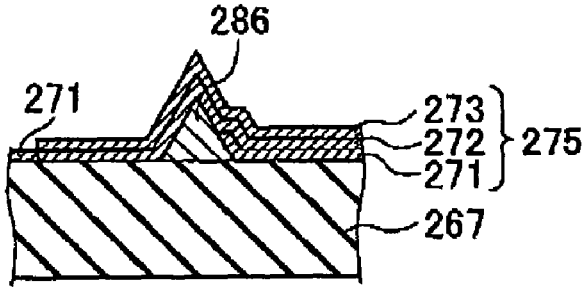
Figure 21E:
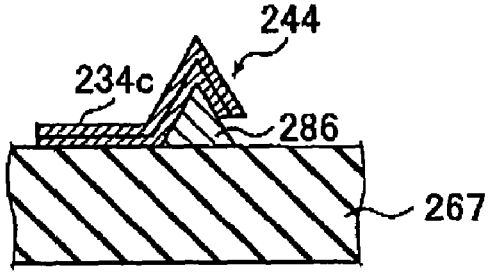

Next, the control electrodes 244 are formed at the tip ends of the pyramid structural members 286 produced in the manner described above, that is, the tip ends of the ink guide members 250. A method of forming the control electrodes 244 will be described with reference to FIGS. 21A to 21E. FIG. 21A is a schematic cross-sectional view taken perpendicularly to the paper plane of FIG. 20J along a plane containing the line X–X' in FIG. 20J. As shown in FIG. 21A, a positive-type photoresist 271 is applied onto a surface of the pyramid structural member 286 so as to form a film having a predetermined thickness through spray application. Then, as shown in FIG. 21B Where FIG. 21A is seen from the upper side, exposure light is irradiated only onto a region $W_1$ on the tip end portion of the pyramid structural member 286, in which the control electrode 244 should be formed, and a region $W_2$ on the $SiO_2$ substrate in which the wiring should be formed, thereby exposing the positive-type photoresist 271 in the regions $W_1$ and $W_2$. Following this, as shown in the schematic cross-sectional view in FIG. 21C, the positive-type photoresist 271 is removed in the region $W_1$, in which the control electrode 244 is to be formed, and the region $W_2$, in which the wiring is to be formed, by performing development (hereinafter these regions will be referred to as the "exposed portions"). Next, as shown in FIG. 21D, a Cr film 272 and an Au film 273 are formed in this order as a metallic film 275 on the pyramid structural member 286 using a sputtering technique so as to respectively have thicknesses of 30 nm and 100 nm. Following this, heat treatment is performed at around 150° C., thereby deforming the positive-type photoresist 271 formed on the pyramid structural member 286. As a result, cracks are formed in the metallic film 275 formed on the positive-type photoresist 271 and the metallic film 275 formed at the boundary between the positive-type photoresist 271 and the exposed portions. Finally, the positive-type photoresist 271 is dissolved using a positive-type photoresist release liquid, thereby removing the metallic film 275 in portions other than the exposed portions. In this manner, the control electrode 244 is formed in the tip end portion of the pyramid structural member 286 and the metallic wiring 234*c* connected to the control electrode 244 is formed on the $SiO_2$ substrate.

Then, an insulative substrate made of $Al_2O_3$ or the like is placed on and bonded to the head substrate obtained by forming the pyramid structural members 286 (ink guide members) on the $SiO_2$ substrate 267 and forming the control electrodes 244 on the pyramid structural members 286 in the manner described above. Here, multiple circular through-holes with a predetermined diameter for ejecting the ink are established in the insulative substrate. At the time of arrangement of the insulative substrate on the head substrate, the extreme top portions of the pyramid structural members 286 that are the ink guide members are positioned approximately coaxially with the through-holes (ink ejection openings) formed in the insulative substrate so that the tip end portions of the pyramid structural members 286 protrude through the through-holes of the insulative substrate. Note that it is preferable that the tip end portions of the ink guide members that are the pyramid structural members protrude by a height of 30 to 70 μm from the surface of the insulative substrate because this construction makes it possible to allow the ink supplied to the through-holes to cover the tip ends of the ink guide members and to form desired meniscuses. In the manner described above, the ink ejection head 203 shown in FIG. 16 is produced. In this embodiment, a substrate made of $Al_2O_3$ is used as the insulative substrate, although it is also possible to use a substrate made of different ceramics, such as $ZrO_2$, or a resin such as polyimide.

The third embodiment of the liquid ejection head according to the present invention has been described above, although the present invention is not limited to this embodiment.

Figure 22:
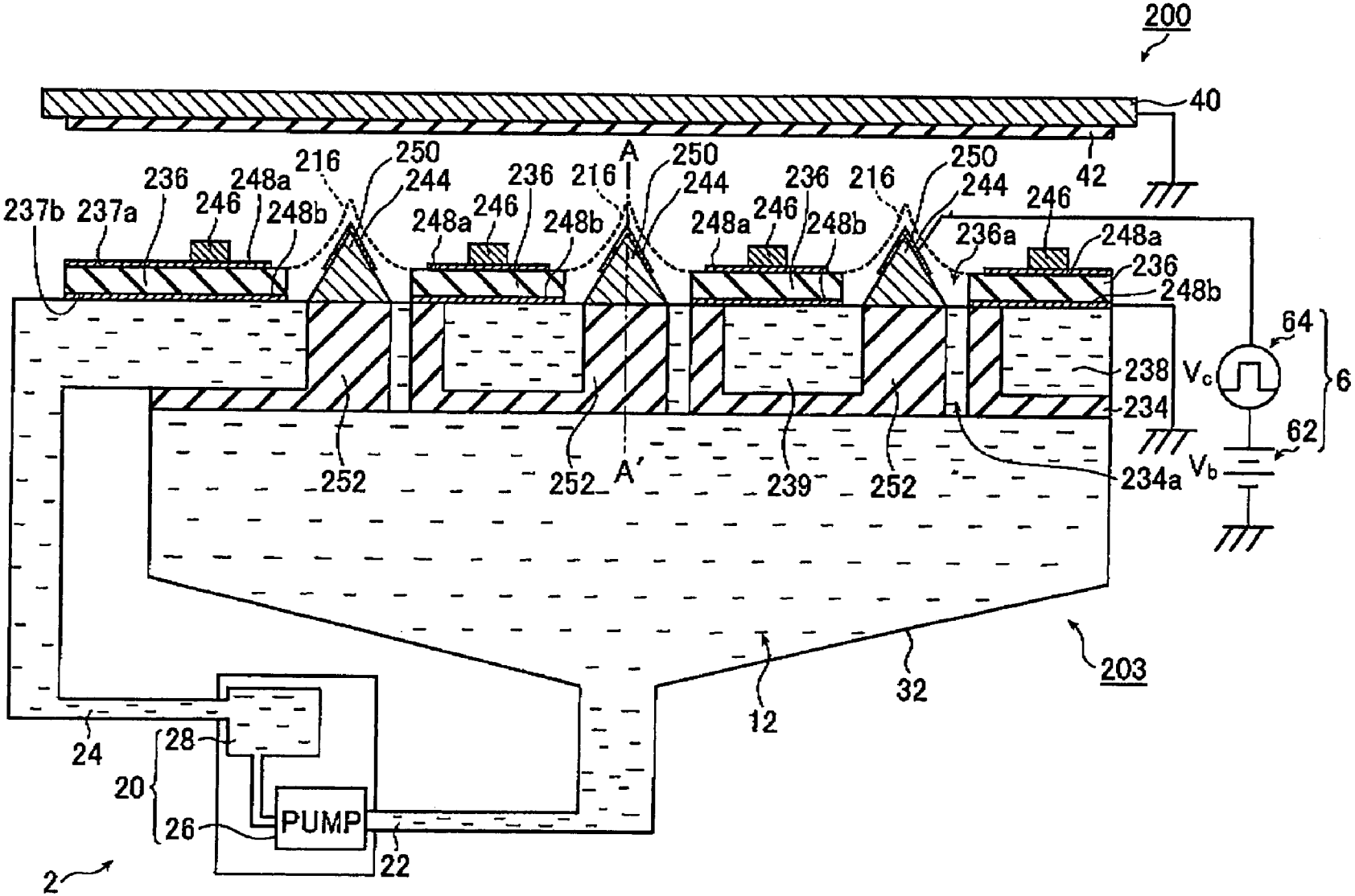
FIG. 22 is a schematic structural diagram of an ink ejection apparatus provided with the ink ejection head according to the third embodiment where separation barriers are additionally formed around the ink guide members.
Figure 23A:
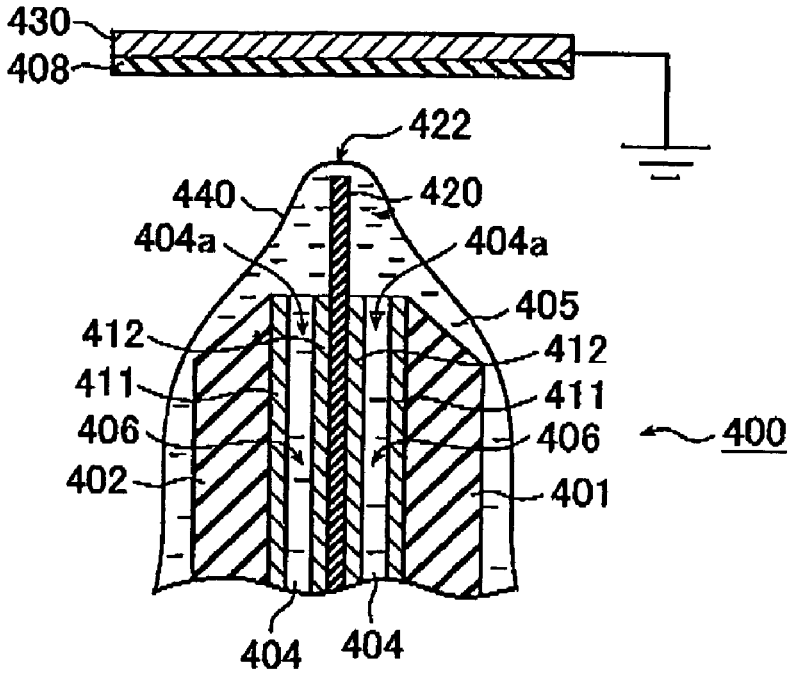
FIG. 23A PRIOR ART
FIGS. 23A and 23B are each a schematic structural diagram of an example of an ink ejection means in a conventional image recording apparatus.
Figure 23B:
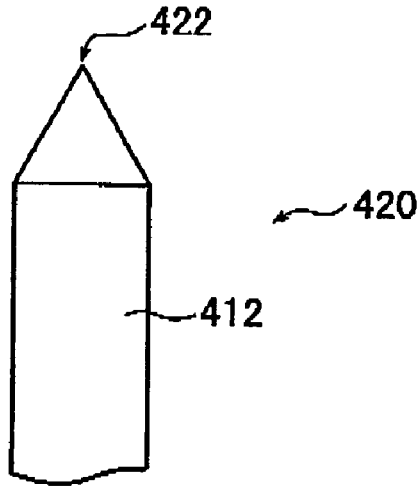
FIG. 23B PRIOR ART
Figure 24:
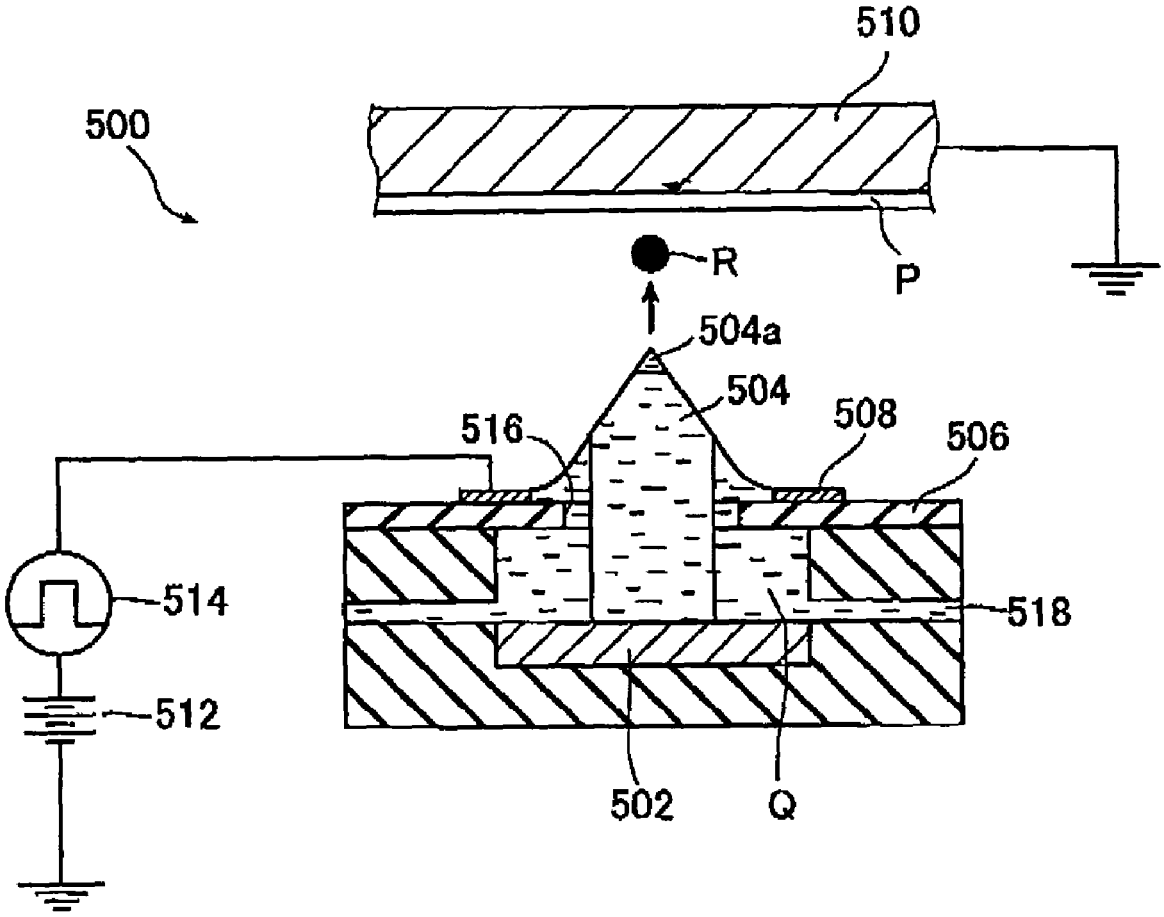
FIG. 24 PRIOR ART
FIG. 24 is a schematic structural diagram of an example of an ink jet head of a conventional ink jet recording apparatus.

For instance, as shown in FIG. 22, it is also possible to provide separation barriers 246 around the ink guide members 250 of the ink ejection head 203. These separation barriers 246 are capable of preventing interferences of meniscuses by separating the meniscus 216 formed at each ink guide member 250 from the meniscuses 216 formed at its adjacent ink guide members 250. Also, the separation barriers 246 are capable of preventing fluctuations of the meniscus 216 at each ink guide member 250 at the time of ejection of ink droplets from its adjacent ink guide members 250. Therefore, in order to maintain the meniscuses 216 formed at the respective ink guide members 250 with stability, it is preferable that the separation barriers 246 are provided. Also, in order to separate the meniscuses 216 formed at the adjacent ink guide members 250 from each other with more reliability by preventing the ink from climbing the wall surfaces of the separation barriers 246, it is preferable that at least the surfaces of the separation barriers 246 have ink repellency. Here, the ink repellency means a water-repellent property in the case of water-based ink and means an oil repellent in the case of oil-based ink.

Also, in this embodiment, the shield electrodes 248*a* and 248*b* are respectively provided on the upper surface 237*a* and the lower surface 237*b* of the insulative substrate 236, although it is not necessarily required to provide these shield electrodes 248*a* and 248*b*. However, when electric fields exerted from the control electrodes 244 in the downward direction in FIG. 19 are shielded with these shield electrodes 248*a* and 248*b*, widening in the horizontal direction in FIG. 19 of the electric fields directed in the downward direction in FIG. 19 is suppressed. Consequently, it becomes possible to prevent electric fields directed in a direction opposite to the moving direction of the ink 12 in the head substrate through-holes 234*a* functioning as the ink supply paths from being formed in the head substrate through-holes 234*a* and to cause the ink 12 containing a stabilized concentration of charged particles to flow out from ink outflow openings 253. As a result, in order to stabilize the concentration of the charged particles in the meniscuses 216 and to stabilize the size and shape of ink droplets to be ejected, it is preferable that the shield electrodes 248*a* and 248*b* are provided.

Further, in this embodiment, the construction shown in FIG. 17B is adopted in which the control electrode 244 provided at the tip end of the ink guide member 250 and the wiring 234*c* formed on the head substrate 234 and connected to the control electrode 244 each contact the ink 12 and the atmosphere. However, the ink ejection head according to the present invention is not limited to this and a construction may be used in which the control electrode 244 and the wiring 234*c* are covered with an insulative film and are prevented from contacting the ink 12 and the atmosphere. With this construction, it becomes possible to prevent short circuits between the respective control electrodes 244 and the wiring, current leakage from the respective control electrodes 244 and the wiring 234*c*, abnormal discharging, and the like. As a result, it becomes possible to prevent a malfunction and an increase of a voltage required for ejection at the time of an ink ejection operation and to eject an ink droplet having a stabilized size and shape at a low voltage with stability. Therefore, in order to eject such an ink droplet with stability, it is preferable that the control electrodes 244 and the wiring are covered with an insulative film.

The solution ejected from the liquid ejection head produced according to this embodiment is not limited to ink containing colorant particles and may be any other kind of solution so long as the solution contains charged particles dispersed in a solvent.

Also, in this embodiment, the liquid ejection head is constructed by bonding the insulative substrate and the head substrate together, so that it becomes possible to prevent fluctuations of a drive voltage resulting from substrate warpage.

Also, in this embodiment, the control electrodes are formed using Au (gold), although the present invention is not limited to this and it is possible to use another arbitrary material, such as a metal or an oxide, so long as the material conducts electricity. For instance, metals like gold, copper, and aluminum are suitable. When the control electrodes are formed using a material that tends to be oxidized, it is also possible to cover the surfaces of the control electrodes with an insulative film or the like to thereby prevent the oxidation. Also, the control electrodes may be formed so as to cover the whole of the pyramid structural members that are the ink guide members or may be formed so as to cover only the tip end portions of the ink guide members.

In this embodiment, a quartz glass ($SiO_2$) substrate is used as the head substrate, although a glass substrate containing an alkaline ion, such as a Pyrex (registered trademark) substrate, may be used instead. In this case, in the production process of the ink ejection head shown in FIG. 20F, it is possible to achieve the joining of the Si substrate using an anode joining method. Also, in the ink ejection head production process shown in FIG. 20F, a solder or a bonding agent that is resistant to KOH etchant may be used to join the Si substrate to the glass substrate.

Also, in this embodiment, as shown in FIG. 21B, the shape of the opening portion of the head substrate through-hole 234*a* is set as rectangular, although the present invention is not limited to this and the opening portion may be formed in any other shape such as a circular shape, an oval shape, or an arbitrary polygonal shape.

In the ink ejection head production process shown in FIG. 20G of this embodiment, an $SiO_2$ mask is used as an etching mask for forming the Si square-pole structure using the $SF_6$ reaction gas, although a mask made of a metal (such as Cr or Al) that is resistant to a fluorine-based gas may be used instead.

Also, in the ink ejection head production process shown in FIG. 20H, the Si square-pole structure is formed through dry etching using the $SF_6$ reaction gas, although the same pole-shaped structure may be produced by directly processing the Si substrate using a microprocessing method, such as sand blasting or ultrasonic processing, instead of or in combination with the dry etching.

In this embodiment, the sharply pointed ink guide members are produced through anisotropic etching of an Si single crystal substrate. In the present invention, however, the material of the single crystal substrate is not limited to Si so long as it is possible to produce such sharply pointed ink guide members through the anisotropic etching. For instance, the ink guides may be made of a compound semiconductor single crystal substrate or the like using the ink ejection head production method of this embodiment so long as it is possible to produce such sharply pointed ink guides through the anisotropic etching.

Also, in this embodiment, through the anisotropic etching, the ink guide members are produced as pyramid structural members whose inclined surfaces are each formed by a high-order crystalline plane and tip end has been sharply pointed. In the present invention, however, it is not necessarily required to form the inclined surfaces of the ink guides by such high-order crystalline places and may be formed by (111) planes, for instance.

Also, in this embodiment, the tip ends of the ink guide members are set so as to have a tip end angle of 60° or less and a radius of curvature of 4 μm or less. In the present invention, however, the tip ends of the ink guide members are not necessarily formed so as to be sharply pointed by such a high degree so long as it is possible to eject droplets from the tip ends of the ink guide members with stability at a desired ejection voltage. However, in order to eject the ink with more stability while further reducing the ejection voltage, it is desirable that the tip ends of the ink guide members are produced so as to have a tip end angle of 60° or less and a radius of curvature of 4 μm or less.

In each of the embodiments described above, the ink guides and the ink guide members are quadrangular pyramid-shaped structural members but this is not the sole case of the present invention. The ink guides and the ink guide members are not limited to any particular pyramid structural members so long as they each have at least one inclined surface. To be more specific, they may be each a polyangular pyramid-shaped structural member having flat inclined surfaces (e.g., a hexangular pyramid-shaped structural member or an octangular pyramid-shaped structural member), or a pyramid-shaped structural member having a curved inclined surface (e.g., a circular cone-shaped structural member). In both cases, the inclined surface(s) may also be stepped.

The ink ejection head and the production method thereof according to the prevent invention have been described in detail above, although the present invention is not limited to the embodiments described above and it is of course possible to make various modifications and changes without departing from the gist of the present invention.

What is claimed is:

1. A method for producing a liquid ejection head that ejects a solution, in which charged particles are dispersed, toward a counter electrode, comprising:

a head substrate;

a solution guide member formed on a surface of the head substrate so as to protrude and include a sharp-pointed portion having a sharply pointed tip end, with the sharp-pointed portion being formed by at least one of inclined surfaces and having a cross section that is reduced as a distance to the tip end is decreased; and a solution supply path having a solution outflow opening through which the solution flows out to the neighborhood of the sharp-pointed portion so as to form a solution flow around the inclined surfaces of the solution guide member, wherein the solution flow is formed around the tip end of the sharp-pointed portion in a direction going across the inclined surfaces and a part of the solution flow is guided to the tip end and is ejected as a droplet by means of an electrostatic force, wherein the solution supply path is formed by a solution guide member through-hole formed in a direction from a base portion of the solution guide member to the sharp-pointed portion, and wherein the solution guide member through-hole is connected with a head substrate through-hole formed in the head substrate on which the solution guide member is provided, and the solution is supplied from a surface of the head substrate on a side opposite to the surface of the head substrate, on which the solution guide member is provided, and passes through the head substrate through-hole, the method comprising the steps of:

forming a photosensitive resin layer on the head substrate having the head substrate through-hole;

molding a convex portion forming the sharp-pointed portion on a surface of the photosensitive resin layer in proximity to the head substrate through-hole by pressing a mold substrate against the surface of the photosensitive resin layer;

exposing and photosensitizing the photosensitive resin layer in one of (i) a region corresponding to at least a part of the convex portion and a peripheral portion surrounding the head substrate through-hole of the head substrate and (ii) a region except for at least the corresponding region; and developing the photosensitized photosensitive resin layer to form the solution guide member on the head substrate and the solution guide member through-hole that is connected with the head substrate through-hole and forms the solution supply path.

2. A method for producing a liquid ejection head including a first substrate, a protrusion portion that protrudes from the first substrate and has a protrusion end forming an upper surface, a solution guide that is made of a single crystal material on the upper surface and ejects a solution guided to a sharply pointed tip end portion as a droplet by means of an electrostatic force, and a second substrate that has a through-hole, in which the solution guide is provided so as to protrude from a substrate surface, is joined to the upper surface, and is fixed to and supported by the protrusion portion, the method comprising the steps of:

producing a first head member through processing of an insulative substrate so that a convex portion forming the protrusion portion is formed on a plate-shaped substrate, with the convex portion having an upper surface at a protrusion end;

joining the upper surface of the convex portion to a single crystal substrate and integrating the first head member with the single crystal substrate;

producing a sharp-pointed portion forming the solution guide at a predetermined position on the upper surface of the convex portion by performing anisotropic wet etching of the single crystal substrate; and aligning a second head member forming the second substrate, which has a through-hole established at a predetermined position, with a predetermined position so that the sharp-pointed portion passes through the through-hole, and joining and fixing a surface of the second head member to the upper surface of the protrusion portion.

3. The method for producing a liquid ejection head according to claim 2, wherein the sharp-pointed portion forming the solution guide is produced at the predetermined position on the upper surface of the convex portion by forming projections and depressions in a surface of the single crystal substrate through anisotropic dry etching and then performing anisotropic wet etching of the projection of the single crystal substrate.

4. The method for producing a liquid ejection head according to claim 2, wherein a plurality of sharp-pointed portions that each form the solution guide are produced through anisotropic wet etching of the single crystal substrate, and the second head member forming the second substrate and having a plurality of through-holes at predetermined positions is aligned with the predetermined position so that the sharp-pointed portions respectively pass through the through-holes, and the surface of the second head member is joined and fixed to the upper surface of the protrusion portion.

5. A method for producing a liquid ejection head that ejects a solution containing charged particles onto a recording medium by utilizing an electrostatic force, said head comprising:

a head substrate;

an insulative substrate positioned on the head substrate and having ejection openings for ejecting the solution; and solution guide members formed on the head substrate, each including a tip end portion protruding through each ejection opening of the insulative substrate, wherein a control electrode, to which a voltage for controlling the ejection of the solution from each ejection opening is to be applied, is formed in the tip end portion of each solution guide member, and each set of through-hole passing through the head substrate in a thickness direction and a recovery groove for recovering the solution from each ejection opening is formed in the head substrate for each ejection opening, with the through-hole communicating with a corresponding ejection opening and a space defined by the recovery groove and the insulative substrate also communicating with the corresponding ejection opening, the method comprising the steps of:

forming each set of the recovery groove and the through-hole for each corresponding ejection opening by performing dry etching on the head substrate in the thickness direction;

integrating the head substrate and a single crystal substrate by joining the single crystal substrate to the head substrate in a side where each recovery groove is formed;

forming each solution guide member, between the recovery groove and the through-hole in each set on a surface of the side where each recovery groove of the head substrate is formed, by performing dry etching and anisotropic etching on the single crystal substrate; and forming each control electrode in the tip end portion of each solution guide member by forming a metallic film on the tip end portion of each solution guide member.

* * * * *